US011649028B2

(12) United States Patent
Boyer et al.

(10) Patent No.: US 11,649,028 B2
(45) **Date of Patent: *May 16, 2023**

(54) WATERCRAFT HAVING AN INTERFACE FOR MOUNTING A PROPULSION MECHANISM

(71) Applicant: PELICAN INTERNATIONAL INC., Laval (CA)

(72) Inventors: Réjean Boyer, Laval (CA); Vincent Drouin, Laval (CA); Isabelle Dubreuil, Laval (CA)

(73) Assignee: PELICAN INTERNATIONAL INC., Laval (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/679,845

(22) Filed: Feb. 24, 2022

(65) Prior Publication Data

US 2022/0380012 A1 Dec. 1, 2022

Related U.S. Application Data

(63) and a continuation-in-part of application No. 17/089,639, filed on Nov. 4, 2020, now Pat. No.
(Continued)

(51) Int. Cl.
*B63H 16/08* (2006.01)
*B63B 34/20* (2020.01)
(Continued)

(52) U.S. Cl.
CPC ..... *B63H 16/08* (2013.01); *B63B 34/20* (2020.02); *B63B 34/26* (2020.02); *B63H 16/04* (2013.01)

(58) Field of Classification Search
CPC ..... B63H 16/08; B63H 16/04; B63B 34/20; B63B 34/26
See application file for complete search history.

(56) References Cited

U.S. PATENT DOCUMENTS 3,376,842 A 4/1968 Wynne
3,982,496 A 9/1976 Blanchard
(Continued)

FOREIGN PATENT DOCUMENTS

CN 111055986 A 4/2020
WO WO 2019/021062 A1 1/2019

OTHER PUBLICATIONS

Adventure Boats, Race to Alaska, Boats.com, Jul. 23, 2015, by Staff, Jul. 23, 2015, downloaded from https://www.boats.com/on-the-water/adventure-boats-race-to-alaska/, 9 pgs.
(Continued)

*Primary Examiner* — Stephen P Avila
(74) *Attorney, Agent, or Firm* — Morgan, Lewis & Bockius LLP

(57) ABSTRACT

The invention relates to an interface for mounting a propulsion mechanism to a watercraft such as a fishing kayak, and to a watercraft comprising such an interface. The interface comprises a first portion including a first plate with a hole sized and shaped for receiving therethrough a portion of the propulsion mechanism, a second portion including a second plate and one channel extending from the second plate, the channel being in registry with the hole of the first portion for therein a portion of the propulsion mechanism. The interface also comprises fastening assemblies for removably fastening the second portion to the first portion of the interface, and a guiding assembly for maintaining the channel of the second portion in registry with the hole of the first portion.

30 Claims, 49 Drawing Sheets

Related U.S. Application Data

11,447,221, which is a continuation of application No. 16/287,989, filed on Feb. 27, 2019, now Pat. No. 10,829,189.

(60) Provisional application No. 63/153,357, filed on Feb. 24, 2021.

(51) Int. Cl.
*B63H 16/04* (2006.01)
*B63B 34/26* (2020.01)

(56) References Cited

U.S. PATENT DOCUMENTS

| | | | | |
|---|---|---|---|---|
| 4,040,378 | A * | 8/1977 | Blanchard | B63H 5/07 440/52 |
| 4,228,751 | A | 10/1980 | Robertson et al. | |
| 5,362,264 | A | 11/1994 | Parant | |
| 5,460,552 | A | 10/1995 | Blanchard et al. | |
| 6,022,249 | A | 2/2000 | Ketterman | |
| 6,458,004 | B2 | 10/2002 | Van Breems | |
| 6,609,939 | B1 | 8/2003 | Towner et al. | |
| 7,007,628 | B1 | 3/2006 | Conley | |
| 7,182,657 | B2 * | 2/2007 | Mansson | B63H 21/305 440/52 |
| 7,294,031 | B1 | 11/2007 | Davis et al. | |
| 7,430,976 | B2 | 10/2008 | Ketterman et al. | |
| 7,637,791 | B2 | 12/2009 | Ketterman et al. | |
| 7,690,959 | B1 | 4/2010 | Szilagyi et al. | |
| 7,867,046 | B1 | 1/2011 | Eichinger | |
| 8,011,983 | B1 | 9/2011 | Davis et al. | |
| 8,082,871 | B2 * | 12/2011 | Czarnowski | B63B 34/22 114/345 |
| 8,453,589 | B2 | 6/2013 | Czamowski et al. | |
| 8,506,338 | B2 | 8/2013 | Gallato et al. | |
| 8,740,662 | B2 | 6/2014 | Gallato et al. | |
| 8,753,156 | B2 | 6/2014 | Ketterman et al. | |
| 8,869,731 | B2 | 10/2014 | Dow et al. | |
| 9,359,052 | B2 | 6/2016 | Ketterman et al. | |
| 9,475,559 | B2 | 10/2016 | Czarnowski et al. | |
| 9,527,555 | B2 | 12/2016 | Ketterman et al. | |
| 9,604,703 | B2 | 3/2017 | Kardas et al. | |
| 9,623,944 | B2 | 4/2017 | Kuehmichel et al. | |
| 9,701,367 | B2 | 7/2017 | McDonough et al. | |
| 9,731,802 | B2 | 8/2017 | Ketterman et al. | |
| 9,738,362 | B2 | 8/2017 | Ketterman et al. | |
| 9,914,519 | B2 | 3/2018 | Nutz et al. | |
| 9,981,726 | B2 | 5/2018 | Ketterman et al. | |
| 10,005,531 | B1 | 6/2018 | Broadway et al. | |
| 10,220,924 | B1 | 3/2019 | Horvath et al. | |
| 10,259,553 | B2 | 4/2019 | Dow et al. | |
| 10,829,189 | B2 * | 11/2020 | Boyer | B63H 16/16 |
| 2005/0272321 | A1 | 12/2005 | Mansson | |
| 2008/0029010 | A1 | 2/2008 | Ketterman et al. | |
| 2008/0029011 | A1 | 2/2008 | Czarnowski et al. | |
| 2009/0031941 | A1 | 2/2009 | Czarnowski et al. | |
| 2009/0042461 | A1 | 2/2009 | Walton | |
| 2010/0025889 | A1 | 2/2010 | Riggins et al. | |
| 2016/0121987 | A1 | 5/2016 | Nutt et al. | |
| 2018/0001986 | A1 | 1/2018 | Nutz et al. | |
| 2018/0009515 | A1 | 1/2018 | Murphy | |
| 2019/0061895 | A1 * | 2/2019 | Dow | B63H 1/36 |
| 2020/0269963 | A1 | 8/2020 | Boyer et al. | |

OTHER PUBLICATIONS

Boyer, Office Action, U.S. Appl. No. 17/089,639, dated Feb. 4, 2022, 6 pgs.
Boyer, Office Action, U.S. Appl. No. 16/287,989, dated Feb. 4, 2020, 7 pgs.
Boyer, Notice of Allowance, U.S. Appl. No. 17/089,639, dated Jul. 20, 2022, 7 pgs.
Boyer, Notice of Allowance, U.S. Appl. No. 16/287,989, dated Jul. 7, 2020, 7 pgs.
Boyer, Notice of Allowance, U.S. Appl. No. 17/511,494, dated Feb. 3, 2022, 8 pgs.
Boyer, Notice of Allowance, U.S. Appl. No. 17/511,494, dated May 17, 2022, 5 pgs.
Hobie Cat Company, LLC'S Response to Pelican International Inc.'s Complaint for Patent Infringement; and Counterclaims, Case 3:20-cv-02390-BAS-MSB Document 13 Filed Feb. 11, 2021 Page ID 85, 15 pgs.
*Pelican International Inc.* v. *Hobie Cat Company and Hobie Cat Company II, LLC*, Defendants and Counterlclaimants Hobie Cat's Invalidity Contentions, dated May 6, 2021, 55 pgs.
Appendix 1, May 6, 2021, Invalidity Claim Chart re Groeschel Group, 331 pgs.
Appendix 2, May 6, 2021, Invalidity Claim Chart re Czarnowski, 104 pgs.
Appendix 3, May 6, 2021, Invalidity Claim Chart re Dow, 54 pgs.
Appendix 4, May 6, 2021, Invalidity Claim Chart re Lanxess, 189 pgs.
Appendix 5, May 6, 2021, Invalidity Claim Chart re Blanchard, 53 pgs.
Appendix 6—Invalidity Claim Chart re Parant, 26 pgs.
Lanxess, Engineering Plastics, Joining Techniques, Copyright © 2005 Lanxess Corporation, 38 pgs.
Lanxess, Engineering Plastics, Parts and Mold Design, Copyright © 2007 Lanxess Corporation, 170 pgs.
*Redacted Pelican International Inc.* v. *Hobie Cat Company and Hobie Cat Company II, LLC*, Defendants and Counterlclaimants Hobie Cat's PLR 3.6(b) Disclosure of Amended Invalidity Contentions, dated Jul. 22, 2021, Case No. 20-cv-2390-BAS-MSB, 59 pgs.
Amended Appendix 1, Jul. 22, 2021, Invalidity Claim Chart re Groeschel, 123 pgs.
Amended Appendix 2, Jul. 22, 2021, Invalidity Claim Chart re Czarnowski, 54 pgs.
Amended Appendix 3, Jul. 22, 2021, Invalidity Claim Chart re Dow, 33 pgs.
Amended Appendix 4, Jul. 22, 2021, Invalidity Claim Chart re Lanxess, 61 pgs.
Amended Appendix 5, Jul. 22, 2021, Invalidity Claim Chart re Blanchard, 22 pgs.
Amended Appendix 6, Jul. 22, 2021, Invalidity Claim Chart re Parant, 25 pgs.
Amended Appendix 7, Jul. 22, 2021, Invalidity Claim Chart re Szilagyi, 103 pgs.
*Pelican International Inc., a Canadian corporation*, Plaintiff, v. *Hobie Cat Company, a Missouri corporation, and Hobie Cat Company II, LLC, a Delaware limited liability company*, Defendants and *Hobie Cat Company, a Missouri corporation, and Hobie Cat Company II, LLC, a Delaware limited liability company*, Counterclaimants, v. *Pelican International Inc., a Canadian corporation*, Counterdefendant, Declaration of TY Southerland, dated Jan. 16, 2022, Case No. 20-cv-2390-BAS-MSB, 8 pgs.
*Pelican International Inc., a Canadian corporation*, Plaintiff, v. *Hobie Cat Company, a Missouri corporation, and Hobie Cat Company II, LLC, a Delaware limited liability company*, Defendants and *Hobie Cat Company, a Missouri corporation, and Hobie Cat Company II, LLC, a Delaware limited liability company*, Counterclaimants, v. *Pelican International Inc., a Canadian corporation*, Counterdefendant, Declaration of Robert Morton, dated Jan. 13, 2022, Case No. 20-cv-2390-BAS-MSB, 25 pgs.
*Pelican International Inc.*, Plaintiff, v. *Hobie Cat Company, et al.*, Defendants, Claim Construction Order for U.S. Pat. No. 10,829,189, Case No. 20-cv-23 90-BAS-MSB, Document 77 filed Feb. 1, 2022, 71 pgs.
*Pelican International Inc.*, Plaintiff, v. *Hobie Cat Company, a Missouri corporation, and Hobie Cat Company II, LLC*, Defendants and *Hobie Cat Company, and Hobie Cat Company II, LLC*, Counterclaimants, v. *Pelican International Inc.*, Counterdefendant, Public version, Expert Report of Dr. Wendy Sanders, Feb. 11, 2022, 102 pgs.
Public Version, Feb. 11, 2022, Exhibit A Sanders CV, 5 pgs.
Public Version, Feb. 11, 2022, Ex B Sanders testimony list, 2 pgs.

(56) References Cited

OTHER PUBLICATIONS

Public Version, Feb. 11, 2022, Ex C List of Materials Considered, 9 pgs.
Public Version, Feb. 11, 2022, Appendix A Czamowski, 40 pgs.
Public Version, Feb. 11, 2022, Appendix B Hobie Dinghy, 45 pgs.
Public Version, Feb. 11, 2022, Appendix C Raptor G2, 44 pgs.
Public Version, Feb. 11, 2022, Appendix D Groeschel, 47 pgs.
*Pelican International Inc.*, Plaintiff v. *Hobie Cat Company and Hobie Cat Company II, LLC*, Defendants. *Hobie Cat Company and Hobie Cat Company II, LLC*, Counterclaimants, v. *Pelican International Inc.*, Counterdefendant, Rebuttal Expert Report of Dr. Wendy Sanders, dated Mar. 16, 2022, Case No. 20-cv-2390-BAS-MSB, 151 pgs.
*Pelican International Inc., a Canadian corporation*, Plaintiff and Counterdefendant, v. *Hobie Cat Company, a Missouri corporation, and Hobie Cat Company II, LLC, a Delaware limited liability company*, Defendants and Counterclaimants. *Hobie Cat Company, a Missouri corporation, and Hobie Cat Company II, LLC, a Delaware limited liability company*, Counterclaimants, v. *Pelican International Inc., a Canadian corporation*, Counterdefendant, Rebuttal Expert Report of Dr. Kevin Maki, Mar. 16, 2022, Case No. 20-cv-2390-BAS-MSB, 172 pgs.
*Pelican International Inc.*, Plaintiff v. *Hobie Cat Company and Hobie Cat Company II, LLC*, Defendants. *Hobie Cat Company and Hobie Cat Company II, LLC*, Counterclaimants, v. *Pelican International Inc.*, Counterdefendant, Rebuttal Expert Report of Dr. Wendy Sanders Responding to Purported Additional Evidence of Secondary Considerations, dated Mar. 23, 2022, Case No. 20-cv-23 90-BAS-MSB, 14 pgs.
*Pelican International Inc.,a Canadian corporation*, Plaintiff v. *Hobie Cat Company, a Missouri corporation, and Hobie Cat Company II, LLC, a Delaware limited liability company*, Defendants, *Hobie Cat Company, a Missouri Corporation, and Hobie Cat Company II, LLC, a Delaware limited liability company*, Counterclaimants, v. *Pelican International Inc., a Canadian corporation*, Counterdefendant, Defendant Hobif'S Notice Pursuant To 3 5 U.S.C. § 282, Jul. 6, 2022, Case No. 20-cv-2390-BAS-MSB, 10 pgs.
Czarnowski et al., U.S. Appl. No. 60/836,166, "Twist-N-Seal-Hatch," filed Aug. 7, 2006, 19 pgs.
Ketterman et al., U.S. Appl. No. 60/835,271, "Twist and Stow Rudder," filed Aug. 2, 2006, 21 pgs.
Jim Czamowski, Hobie Dinghy, 2011, 8 pgs.
Hobie Inflatable Kayak Range (i9, i12, i11, i14T), 2007.
Hobie, Eclipse Stand-up Pedalboards (ACX, Dura), 2016, 1 pgs.
Hobie, Hobie BIC Eclipse, 2016.
Santa Cruz Kayaks Raptor G2 Kayak, 2016.
YouTube video titled "Kayak Fishing-Kayak Review Santa Cruz Raptor G2," Jul. 25, 2016, 30milesQut (also known as Ty Southerland), 1 pgs.
YouTube video titled "1st G2 pedal thm," dMay 8, 2016, Jim Martin, 1 pg.
Facebook posts on page titled "Santa Cruz Kayaks," re Raptor G2 Kayak, Mar. 2, 2016, Santa Cruz Kayaks, 8 pgs.
Hobie.com/forum blog post title "Thermoformed Hulls,"Oct. 30, 2013, fusioneng (also known as Robert Morton), 12 pgs.
Hobie.com/forum blog post title New Pelican Pedal Kayak, Jul. 10, 2018, fusioneng (also known as Robert Morton), 4 pgs.
Hobie.com/forum blog post titled "New Pelican Pedal Kayak," fusioneng (also known as Robert Morton), Jul. 11, 2018, 2 pgs.
Hobie Mirage Drive Users Will Get Over Pelican's HyDryve, FishingTech, Oct. 25, 2018, FishingTech, 2 pgs.
Small Craft-Hull Construction and Scantlings, ISO 12215:2008, 2008, International Organization for Standardization, 298 pgs.
Rules for Building and Classing Reinforced Plastic Vessels, 1978, American Bureau of Shipping, 168 pgs.
Outboard Engine Mounting Guide, ABYC TH-12 2017, 2017, The American Boat & Yacht Council, 12 pgs.
Pelican International, Inc., International Search Report and Written Opinion, PCT/IB2022/051658, dated Jun. 15, 2022, 11 pgs.
Boyer, Office Action, U.S. Appl. No. 17/886,404, dated Jan. 23, 2023, 6 pgs.

* cited by examiner

WATERCRAFT HAVING AN INTERFACE FOR MOUNTING A PROPULSION MECHANISM

CROSS-REFERENCE TO RELATED APPLICATIONS

This is a continuation in part of U.S. patent application Ser. No. 17/089,639, filed Nov. 4, 2020, which is a continuation of U.S. patent application Ser. No. 16/287,989, filed Feb. 27, 2019, both titled "INTERFACE FOR MOUNTING A PROPULSION MECHANISM TO A WATERCRAFT," now U.S. Pat. No. 10,829,189, and this application claims the benefit of U.S. Provisional Patent Application No. 63/153,357, filed Feb. 24, 2021 and titled "INTERFACE FOR MOUNTING A PROPULSION MECHANISM TO A WATERCRAFT," all of which are hereby incorporated by reference herein in their entirety.

TECHNICAL FIELD

The invention relates to an interface for mounting a propulsion mechanism to a watercraft, and to a watercraft that includes such an interface.

BACKGROUND OF THE ART

Various pedal operated propulsion mechanisms exist for propelling watercrafts such as kayaks. Such pedal operated propulsion mechanisms are becoming increasingly popular in fishing kayaks since users can propel their watercraft using only their feet while their hands remain available for holding fishing rods and the like.

One type of pedal operated propulsion mechanism comprises a pedals that operatively connect to a pair of flappers adapted to oscillate through arcuate paths in a generally transverse direction with respect to the central longitudinal dimension of the watercraft. Such pedal operated propulsion mechanisms are typically mounted to a receptacle in the hull or body of the kayak. In these designs, the pedal operated propulsion mechanism is directly supported by and coupled to the hull of the kayak. While this configuration may be suitable in many instances, the reciprocating movement induced on the pedals tends to urge slight movement of the foot propulsion mechanism relative to the hull of the kayak, which causes damages to the hull over time. Since the hull itself defines the support for the foot propulsion mechanism, the entire hull must be replaced when such damage occurs. Furthermore, the manufacturing of such a hull by thermoforming may prove onerous since the crafting of the receptacle for the propulsion mechanism typically requires a worker to carefully cut out the opening for receiving the foot propulsion mechanism, which tends to slow down the manufacturing process.

Therefore, it would be desirable to be provided with an interface for a watercraft that alleviates at least some of the above-identified drawbacks.

SUMMARY

According to a broad aspect, there is provided an interface for mounting a propulsion mechanism to a watercraft including a rigid body having a deck portion, a hull portion and a well extending between the deck portion and the hull portion. In this broad aspect, the interface comprises:

a first portion including a first plate positionable adjacent to one of the hull portion and the deck portion of the watercraft, about the periphery of the well, and at least one channel extending from the second plate, the channel being positionable in the well, in registry with the hole of the first portion, the channel being sized and shaped for receiving therein a portion of the propulsion mechanism and for mounting the propulsion mechanism to the interface; and at least one fastening assembly for removably fastening the first portion to the body of the watercraft.

In one feature, the interface further comprises a second portion including a second plate positionable adjacent to the other of the hull portion and the deck portion of the watercraft, about the periphery of the well, the second plate comprising a hole sized and shaped for receiving therethrough a portion of the propulsion mechanism. In this feature, the hole is positionable in registry with the well, and the at least one fastening assembly is further configured for removably fastening the second portion of the interface to the body of the watercraft.

In another feature, the first portion is a top portion and the first plate is a top plate, and wherein the second portion is a bottom portion and the second plate is a bottom plate.

In yet another feature, the channel is adapted for removably securing the propulsion mechanism to the interface.

In still another feature, the at least one fastening assembly is configured for removably fastening the first portion to the second portion of the interface. Preferably, the at least one fastening assembly includes a first segment engaging the first portion of the interface and a second segment engaging the second portion of the interface. The first and second segments of the at least one fastening assembly collaborate to force the first and second portions of the interface toward one another to sandwich the body of the watercraft between the first and second plates.

In a further feature, the first segment of the at least one fastening assembly comprises a threaded fastener engaging the first plate of the first portion and the second segment of the at least one fastening assembly comprises a fastening projection provided with a threaded hole, the threaded fastener being engageable in the threaded hole of the fastening projection to force the first and second portions of the interface toward one another.

In yet a further feature, the at least one fastening assembly is further configured for maintaining the channel of the first portion in registry with the hole of the second portion when the at least one fastening assembly is fastened and the channel is spaced-apart from the second plate.

In still a further feature, the at least one fastening assembly comprises four fastening assemblies.

In one feature, the interface further comprises at least one guiding assembly for maintaining the channel of the first portion in registry with the hole of the second portion when the at least one fastening assembly is fastened and the channel is spaced-apart from the second plate. Preferably, the at least one guiding assembly comprises a plurality of fins extending upwardly from the second plate of the second portion, about the periphery of the hole, the fins being configured for positioning the channel of the first portion in registry with the hole of the second portion as the first and second portions of the interface are forced toward one another.

In one feature, the fins extend from at least one of a ridge extending upwardly from the second plate of the second portion, a female portion of a guide assembly and the second segment of the second portion.

In another feature, the at least one guiding assembly comprises a guiding assembly mounted to the at least one fastening assembly.

In still another feature, the propulsion mechanism is a foot propulsion mechanism.

In yet another feature, the propulsion mechanism is an oscillating flapper propulsion mechanism.

In a further feature, the propulsion mechanism is a motorised propulsion mechanism.

In still a further feature, the watercraft is a kayak, and preferably a fishing kayak.

In another feature, the watercraft is a small boat.

In a further feature, the interface further comprises a lock mechanism for removably securing the propulsion mechanism to the interface. Preferably, the lock mechanism is mounted in the channel of the first portion of the interface. More preferably, the propulsion mechanism comprises a shaft including at least projection on one side of the propulsion mechanism, and the channel comprises at least one recess for slidably receiving therein the at least one shaft projection. The lock mechanism is positioned in the channel adjacent to the recess and being movable between a lock position and an unlock position, the lock mechanism in lock position engaging the shaft projection received in the recess to prevent vertical movement of the propulsion mechanism relative to the channel.

According to another broad aspect, there is provided a watercraft comprising:

rigid body having a deck portion, a hull portion and a well extending between the deck portion and the hull portion, an interface for mounting a propulsion mechanism to the body of the watercraft, the interface including:

a first portion including a first plate positionable adjacent to one of the hull portion and the deck portion of the watercraft, about the periphery of the well, and at least one channel extending from the first plate, the channel being positionable in the well, the channel being sized and shaped for receiving therein a portion of the propulsion mechanism and for mounting the propulsion mechanism to the interface; and at least one fastening assembly for removably fastening the first portion to the body of the watercraft.

In one feature, the interface further comprises a second portion including a second plate positionable adjacent to the other of the hull portion and the deck portion of the watercraft, about the periphery of the well, the second plate comprising a hole sized and shaped for receiving therethrough a portion of the propulsion mechanism. In this feature, the hole is positionable in registry with the well, and the at least one fastening assembly is further configured for removably fastening the second portion of the interface to the body of the watercraft.

In another feature, the first portion is a top portion and the first plate is a top plate, and wherein the second portion is a bottom portion and the second plate is a bottom plate.

In yet another feature, the channel is adapted for removably securing the propulsion mechanism to the interface.

In still another feature, the at least one fastening assembly is configured for removably fastening the first portion to the second portion of the interface. Preferably, the at least one fastening assembly includes a first segment engaging the first portion of the interface and a second segment engaging the second portion of the interface. The first and second segments of the at least one fastening assembly collaborate to force the first and second portions of the interface toward one another to sandwich the body of the watercraft between the first and second plates.

In a further feature, the first segment of the at least one fastening assembly comprises a threaded fastener engaging the first plate of the first portion and the second segment of the at least one fastening assembly comprises a fastening projection provided with a threaded hole, the threaded fastener being engageable in the threaded hole of the fastening projection to force the first and second portions of the interface toward one another.

In yet a further feature, the at least one fastening assembly is further configured for maintaining the channel of the first portion in registry with the hole of the second portion when the at least one fastening assembly is fastened and the channel is spaced-apart from the second plate.

In still a further feature, the at least one fastening assembly comprises four fastening assemblies.

In one feature, the interface further comprises at least one guiding assembly for maintaining the channel of the first portion in registry with the hole of the second portion when the at least one fastening assembly is fastened and the channel is spaced-apart from the second plate. Preferably, the at least one guiding assembly comprises a plurality of fins extending upwardly from the second plate of the second portion, about the periphery of the hole, the fins being configured for positioning the channel of the first portion in registry with the hole of the second portion as the first and second portions of the interface are forced toward one another.

In one feature, the fins extend from at least one of a ridge extending upwardly from the second plate of the second portion, a female portion of a guide assembly and the second segment of the second portion.

In another feature, the at least one guiding assembly comprises a guiding assembly mounted to the at least one fastening assembly.

In still another feature, the propulsion mechanism is a foot propulsion mechanism.

In yet another feature, the propulsion mechanism is an oscillating flapper propulsion mechanism.

In a further feature, the propulsion mechanism is a motorised propulsion mechanism.

In still a further feature, the watercraft is a kayak, and preferably a fishing kayak.

In another feature, the watercraft is a small boat.

In a further feature, the interface further comprises a lock mechanism for removably securing the propulsion mechanism to the interface. Preferably, the lock mechanism is mounted in the channel of the first portion of the interface. More preferably, the propulsion mechanism comprises a shaft including at least projection on one side of the propulsion mechanism, and the channel comprises at least one recess for slidably receiving therein the at least one shaft projection. The lock mechanism is positioned in the channel adjacent to the recess and being movable between a lock position and an unlock position, the lock mechanism in lock position engaging the shaft projection received in the recess to prevent vertical movement of the propulsion mechanism relative to the channel.

According to another broad aspect, there is provided an interface for mounting a propulsion mechanism to a watercraft including a rigid body having a deck portion, a hull portion and a well extending between the deck portion and the hull portion. In this broad aspect, the interface comprises:

a first portion including a first plate positionable adjacent to one of the hull portion and the deck portion of the watercraft, about the periphery of the well, and at least one channel extending from the first plate, the channel being positionable in the well, the channel being sized and shaped for receiving therein a portion of the propulsion mechanism and for mounting the propulsion mechanism to the interface;

a second portion including a second plate positionable adjacent to the other of the hull portion and the deck portion of the watercraft, about the periphery of the well, the second plate comprising a hole sized and shaped for receiving therethrough a portion of the propulsion mechanism, the hole being positionable in registry with the well and with the channel of the first portion;

at least one fastening assembly for removably fastening the second portion to the first portion of the interface, the at least one fastening assembly including a first segment engaging the first portion of the interface and a second segment engaging the second portion of the interface, the first and second segments of the at least one fastening assembly collaborating to force the first and second portions of the interface toward one another to sandwich the body of the watercraft between the first and second plates;

at least one guiding assembly for maintaining the channel of the first portion in registry with the hole of the second portion when the at least one fastening assembly is fastened and the channel is spaced-apart from the first plate.

According to yet another broad aspect, there is provided a watercraft comprising:

rigid body having a deck portion, a hull portion and a well extending between the deck portion and the hull portion, an interface for mounting a propulsion mechanism to the body of the watercraft, the interface including:

a first portion including a first plate positionable adjacent to one of the hull portion and the deck portion of the watercraft, about the periphery of the well, and at least one channel extending from the first plate, the channel being positionable in the well, the channel being sized and shaped for receiving therein a portion of the propulsion mechanism and for mounting the propulsion mechanism to the interface;

a second portion including a second plate positionable adjacent to the other of the hull portion and the deck portion of the watercraft, about the periphery of the well, the second plate comprising a hole sized and shaped for receiving therethrough a portion of the propulsion mechanism, the hole being positionable in registry with the well and with the channel of the first portion;

at least one fastening assembly for removably fastening the second portion to the first portion of the interface, the at least one fastening assembly including a first segment engaging the first portion of the interface and a second segment engaging the second portion of the interface, the first and second segments of the at least one fastening assembly collaborating to force the first and second portions of the interface toward one another to sandwich the body of the watercraft between the first and second plates;

at least one guiding assembly for maintaining the channel of the first portion in registry with the hole of the second portion when the at least one fastening assembly is fastened and the channel is spaced-apart from the first plate.

In some aspects, a kayak includes a substantially rigid body having a deck side, a hull side, and a well extending through the deck side and the hull side; an interface for mounting a foot-driven propulsion mechanism to the substantially rigid body, the interface including: a first portion near to the hull side or the deck side, the first portion comprising a first hole for allowing passage of at least a portion of the foot-driven propulsion mechanism therethrough; a second portion near to the other of the hull side or the deck side on an opposite side of the well from the first portion, the second portion comprising a second hole for allowing passage of at least a portion of the foot-driven propulsion mechanism therethrough, wherein the second portion is a separate component from at least the first portion; and a channel structure disposed in the well between the first portion and the second portion, the channel structure being sized and shaped for allowing passage of a portion of the foot-driven propulsion mechanism therethrough and for removably securing the foot-driven propulsion mechanism to the interface. A distal end of the channel structure is securely coupled to the first portion and/or the second portion.

In some implementations, the channel structure is glued to the first portion and/or the second portion. The distal end of the channel structure securely mates with the first portion and/or the second portion via a projection and a corresponding recess. The distal end of the channel structure securely mates with the first portion and/or the second portion via multiple projections and corresponding recesses. The channel structure is integrally formed with, and extends away from, the first portion, and multiple projections and corresponding recesses mate with one another to couple the channel structure with the second portion.

In some implementations, the channel structure is glued to the second portion. The channel structure is plastic-welded to the first portion or second portion. In some implementations, the kayak further includes drainage holes in the interface through which water can drain. In some implementations, the interface further comprises at least one guide extending from the second portion to align the channel structure with the second hole of the second portion.

In some implementations, the at least one guide defines a lip for receiving a portion of the channel structure thereon. In some implementations, the lip extends at least partially around a periphery of the second hole of the second portion. In some implementations, the well structure includes a recess near the deck side and a recess near the hull side, wherein each of the first portion and the second portion are disposed within a respective recess at the hull side or the deck side. In some implementations, the interface further comprises at least one guide extending from the first portion to align the channel structure with the first hole of the first portion.

In some implementations, the interface and the substantially rigid body of the kayak are formed by different plastic molding processes. In some implementations, the kayak further includes drainage holes in the interface through which water can drain. In some implementations, the kayak further includes a fastener for coupling the interface to the kayak, wherein the fastener comprises either screws and corresponding holes or a snapfit. In some implementations, the interface is removably coupled to the kayak.

In another aspect, a kayak includes a substantially rigid body having a deck side, a hull side, and a well extending through the deck side and the hull side, wherein the well includes a recess near the deck side; an interface for mounting a foot-driven propulsion mechanism to the substantially rigid body, the interface including: a first portion disposed in the recess near to the deck side of the kayak; a channel structure extending from the first portion, the channel structure disposed in the well, wherein the channel structure is sized and shaped for receiving therein at least a portion of the foot-driven propulsion mechanism and for removably securing the foot-driven propulsion mechanism to the interface; and multiple screws securing the first portion to the kayak.

In some implementations, the channel structure is integrally formed with the first portion by different plastic molding processes than that used to form the kayak. In some implementations, the channel structure is a separate component from the first portion, wherein both the channel structure and the first portion are formed by different plastic molding processes than that used to form the kayak, and wherein the channel structure is glued to the first portion.

In another aspect, a kayak extending longitudinally between rear and front ends and transversely between left and right sides, the kayak includes a foot-driven propulsion mechanism including first and second shafts with first and second pedals, first and second flappers, and a core body between the first and second shafts and first and second flappers, the core body including first and second projections that include first and second ends. The kayak includes a body having a deck portion with a top side and a hull portion with a bottom side adapted to contact water. The top side includes a top peripheral wall section defining a top opening and the bottom side includes a bottom peripheral wall section defining a bottom opening. The kayak including an interface having top and bottom plates and a channel portion extending between the top and bottom plates. The top plate includes a top peripheral wall section defining a top opening adapted to at least partially receive the foot-driven propulsion mechanism and the bottom plate having a bottom peripheral wall section defining a bottom opening adapted to at least partially receive the foot-driven propulsion mechanism. The channel portion includes an internal peripheral wall defining a hollow space to at least partially receive the foot-driven propulsion mechanism. The internal peripheral wall of the interface includes first and second projections or recesses. The first and second ends of the first and second projections are mounted to the first and second projections or recesses.

In some implementations, the top peripheral wall section of the deck portion includes a top peripheral recess, the bottom peripheral wall section of the deck portion includes a bottom peripheral recess. The top peripheral wall of the interface is received in the top peripheral recess, and the bottom peripheral wall of the interface is received in the bottom peripheral recess.

In some implementations, the top peripheral wall of the interface is snap-fit or friction fit into the top peripheral recess and the bottom peripheral wall of the interface is snap-fit or friction fit into the bottom peripheral recess. In some implementations, the top peripheral wall of the interface is secured to the top peripheral recess with treaded fasteners or rivets and wherein the bottom peripheral wall of the interface is secured to the bottom peripheral recess with treaded fasteners or rivets. In some implementations, the top peripheral wall of the interface is glued or plastic welded to the top peripheral recess and the bottom peripheral wall of the interface is glued or plastic welded to the bottom peripheral recess.

In some implementations, the channel portion of the interface is integrally formed with the top plate or the bottom plate. In some implementations, the first and second projections are rear and front projections, the first and second projections or recesses are rear and front projections or recesses, the core body of the foot-driven propulsion mechanism includes left and right projections having left and right ends. The internal peripheral wall of the interface includes left and right projections or recesses, and the left and right ends of the left and right projections are mounted to the left and right projections or recesses. In some implementations, the channel portion of the interface includes first and second side walls, each of the first and second side walls includes a first recess, a second recess terminating into a lower funnel-shape slot, and a top funnel slot, The first recess has a shape to generally conform to a periphery of the core body of the foot propulsion mechanism, and the lower funnel-shaped slot is adapted to receive left and right transverse projections of the core body of the foot propulsion mechanism. In some implementations, the top funnel slot is adapted to at least partially receive the core body of the foot propulsion mechanism. In some implementations, the kayak includes a lock that is pivotable between an unlocked position and a locked position, in the locked position, movement of the foot propulsion mechanism is prevented. In some implementations, a top side of the top peripheral wall of the interface is generally flush with the top side of the deck portion at a joint between the top peripheral wall and the top side and a bottom side of the bottom peripheral wall of the interface is generally flush with the bottom side of the hull portion at a joint between the bottom peripheral wall and the bottom side. In some implementations, the body is made of a first plastic material having a first rigidity and the interface is made of a second plastic material having a second rigidity, the second rigidity being greater than the first rigidity.

In another aspect, a kayak extending longitudinally between rear and front ends and transversely between left and right sides, the kayak includes: a foot-driven propulsion mechanism having first and second shafts with first and second pedals, first and second flappers, and a core body between the first and second shafts and first and second flappers, the core body having rear and front projections that include rear and front ends. The kayak includes a body having a deck portion with a top side and a hull portion with a bottom side adapted to contact water. The top side includes a top peripheral wall section defining a top opening and the bottom side includes a bottom peripheral wall section defining a bottom opening; and an interface having top and bottom plates and a channel portion extending between the top and bottom plates. The top plate includes a top peripheral wall section defining a top opening adapted to at least partially receive the foot-driven propulsion mechanism and the bottom plate includes a bottom peripheral wall section defining a bottom opening adapted to at least partially receive the foot-driven propulsion mechanism. The channel portion includes an internal peripheral wall defining a hollow space to at least partially receive the foot-driven propulsion mechanism, the internal peripheral wall of the interface includes rear and front side walls, the rear side wall has a rear projection or recesses. The front side wall includes a front projection or recesses. The rear and front ends of the rear and front projections are mounted to the rear and front projections or recesses.

In some implementations, the top peripheral wall section of the deck portion comprises a top peripheral recess, wherein the bottom peripheral wall section of the deck portion comprises a bottom peripheral recess, wherein the top peripheral wall of the interface is received in the top peripheral recess, and wherein the bottom peripheral wall of the interface is received in the bottom peripheral recess.

In some implementations, the top peripheral wall of the interface is snap-fit or friction fit into the top peripheral recess and wherein the bottom peripheral wall of the interface is snap-fit or friction fit into the bottom peripheral recess.

In some implementations, the top peripheral wall of the interface is secured to the top peripheral recess with treaded fasteners or rivets and wherein the bottom peripheral wall of the interface is secured to the bottom peripheral recess with treaded fasteners or rivets.

In some implementations, the top peripheral wall of the interface is glued or plastic welded to the top peripheral recess and wherein the bottom peripheral wall of the interface is glued or plastic welded to the bottom peripheral recess. In some implementations, the channel portion of the interface is integrally formed with the top plate or the bottom plate. In some implementations, the core body of the foot-driven propulsion mechanism includes left and right projections having left and right ends. The internal peripheral wall of the interface includes left and right projections or recesses, and the left and right ends of the left and right projections are mounted to the left and right projections or recesses.

In some implementations, the channel portion of the interface includes first and second side walls. Each of the first and second side walls includes a first recess, a second recess terminating into a lower funnel-shape slot, and a top funnel slot. The first recess has a shape to generally conform to a periphery of the core body of the foot propulsion mechanism, and the lower funnel-shaped slot is adapted to receive left and right transverse projections of the core body of the foot propulsion mechanism.

In some implementations, the top funnel slot is adapted to at least partially receive the core body of the foot propulsion mechanism. In some implementations, the kayak includes a lock that is pivotable between an unlocked position and a locked position, wherein in the locked position, movement of the foot propulsion mechanism is prevented. In some implementations, a top side of the top peripheral wall of the interface is generally flush with the top side of the deck portion at a joint between the top peripheral wall and the top side and a bottom side of the bottom peripheral wall of the interface is generally flush with the bottom side of the hull portion at a joint between the bottom peripheral wall and the bottom side. In some implementations, the body is made of a first plastic material having a first rigidity and the interface is made of a second plastic material having a second rigidity, the second rigidity being greater than the first rigidity.

In another aspect, a kayak extending longitudinally between rear and front ends and transversely between left and right sides, the kayak includes a body having a deck portion with a top side and a hull portion with a bottom side adapted to contact water. The top side includes a top peripheral wall section defining a top opening and the bottom side includes a bottom peripheral wall section defining a bottom opening; and an interface having top and bottom plates and a channel portion extending between the top and bottom plates. The top plate includes a top peripheral wall section defining a top opening adapted to at least partially receive a foot-driven propulsion mechanism and the bottom plate comprising a bottom peripheral wall section defining a bottom opening adapted to at least partially receive the foot-driven propulsion mechanism. The channel portion includes an internal peripheral wall defining a hollow space to at least partially receive the foot-driven propulsion mechanism. The top peripheral wall section of the deck portion comprises a top peripheral recess, wherein the bottom peripheral wall section of the deck portion includes a bottom peripheral recess, the top peripheral wall of the interface is received in the top peripheral recess, and the bottom peripheral wall of the interface is received in the bottom peripheral recess.

In some implementations, the top peripheral wall of the interface is snap-fit or friction fit into the top peripheral recess and wherein the bottom peripheral wall of the interface is snap-fit or friction fit into the bottom peripheral recess.

In some implementations, the top peripheral wall of the interface is secured to the top peripheral recess with treaded fasteners or rivets and wherein the bottom peripheral wall of the interface is secured to the bottom peripheral recess with treaded fasteners or rivets. In some implementations, the top peripheral wall of the interface is glued or plastic welded to the top peripheral recess and the bottom peripheral wall of the interface is glued or plastic welded to the bottom peripheral recess. In some implementations, the channel portion of the interface is integrally formed with the top plate or the bottom plate. In some implementations, the foot-driven propulsion mechanism includes first and second shafts with first and second pedals, first and second flappers, and a core body between the first and second shafts and first and second flappers, the core body having rear and front projections comprising rear and front ends. The internal peripheral wall of the interface includes rear and front side walls, the rear side wall includes a rear projection or recesses. The front side wall includes a front projection or recesses, and the rear and front ends of the rear and front projections are mounted to the rear and front projections or recesses.

In some implementations, the core body of the foot-driven propulsion mechanism includes left and right projections having left and right ends, the internal peripheral wall of the interface includes left and right projections or recesses, and the left and right ends of the left and right projections are mounted to the left and right projections or recesses. In some implementations, the channel portion of the interface includes first and second side walls. Each of the first and second side walls includes a first recess, a second recess terminating into a lower funnel-shape slot, and a top funnel slot. The first recess has a shape to generally conform to a periphery of the core body of the foot propulsion mechanism, and the lower funnel-shaped slot is adapted to receive left and right transverse projections of the core body of the foot propulsion mechanism.

In some implementations, the top funnel slot is adapted to at least partially receive the core body of the foot propulsion mechanism. In some implementations, the kayak includes a lock that is pivotable between an unlock position and a lock position, wherein in the lock position, movement of the foot propulsion mechanism is prevented. In some implementations, a top side of the top peripheral wall of the interface is generally flush with the top side of the deck portion at a joint between the top peripheral wall and the top side and a bottom side of the bottom peripheral wall of the interface is generally flush with the bottom side of the hull portion at a joint between the bottom peripheral wall and the bottom side. In some implementations, the body is made of a first plastic material having a first rigidity and the interface is made of a second plastic material having a second rigidity, the second rigidity being greater than the first rigidity.

In some aspects, a watercraft includes a rigid body having a deck portion, a hull portion and a well extending between the deck portion and the hull portion, an interface for mounting a propulsion mechanism to the body of the watercraft, the interface including: a top plate, a first bottom plate spaced-apart from the first top plate and extending generally parallel thereto, and a first channel portion extending between the first top plate and the first bottom, generally transverse thereto, the first top plate abutting a first peripheral segment of the deck portion, the first bottom plate abutting a first peripheral segment of the hull portion and the first channel portion extending in the well when the first section is mounted to the rigid body. The watercraft includes a second interface section comprising a second top plate, a second bottom plate spaced-apart from the second top plate and extending generally parallel thereto, and a second channel portion extending between the second top plate and the second bottom, generally transverse thereto, the second top plate abutting a second peripheral segment of the deck portion, the second bottom plate abutting a second peripheral segment of the hull portion and the second channel portion extending in the well when the second interface section is mounted to the rigid body. The watercraft includes a fastening assembly for fastening the first and second interface sections either to one another or to the body of the watercraft.

In some implementations, the first interface section is a left interface section and the second interface section is a right interface section. The first interface section is a rear interface section and the second interface section is a front interface section.

In some aspects, a watercraft includes a rigid body having a deck portion, a hull portion and a well extending between the deck portion and the hull portion, an interface for mounting a propulsion mechanism to the rigid body of the watercraft, the interface including: a first plate positionable adjacent to one of the hull portion and the deck portion of the watercraft, about a periphery of the well, the first plate including a first hole, a channel receivable in the first hole and securable to the first plate, the channel being positionable in the well, the channel being sized and shaped for receiving therein a portion of the propulsion mechanism and for mounting the propulsion mechanism to the interface; a securing assembly for securing the channel to the first plate; and at least one fastening assembly for removably fastening the interface to the body of the watercraft.

In some implementations, the interface further includes a second plate positionable adjacent to the other of the hull portion and the deck portion of the watercraft, about the periphery of the well, the second plate comprising a second hole sized and shaped for receiving therethrough a portion of the propulsion mechanism, the hole being positionable in registry with well and with the channel. The securing assembly is further configured for securing the channel to the second plate. The at least one fastening assembly is configured for removably fastening the first plate to the second plate of the interface. The at least one fastening assembly includes a first segment engaging the first plate of the interface and a second segment engaging the second plate of the interface, the first and second segments of the at least one fastening assembly collaborating to force the first and second plates of the interface toward one another to sandwich the rigid body of the watercraft therebetween.

In some aspects, a watercraft includes a rigid body having a deck portion, a hull portion and a well extending between the deck portion and the hull portion, an interface for mounting a propulsion mechanism to the rigid body of the watercraft, the interface including: a first plate positionable adjacent to one of the hull portion and the deck portion of the watercraft, about a periphery of the well, the first plate including a first hole, a second plate positionable adjacent to the other of the hull portion and the deck portion of the watercraft, about the periphery of the well, the second plate including a second hole, a channel receivable in the first hole and securable to the first plate, the channel being positionable in the well, the channel being sized and shaped for receiving therein a portion of the propulsion mechanism and for mounting the propulsion mechanism to the interface, the channel being further positionable in registry with the second hole of the second plate; a securing assembly for securing the channel to the first plate; and at least one fastening assembly for removably fastening the interface to the body of the watercraft.

In some implementations, the securing assembly is further configured for securing the channel to the second plate. The at least one fastening assembly is configured for removably fastening the first plate to the second plate of the interface. The at least one fastening assembly includes a first segment engaging the first plate of the interface and a second segment engaging the second plate of the interface, the first and second segments of the at least one fastening assembly collaborating to force the first and second plates of the interface toward one another to sandwich the rigid body of the watercraft therebetween.

In some aspects, a propulsion mechanism for a watercraft including a rigid body having a deck portion, a hull portion and a well extending between the deck portion and the hull portion, the propulsion mechanism includes a core support; an interface comprising a channel secured to the core support and a securing assembly for removably mounting the channel to the body of the watercraft, the channel being positionable in the well; and a propeller mounted to the core support, the propeller being configured to extend below the hull portion of the watercraft when the propulsion mechanism is mounted to the body of the watercraft.

In some implementations, the channel includes a top end and a bottom end, and wherein the interface further comprises a first plate mounted to one of the top end and the bottom end of the channel, the first plate abutting against the body when the propulsion mechanism is mounted to the body of the watercraft. The first plate of the interface is mounted to the top end the channel, the first plate abutting the deck portion of the body watercraft when the propulsion mechanism is mounted to the body of the watercraft. The first plate is mounted to the bottom end the channel, to first plate abutting the hull portion of the body watercraft when the propulsion mechanism is mounted to the body of the watercraft.

In some implementations, the propulsion mechanism further includes a set of left and right pedals operatively coupled to the propeller, the left and right pedals extending above the deck portion of the watercraft when the propulsion mechanism is mounted to the body of the watercraft. In some implementations, the propeller includes a pair of oscillating, flexible flappers. In some implementations, the set of left and right pedals the pair of is operatively coupled to the flexible flappers via one a cable transmission and a chain transmission.

In some aspects, a method for manufacturing a watercraft including a rigid body having a deck portion, a hull portion and an embedded propeller interface extending between the deck portion and the hull portion by thermoforming, the method includes providing a mold including a deck shell and a hull shell, the deck shell and hull shell being movable relative to one another between an open position and a closed position; providing a propeller interface including a deck end and a hull end, the propeller interface being made of a first plastic material; providing first and second sheets of a second, thermoformable plastic material; moving the deck shell and the hull shell in the open position; positioning the first sheet of the second, thermoformable plastic material adjacent to one of the deck portion and the hull portion; positioning the second sheet of the second thermoformable plastic material adjacent to the other of the deck portion and the hull portion; positioning the propeller interface between the first and second sheets of the second, thermoformable material; moving the deck shell and the hull shell of the mold in the closed position; simultaneously thermoforming the deck portion and the hull portion to obtain the rigid body;

moving the deck shell and the hull shell of the mold in the open position. A watercraft manufactured according to the above described method.

In some aspects, a watercraft includes a rigid body having a deck portion, a hull portion and a well extending between the deck portion and the hull portion, an interface for mounting a propulsion mechanism to the body of the watercraft, the interface including: positionable in the well, the channel being sized and shaped for receiving therein a portion of the propulsion mechanism and for mounting the propulsion mechanism to the interface; a securing assembly for securing the channel to at least one of the deck portion and the hull portion.

In some aspects, a watercraft having a rigid body that includes a deck portion, a hull portion with a keel portion, and a well extending between the deck portion and the keel portion, the watercraft includes an interface for mounting a pedal operated propulsion mechanism to the rigid body of the watercraft, the interface includes a channel portion configured to fit within the well, and configured to removably receive the pedal operated propulsion mechanism.

In some implementations, the interface further includes a top plate having a hole therein, the top plate abutting the deck portion at least partially around the well. The interface further includes a bottom plate having a hole therein, the bottom plate abutting the keel portion at least partially around the well. The watercraft further includes a fastening assembly for fastening the interface sections to the body of the watercraft. The fastening assembly includes one or more screws for fastening the top plate to the interface or the bottom plate to the interface. The pedal operated propulsion mechanism includes two pins, each extending from one side thereof, and the channel portion comprises recesses for receiving and supporting the pins and a lock that locks at least one of the pins in place. The channel portion is integrally formed with the top plate. The channel portion is integrally formed with the bottom plate. The channel portion extends only partially through the well. The channel portion extends only partially through the well at a middle portion of the well between the deck portion and the keel portion. The channel portion is force fit into the well. The channel portion is snap fit into the well. The top or bottom plate is force- or snap-fit to the hull. The hull is a thermo-molded material and the interface is an injection molded material.

In some aspects, a watercraft, includes a rigid body that includes a deck, a hull with a keel, and a well extending between the deck and the keel; an interface for mounting a pedal operated propulsion mechanism to the rigid body of the watercraft, the interface including at least two brackets configured to at least partially fit within the well, the at least two brackets configured to removably mount a pedal operated propulsion mechanism to the rigid body of the watercraft.

In some implementations, the at least two brackets comprise three brackets evenly spaced around the well. The at least two brackets comprise four brackets evenly spaced around the well. The four brackets include a forward bracket a rear bracket, and two side brackets. The forward bracket is configured to support a front of the pedal operated propulsion mechanism, the rear bracket is configured to support the rear of the pedal operated propulsion system, and the two side brackets are configured to support the sides of the pedal operated propulsion system. The pedal operated propulsion mechanism includes two pins, each extending from one side thereof, and each of the side brackets comprises a recess for receiving and supporting a respective pin of the two pins, and a lock that locks at least one of the pins in place. The brackets are affixed to the well. The brackets are affixed to a lip formed in the well.

In some implementations, the watercraft further includes a top plate with a hole therein through which at least a portion of the pedal powered propulsion system can pass, where the top plate abuts the deck. The top plate is affixed to the deck using screws, rivets, glue, or plastic-welding. The watercraft further includes a bottom plate with a hole therein through which at least a portion of the pedal powered propulsion system can pass, where the bottom plate abuts the hull at or near the keel. The bottom plate is affixed to the deck using screws, rivets, glue, or plastic-welding. The bottom plate is affixed to the deck using screws, rivets, glue, or plastic-welding. The hull is made from a thermo-molded material and the interface is made from an injection molded material.

In some aspects, a method of making a rigid watercraft, including injection molding an interface configured to removably receive and mount a pedal operated propulsion mechanism to the rigid watercraft; thermo-molding a body that includes a deck, a hull with a keel, and the well extending between the deck and the keel; affixing the interface to the body.

In some implementations, the method further includes, after the thermo-molding, and while the body is still warm, inserting the interface at least partially into the well, and allowing the body to shrink about the interface. The injection molding forms the interface including: (i) a channel configured to fit within the well formed in the hull of the watercraft, (ii) the channel and a top plate that is configured to abut the deck, (iii) the channel and a bottom plate configured to abut the keel, or (iv) the channel the top plate and the bottom plate. The injection molding integrally forms the channel with either or both of the top and bottom plates.

BRIEF DESCRIPTION OF THE DRAWINGS

Having thus generally described the nature of the invention, reference will now be made to the accompanying drawings, showing by way of illustration example embodiments thereof and in which.

DETAILED DESCRIPTION

FIGS. 1 to 7 show an example of a watercraft in accordance with an embodiment of the invention. In this embodiment, the watercraft is a fishing kayak 10 comprising a body 12 having a bow end 14 and a stern end 16 opposite the bow end 14. The body 12 extends along a longitudinal axis $L_1$-$L_1$ from the bow end 14 to the stern end 16. The kayak 10 has a length L defined by the longitudinal axis $L_1$-$L_1$, a width W transversal to the longitudinal axis $L_1$-$L_1$, and a height H transversal to the widthwise and longitudinal directions. As the kayak 10 is primarily designed for fishing, the body 12 of the kayak 10 may be made relatively wide to assist in providing increased stability to the watercraft.

Figure 5:
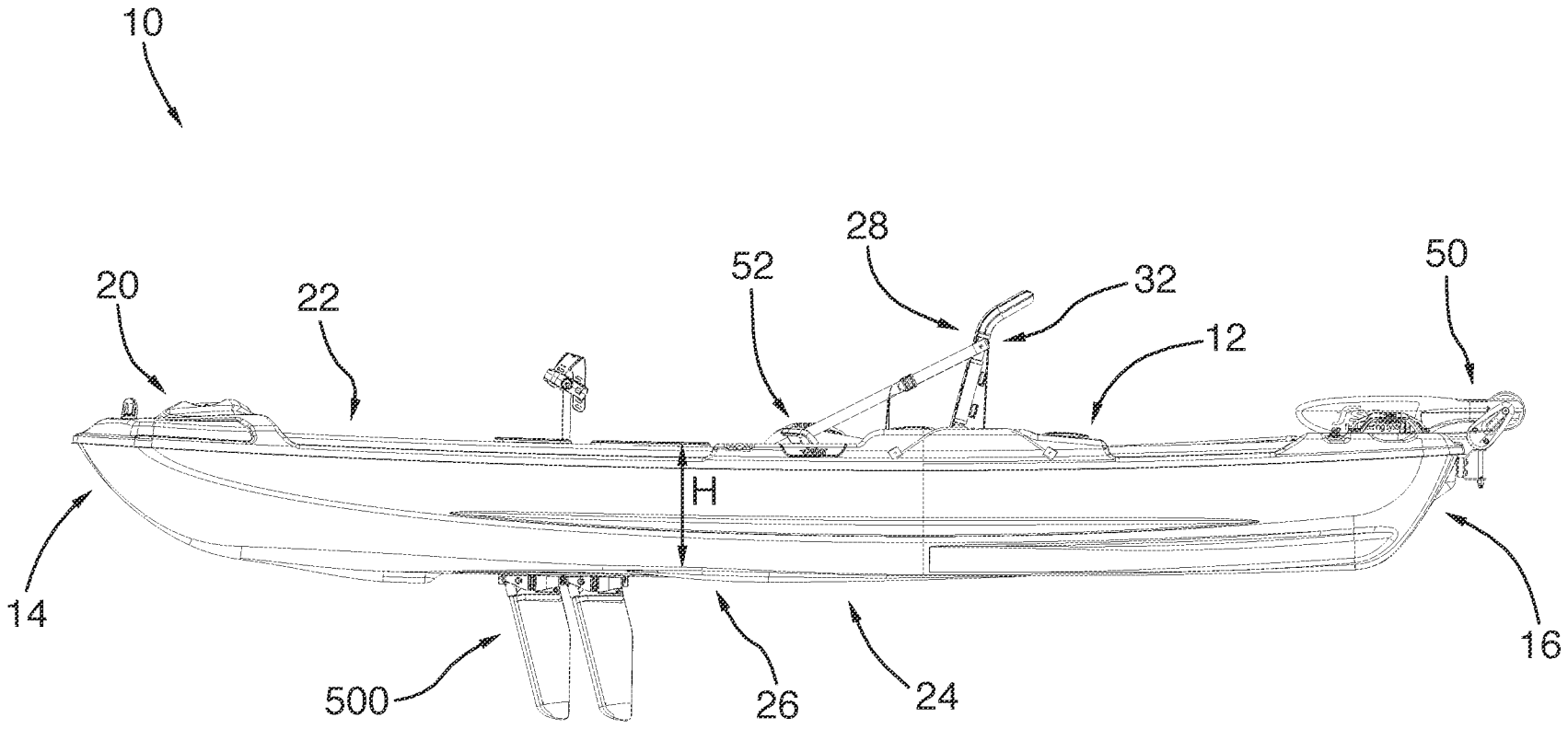
FIG. 5 is a left elevation view of the kayak shown in FIG. 1.
Figure 6:
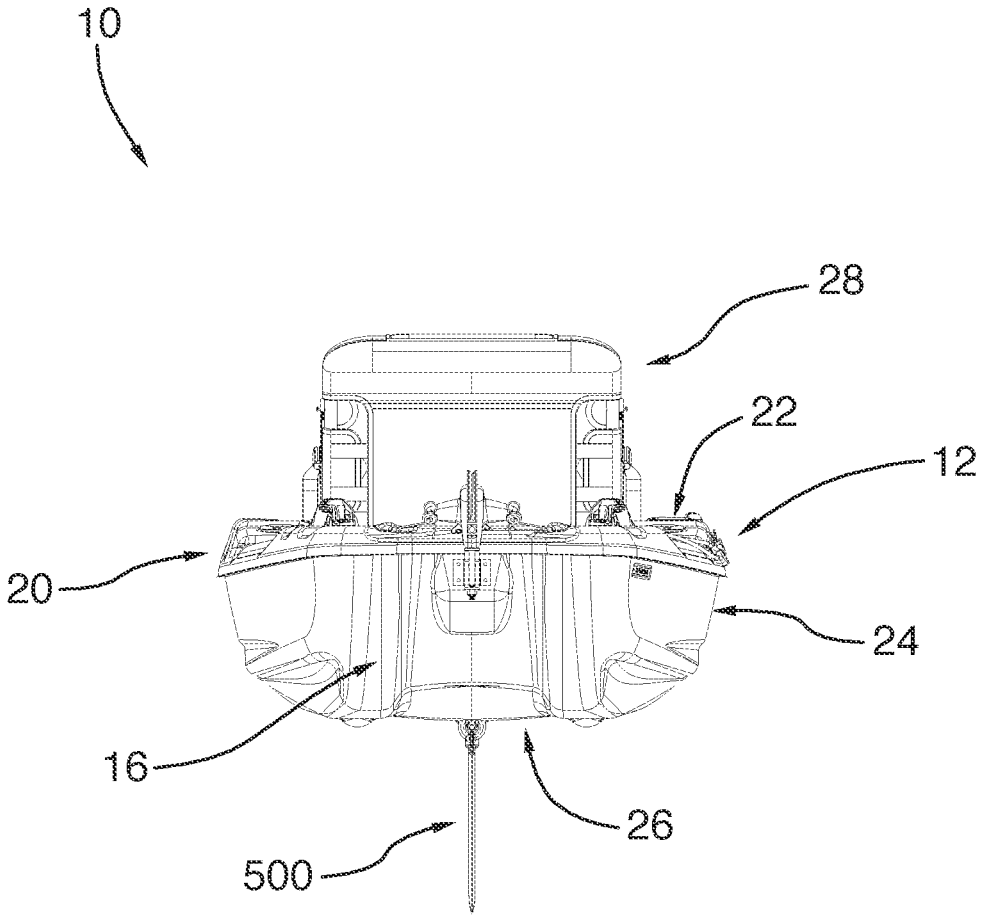
FIG. 6 is a rear elevation view of the kayak shown in FIG. 1.

The body 12 of the kayak 10 comprises a deck 20 defining a top side 22 of the body 12 and a hull 24 defining a bottom side 26 of the body 12 (best shown in FIG. 5). The deck 20 is configured for accommodating a user of the kayak 10 while the hull 24 is configured to engage water onto which the kayak 10 floats and travels.

In the illustrated embodiment, the deck 20 is provided with various features that can be useful to the user. For example, in the embodiment depicted, a seat 28 is disposed atop the deck 20 for allowing a user of the fishing kayak 10 to sit in a generally upright position. The seat 28 comprises a seat bottom 30 and a backrest 32. The deck 20 also comprises a leg area 34 located forwardly of the seat 28 for supporting the user's legs and feet. In this embodiment, the leg area 34 comprises a generally oblong well 100 (best shown in FIGS. 9 to 10) defined in the body 12, an interface 300 mounted in the well 100 and a foot propulsion mechanism 500 mounted to the interface 300, for allowing a user seating on the seat 28 to propel the kayak 10, as it will be described in greater details below. The leg area 34 may also be used for the user to stand while fishing. It will be understood that such features may not necessarily be found in conventional (i.e., recreational/non-fishing) kayaks, or that such features may be configured differently without departing from the scope of this embodiment.

In this embodiment, the deck 20 also comprises a covered storage compartment 36 adjacent the bow end 14 of the body 12 and an open storage compartment 38 located between the covered storage compartment 36 and the leg area 34.

The deck 20 also comprises covered storage compartment 40 adjacent the stern end 16 of the body 12, as well as an open storage compartment 42 located between the covered storage compartment 40 and the seat 28. As it will be appreciated, open storage compartments 36, 38, 40 and 42 may be useful to store equipment and, in the case of the covered storage compartments 36 and 40, to protect such equipment from exposure to water. The open storage compartments 38, 42 may comprise securing cords 44, 46 (such as for example bungee cords) to secure equipment in the open storage compartments 38, 42. As an example, a cooler or other equipment and/or provisions useful for fishing may be secured in the open storage compartments 38, 42.

At the stern end 16 of the deck 20, the kayak 10 is provided with a rudder assembly 50. The rudder assembly 50 is operatively coupled to a steering mechanism 52 located beside the seat 28 (in the illustrated embodiment, on the left side of the seat 28) via a cable transmission (not shown), for steering the kayak 10. Furthermore, in the embodiment depicted, the deck 20 comprises three pole holders 56, 58 and 60 for holding fishing poles (not shown). The deck 20 also comprises a pair of paddle parks 62, 64 on each side of the seat 28 to securely hold paddles (not shown) generally parallel to the longitudinal axis $L_1$-$L_1$ of the kayak 10.

Figure 1:
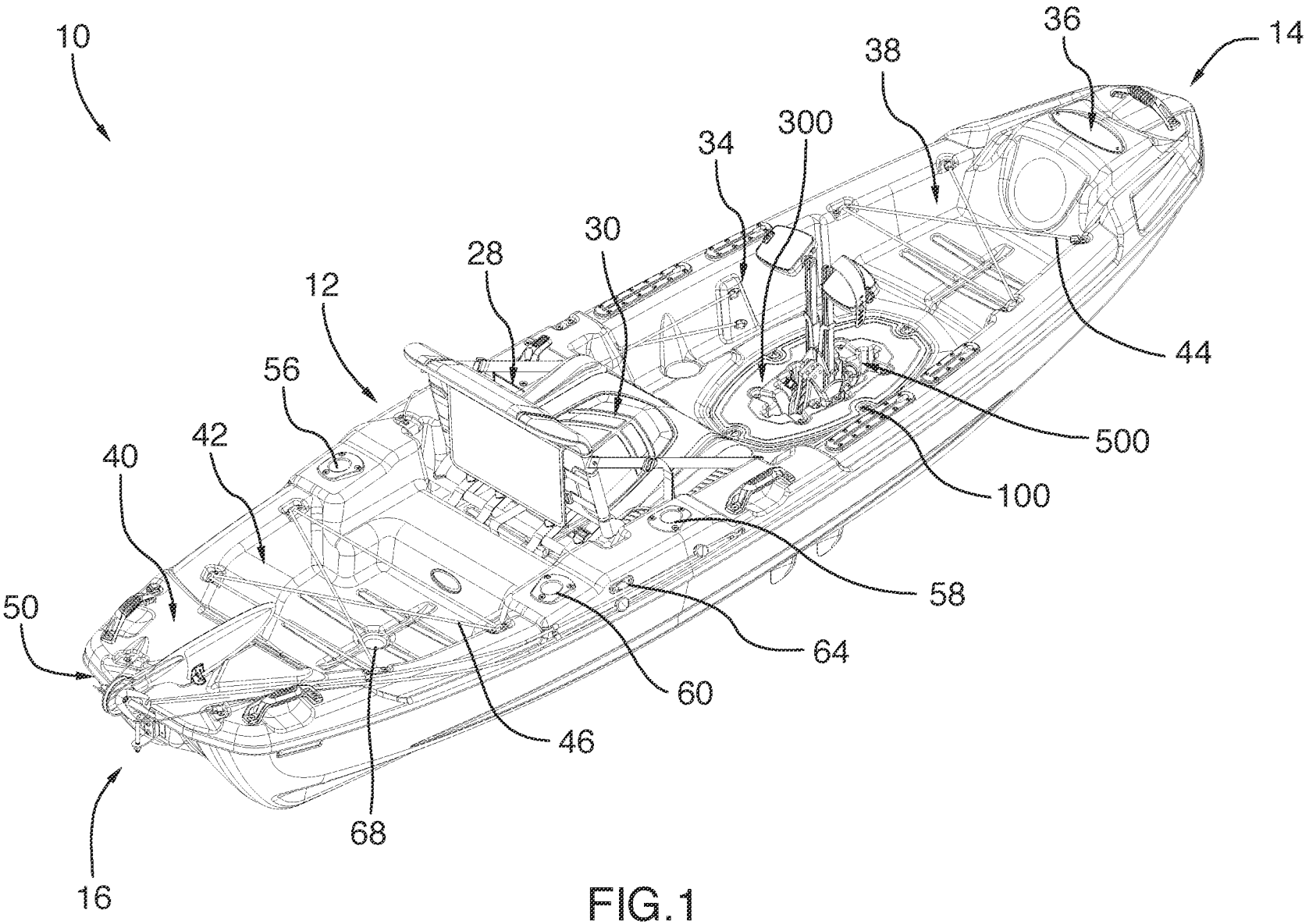
FIG. 1 is a top, rear right perspective view of a kayak in accordance with some embodiments.
Figure 2:
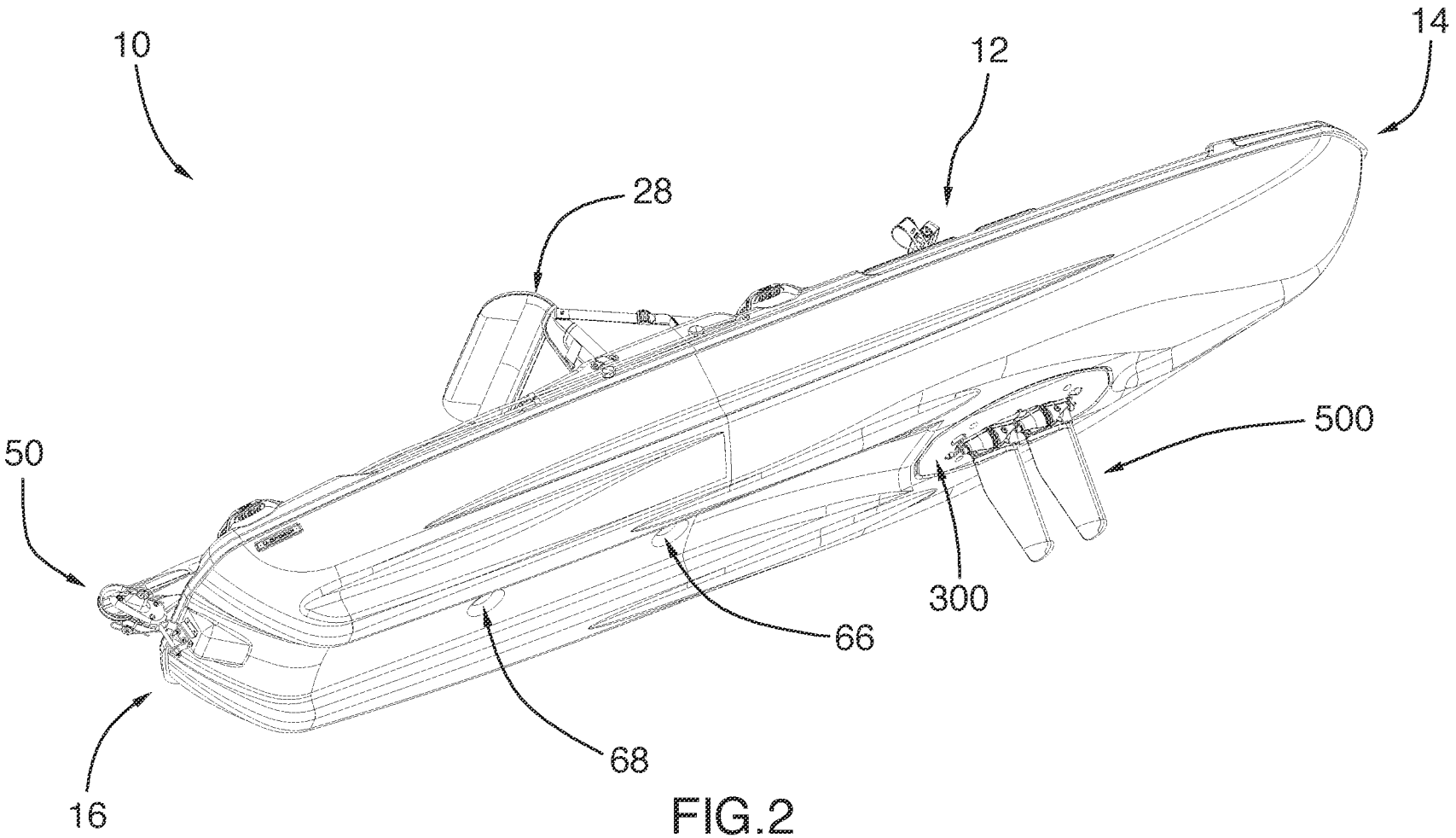
FIG. 2 is a bottom, rear right perspective view of the kayak shown in FIG. 1.
Figure 3:
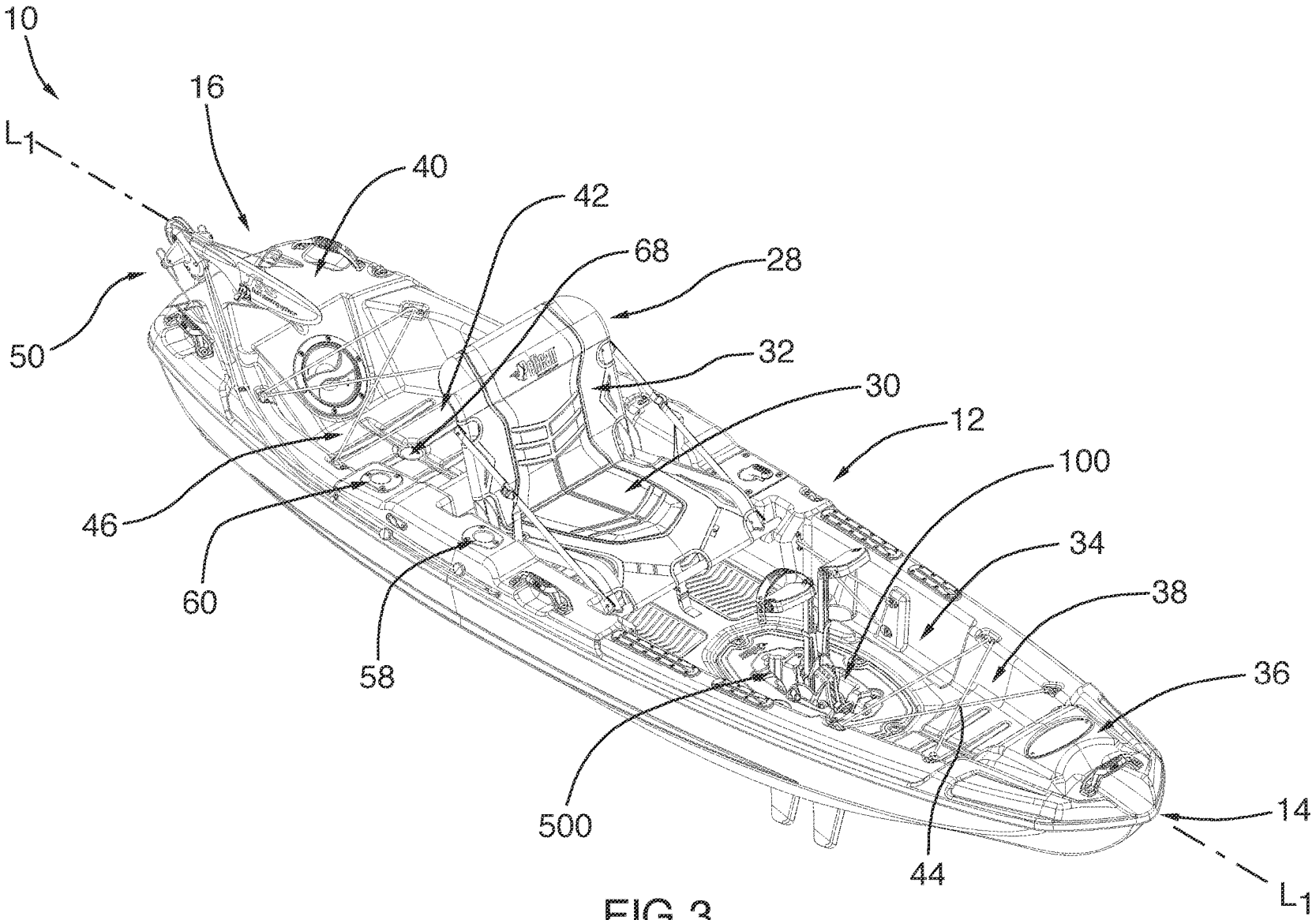
FIG. 3 is a top, front right perspective view of the kayak shown in FIG. 1.
Figure 4:
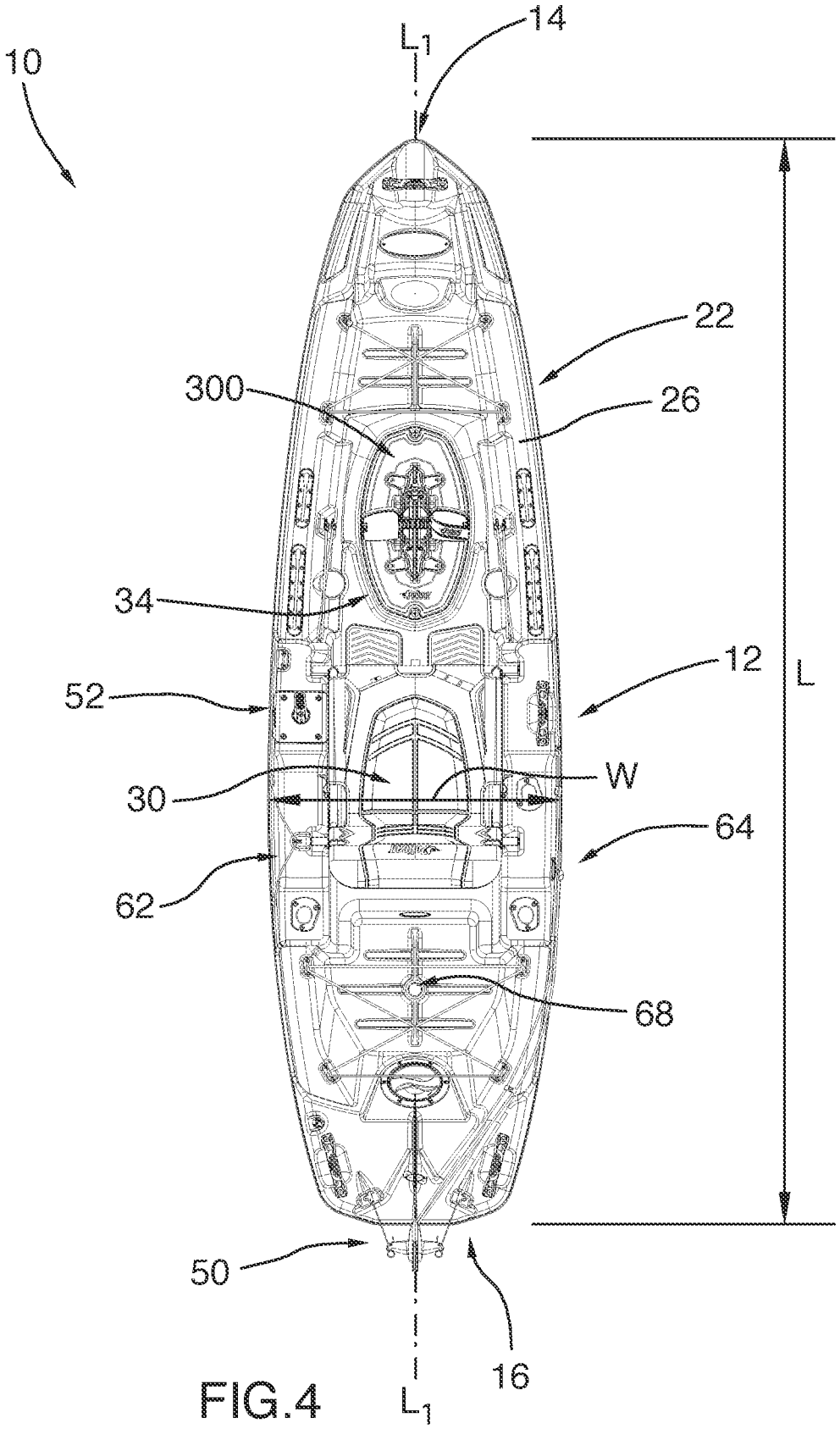
FIG. 4 is a top plan view of the kayak shown in FIG. 1.
Figure 7:
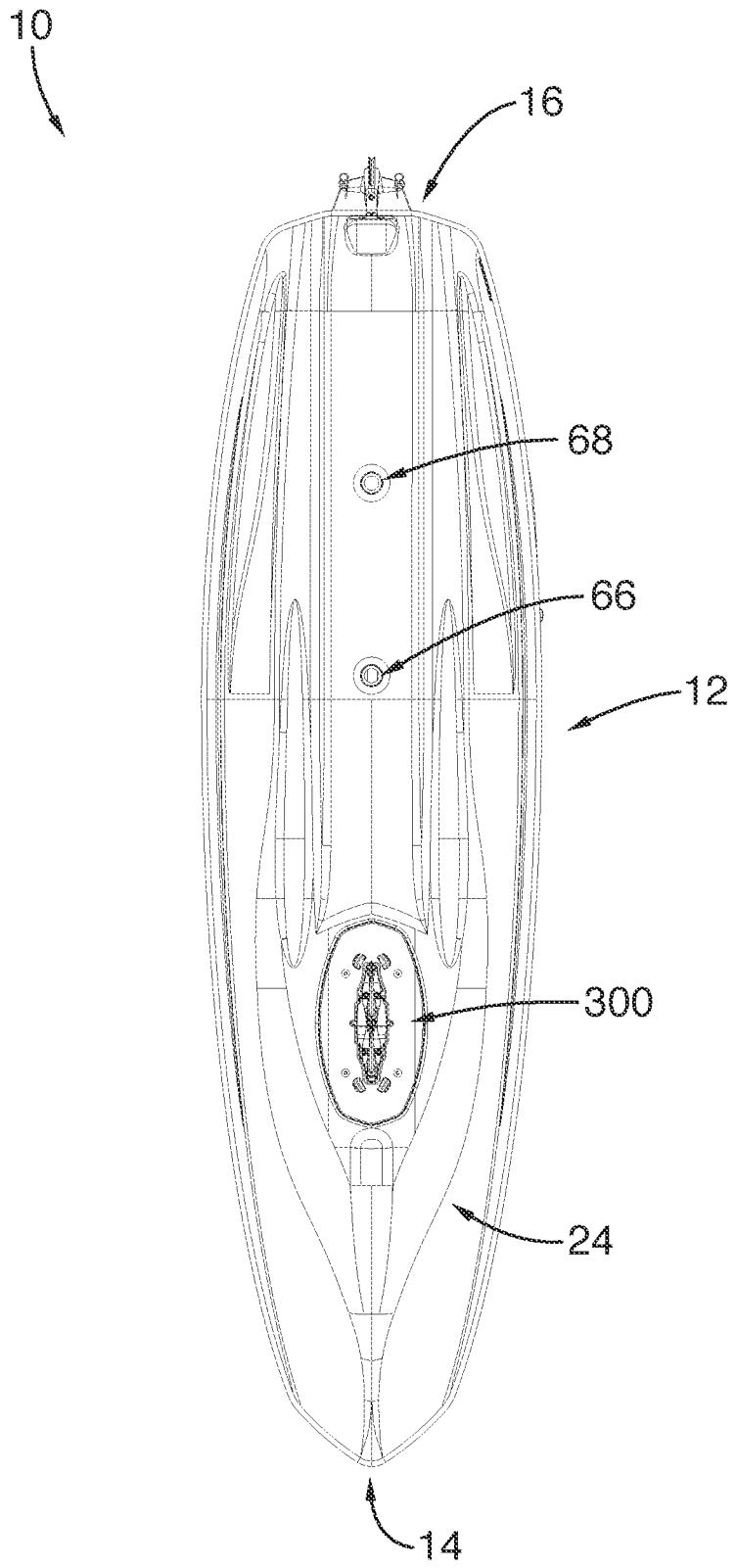
FIG. 7 is a bottom plan view of the kayak shown in FIG. 1.

With reference to FIGS. 1, 2 and 7, the body 12 of the kayak 10 is also shown as comprising a pair of drainage holes 66, 68 through which water from the deck 20 may travel to the bottom side 26 of the body 12 and into a body of water on which the kayak 10 travels.

Defined in the leg area 34 of the body 12 and extending between the deck 20 and the hull 24, is the generally oblong well configured for receiving therein the interface 300 for mounting a foot operated propulsion mechanism 500.

Figure 8:
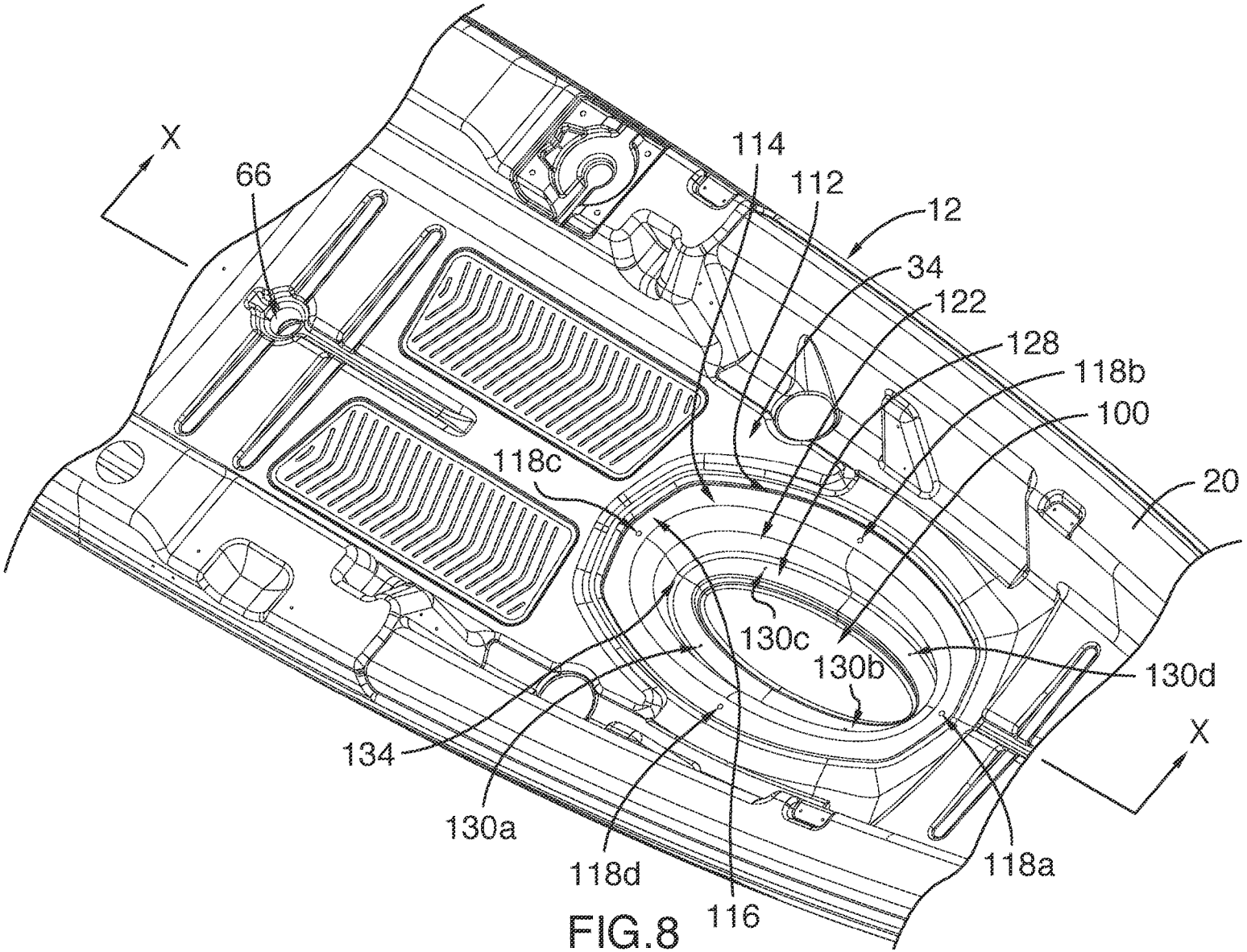
FIG. 8 is an enlarged, top front right perspective view of a body of the kayak shown in FIG. 1, in accordance with some embodiments.
Figure 9:
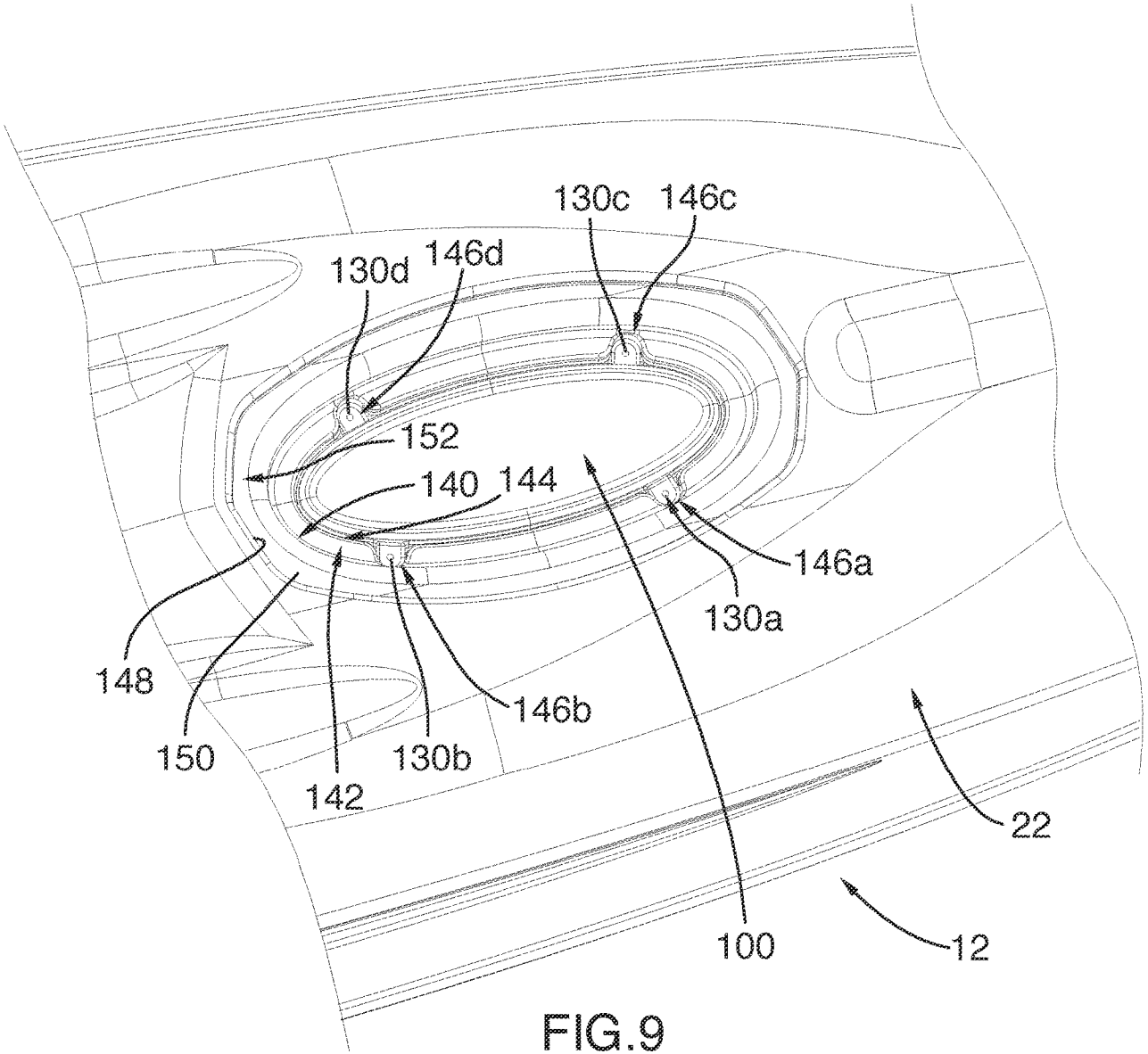
FIG. 9 is an enlarged, bottom front right perspective view of the body shown in FIG. 8.
Figure 10:
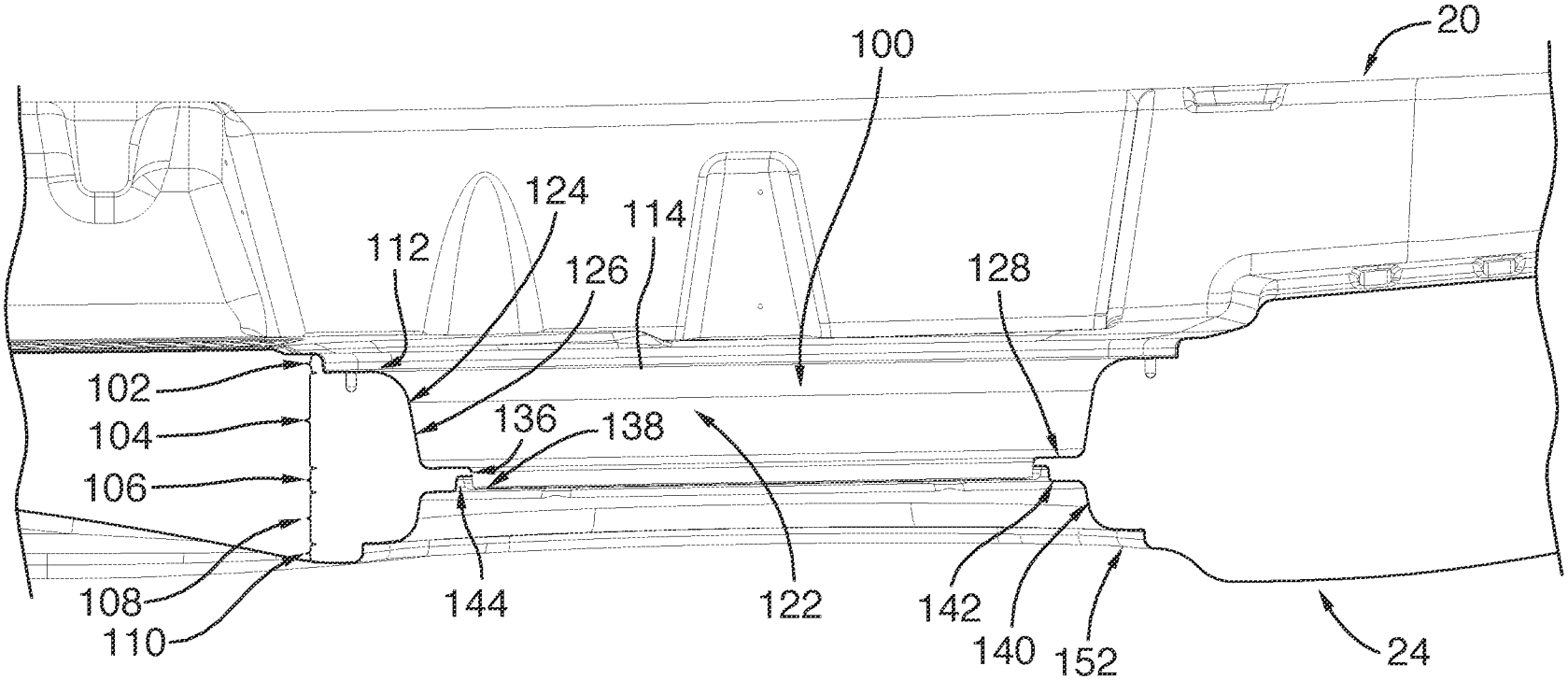
FIG. 10 is a cross-section view of the body shown in FIG. 8, taken along line X-X.
Figure 11:
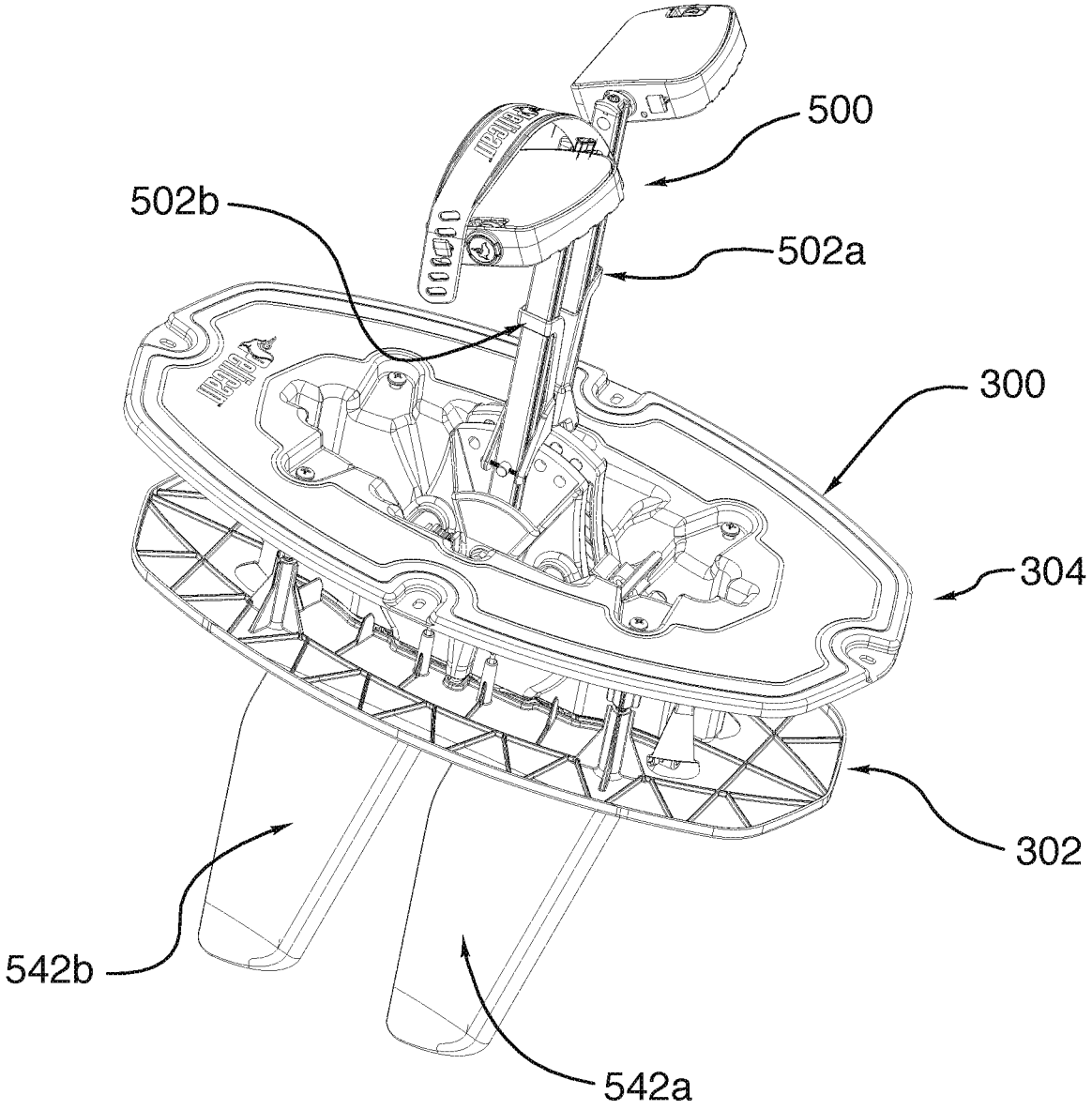
FIG. 11 is a top, front right perspective view of an interface and a propulsion mechanism mounted thereto of the kayak shown in FIG. 1, in accordance with one embodiment.
Figure 12:
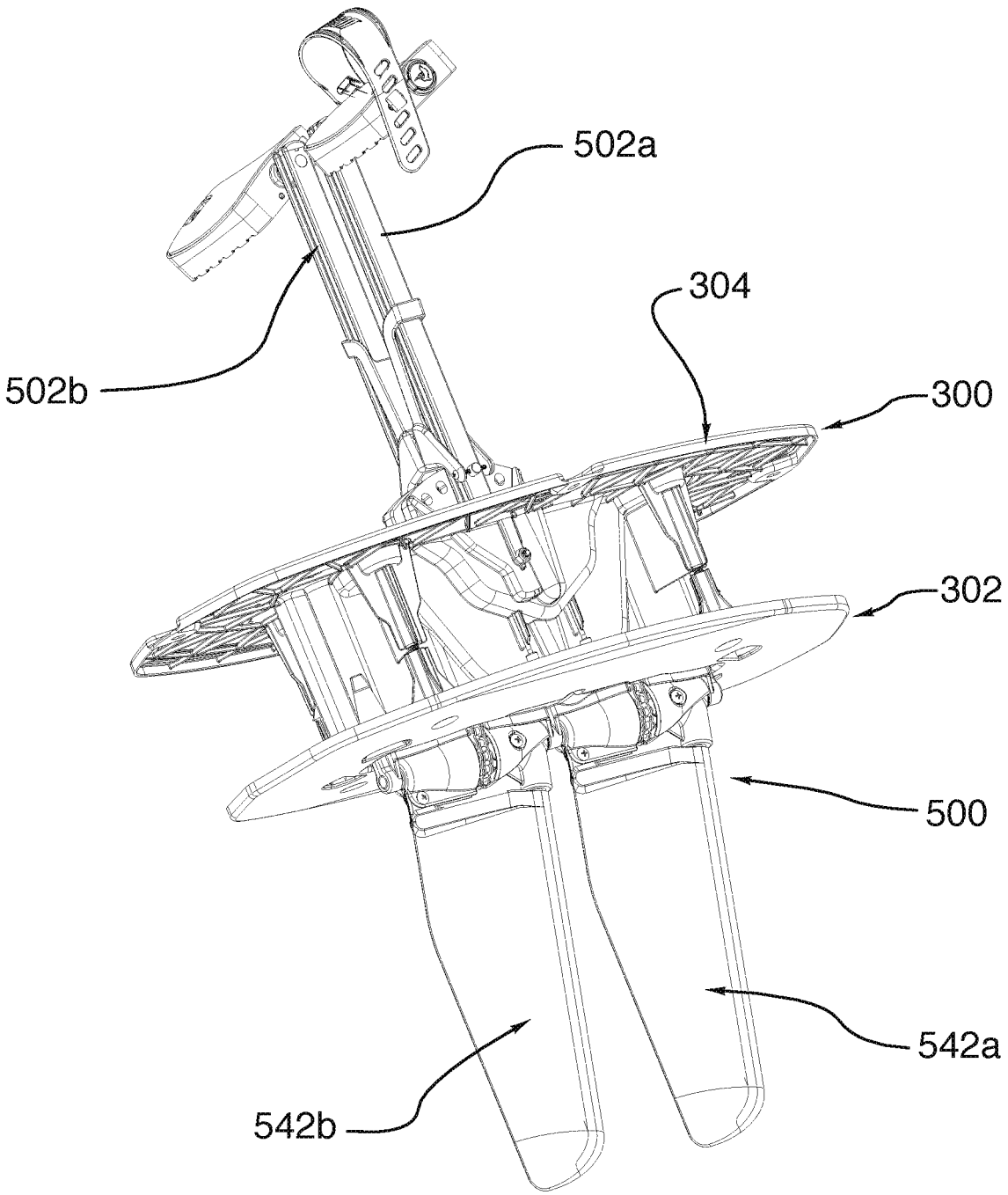
FIG. 12 a bottom, rear right perspective view of the interface and propulsion mechanism shown in FIG. 11.
Figure 13:
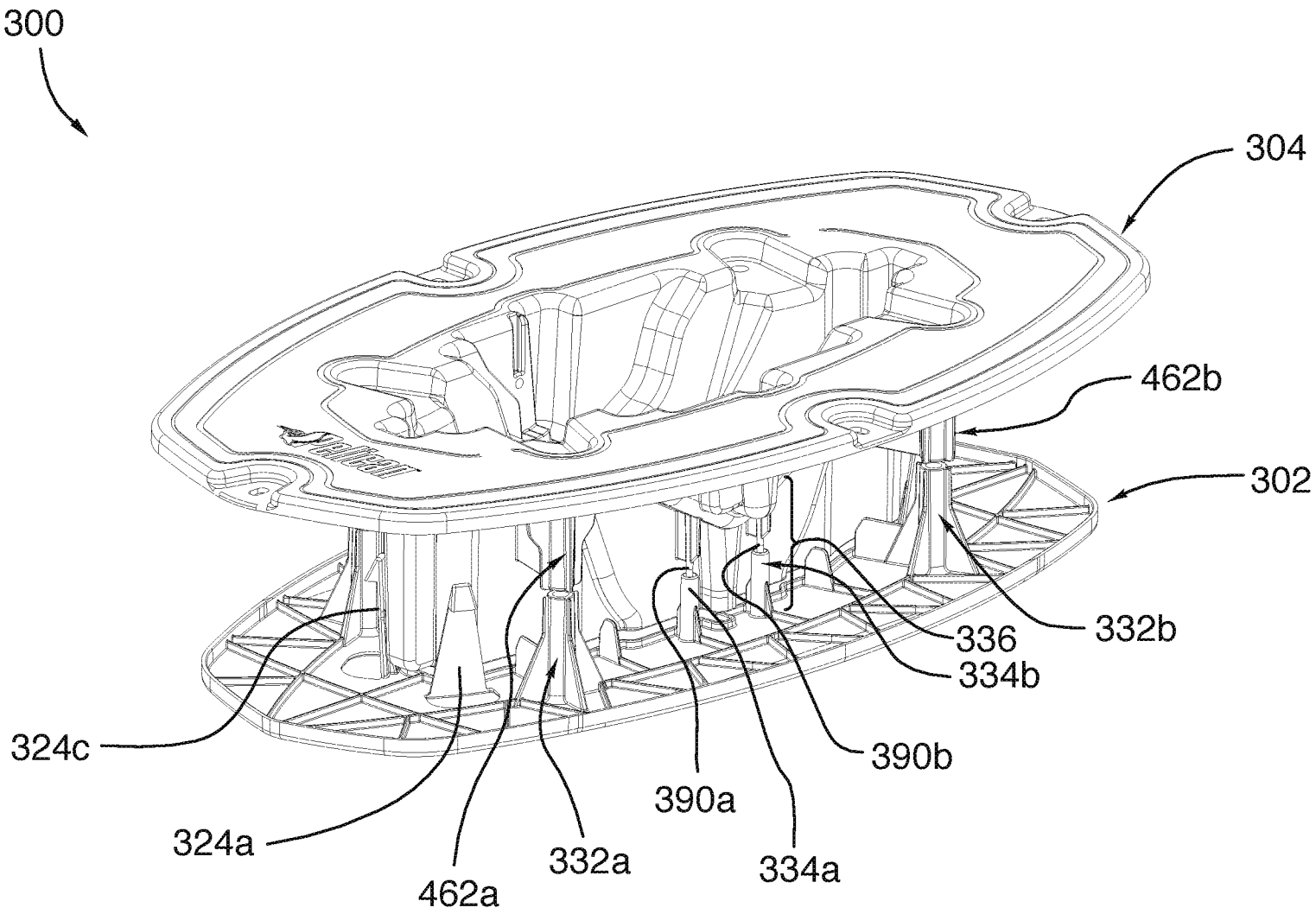
FIG. 13 is a top, rear right perspective view of the interface shown in FIG. 11.

With reference to FIGS. 8 to 10, the well 100 comprises first, second, third, fourth and fifth portions 102, 104, 106, 108 and 110, respectively which sequentially extend from the deck 20 to the hull 24. The first portion 102 comprises a peripheral wall 112 and a first abutment wall 114 extending perpendicular thereto. Together, the peripheral wall 112 and the first abutment wall 114 define a recess 116 sized and shaped for receiving therein a portion of the interface 300, as it will become apparent below. Defined in the first abutment wall 114 are four holes 118*a*-118*d* for receiving therein threaded fasteners 120*a*-120*d* (shown in FIG. 31), for securing a portion of the interface 300 to the body 12 of the kayak 10, as it will become apparent below. The second portion 104 of the well 100 is located below the first portion 102. The second portion 104 comprises a peripheral wall 122 having a top end 124 connected to the first abutment wall 114 of the first portion 102, the top end 124 being curved to transition toward a lower end 126 which, extends at an angle of approximately 80 degrees relative to the horizontal. The lower end 126 of the peripheral wall 122 is connected to a second abutment wall 128. The second abutment wall 128 extends generally horizontal, and comprises a plurality of holes 130*a*-130*d* for receiving therethrough a corresponding plurality of threaded fasteners 132*a*-132*d* (shown in FIG. 31) for securing portion of the interface 300 to the body 12 of the kayak 10, as it will become apparent below. Together, the peripheral wall 122 and the second abutment wall 128 define a second recess 134 for receiving a portion of the interface 300, as it will become apparent below.

The third portion 106 of the well 100 also includes a peripheral wall 136 extending downwardly, as well as a lip 138 extending generally transverse to the peripheral wall 136. The peripheral wall 136 and the lip 138 correspond to the junction between the deck portion 44 of the body 12 and the hull 24, where they are welded of fused together during the manufacturing process.

Likewise, and referring to FIGS. 9 and 10, the fourth portion 108 of the well 100 includes a peripheral wall 140, as well as an abutment wall 142 extending generally horizontal. Defined on the abutment wall 142 is an oblong channel 144 adjacent to the lip 138, and four recesses 146*a*-146*b* for receiving therein portion of the interface 300, as it will become apparent below.

Lastly, and referring to FIG. 9, the fifth portion 110 comprises a peripheral wall 148 and an abutment wall 150. Together, the peripheral wall 148 and the abutment wall 150 define a recess 152 for receiving therein a portion of the interface 300, as it will become apparent below.

Tuning now to FIGS. 11 to 26, the interface 300 will now be described. The interface 300 comprises a bottom portion 302 and a top portion 304 configured to collaborate with the bottom section 302 to conceal the well 100 of the body 12 regardless of any manufacturing variations which may affect the thickness of the body 12 in this location, and to operatively accommodate the foot propulsion mechanism 500.

With reference to FIGS. 16A to 20, the bottom portion 302 comprises a plate 306 having a top face 308 and a bottom face 310, the bottom plate 302 being sized and shape to fit in the recess 152 defined by the fifth portion 110 of well 100 defined in the body 12 of the kayak 10. Defined at the center of the bottom plate 306 is an elongated hole 312 sized and shaped for allowing the passage of a portion of the propulsion mechanism 500, the elongated hole 312 being surrounded by an inner peripheral wall 314 extending upwardly from the top face 308. Also extending upwardly from the top face 308 of the plate 306 is a generally vertical outer peripheral wall 316, located on the periphery of the plate 306, as well as a plurality of reinforcement ridges 318, 320, 322 connecting the inner and outer peripheral walls 314, 316 (only some of the reinforcement ridges being identified with reference numerals 318, 320 and 322) Together with the inner and outer peripheral walls 314, 316, the reinforcement ridges 318, 320, 322 contribute to provide the plate 306 with additional rigidity to torsion and/or bending.

Four snap hooks or snapfits 324*a*-324*d* also extend vertically from the top face 308 of the plate 306. The snapfits 324*a*-324*d* are located proximal to the inner peripheral wall 314 and the elongated hole 312, and each comprises a vertical base 326*a*-326*d* and a hook portion 328*a*-328*d*. When the bottom portion 302 of the interface 300 is properly positioned in the oblong well 100 of the body 12, the plate 306 is received in the recess 152 defined by the peripheral and abutment walls 148, 150 of the fifth portion 110, and the snapfits 324*a*-324*d* extend to engage the lip 138 of the third portion 106. As such, the snapfits 324*a*-324*d* contribute to maintain the position of the bottom portion 302 of the interface 300 in position relative to the body 12 of the kayak 10. As it will be appreciated, the base and the hook portions 326*a*-326*d*, 328*a*-328*d* of the snapfits 324*a*-324*d* are sized to correspond to the distance between the abutment wall 150 of the fifth portion 110 and the top face of the lip 138. Provided at the base of each snapfit 324*a*-324*d* is a draining hole 330*a*-330*d* for allowing water to evacuate the interface 300 (best shown in FIG. 16A).

Figure 16A:
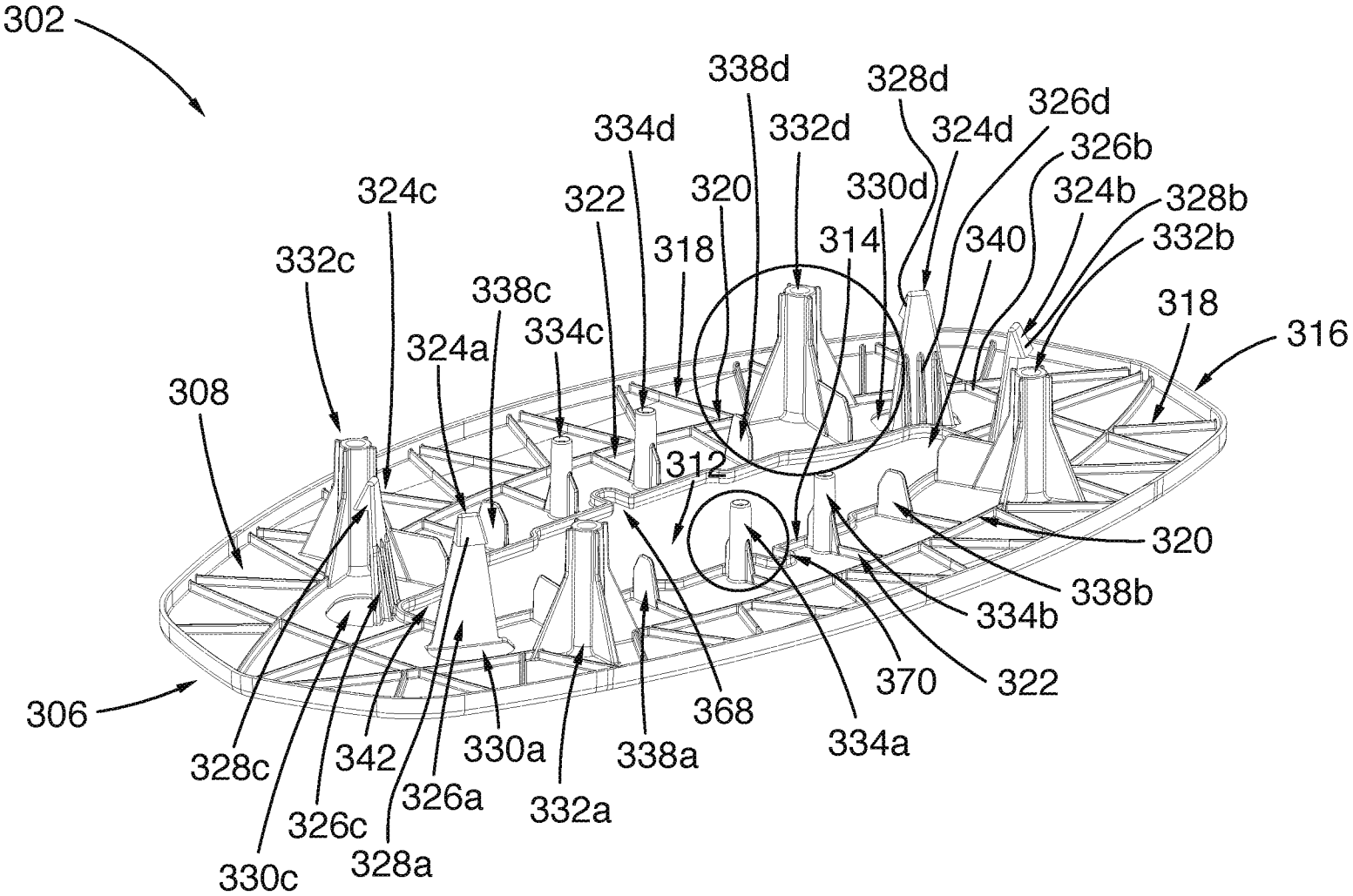
FIG. 16A is a bottom, rear right perspective view of a bottom portion of the interface shown in FIG. 13, in accordance with one embodiment.
Figure 16B:
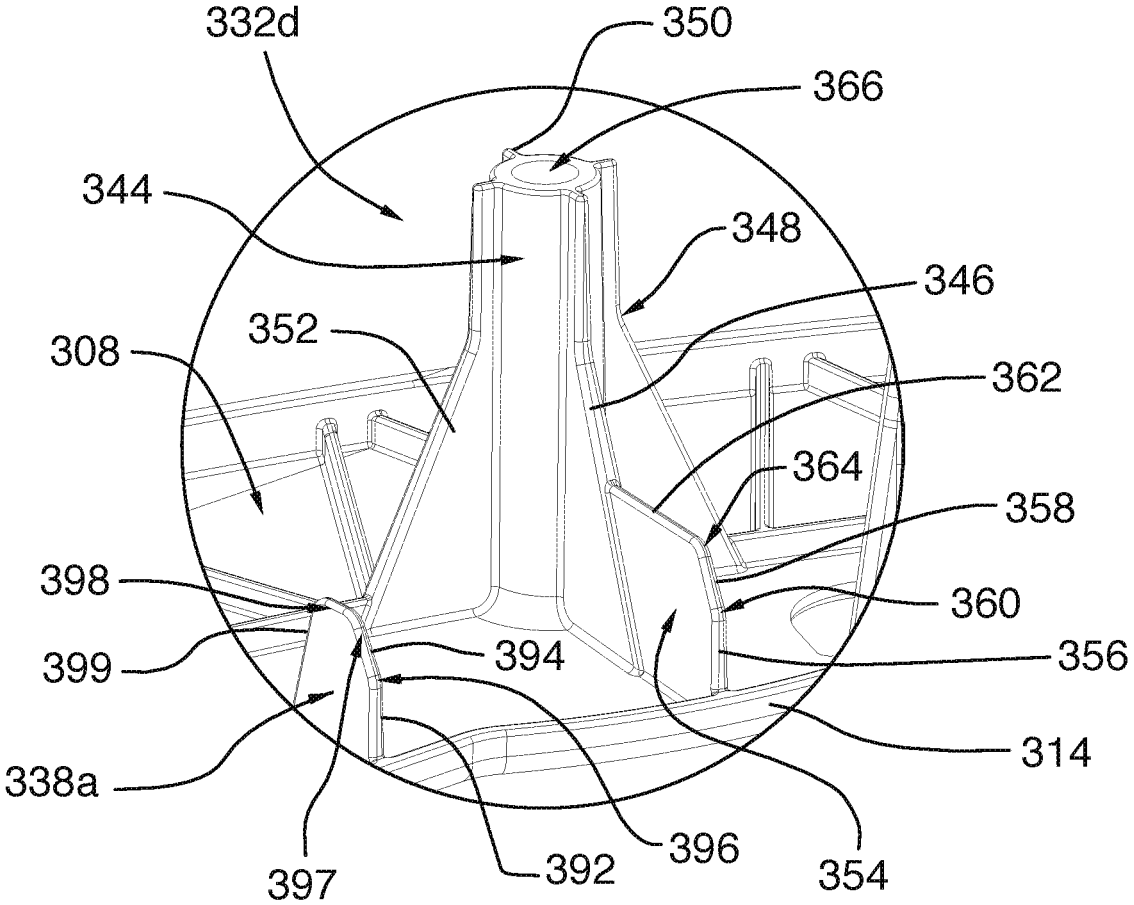
FIG. 16B is a partial, enlarged view of the bottom portion of the interface shown in FIG. 16A, for better showing a fastening projection.

Also extending upwardly from the top face 308 of the bottom plate 306 are a plurality of fastening projections 332*a*-332*d*, a plurality of female portions 334*a*-334*d* of a guide assembly 336, as well as a plurality of guiding fins 338*a*-338*d*. The fastening projections 332*a*-332*d* are located proximal to front and rear ends 340, 342 of the hole 312, generally halfway between the inner and outer peripheral wall 314, 316. With reference to FIG. 16B, each fastening projection 332*a*-332*d* comprises a cylindrical body 344 extending vertically, and a plurality of generally triangular reinforcement members 346, 348, 350 and 352 extending radially from the cylindrical body 344 (only fastening projection 332*d* being illustrated in FIG. 16B). Each fastening projection 332*a*-332*d* also includes a fin 354 extending from one of the triangular reinforcement member 346 toward the inner peripheral wall 314. Each fin 354 comprises a vertical edge 356, extending generally vertical in a location slightly remote from the inner peripheral wall 314 of the bottom plate 306, an inclined edge 358, extending from a top end 360 of the vertical edge 356, and a top edge 362 extending from a top end 364 of the inclined edge 358 toward the cylindrical body 344. Defined in the cylindrical body 344 is a threaded bore 366, for receiving therein a corresponding threaded fastener 132*a* to secure the bottom and top portions 302, 304 of the interface 300 with the body 12 of the kayak 10, as it will become apparent below.

Figure 16C:
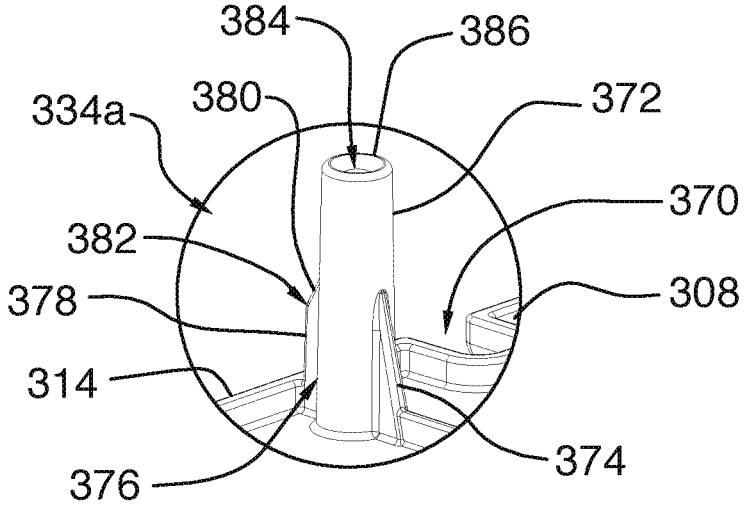
FIG. 16C is another partial, enlarged view of the bottom portion of the interface shown in FIG. 16A, for better showing a female portion of a directing assembly.
Figure 17:
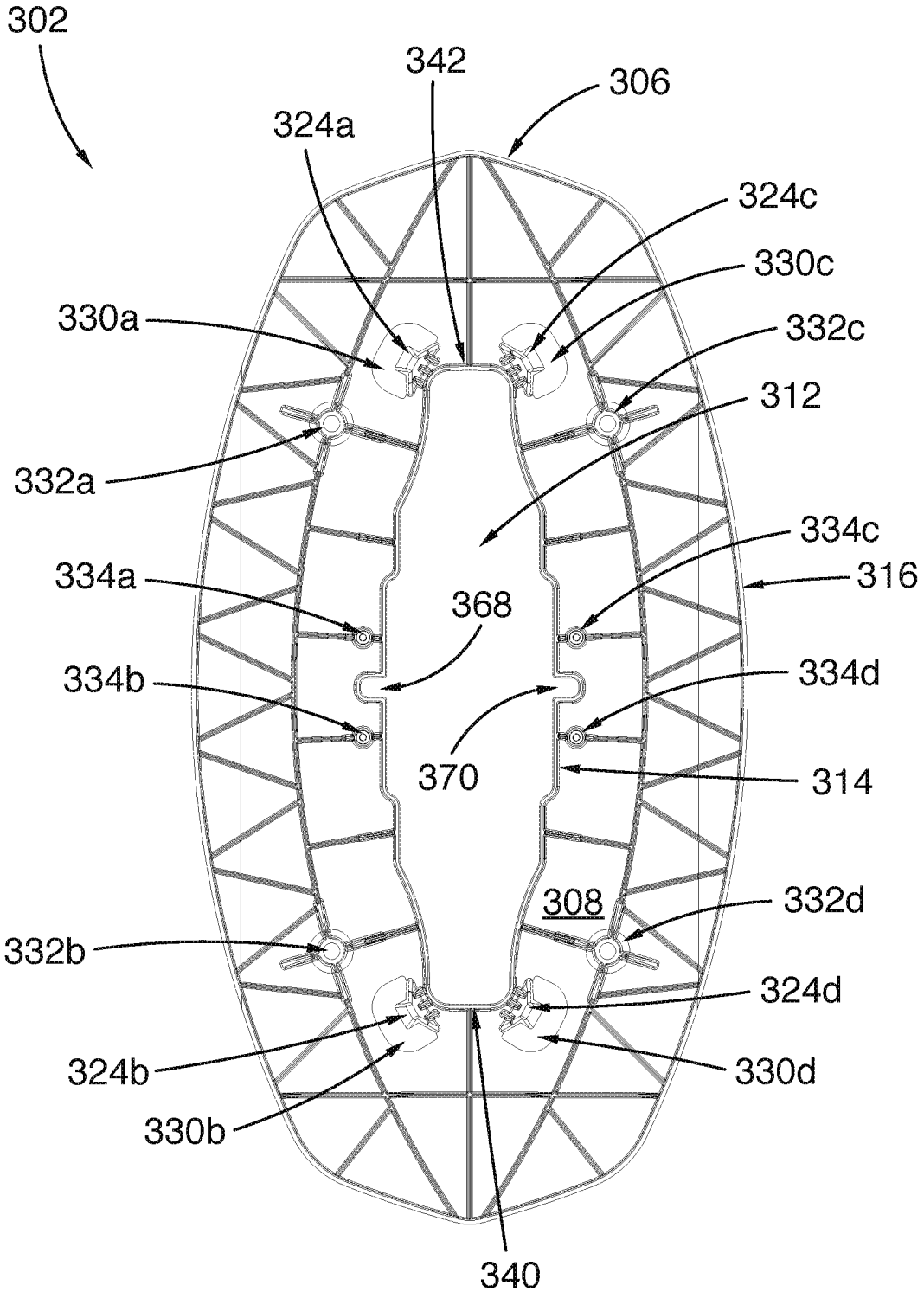
FIG. 17 is a top plan view of the bottom portion shown in FIG. 16A.
Figure 18:
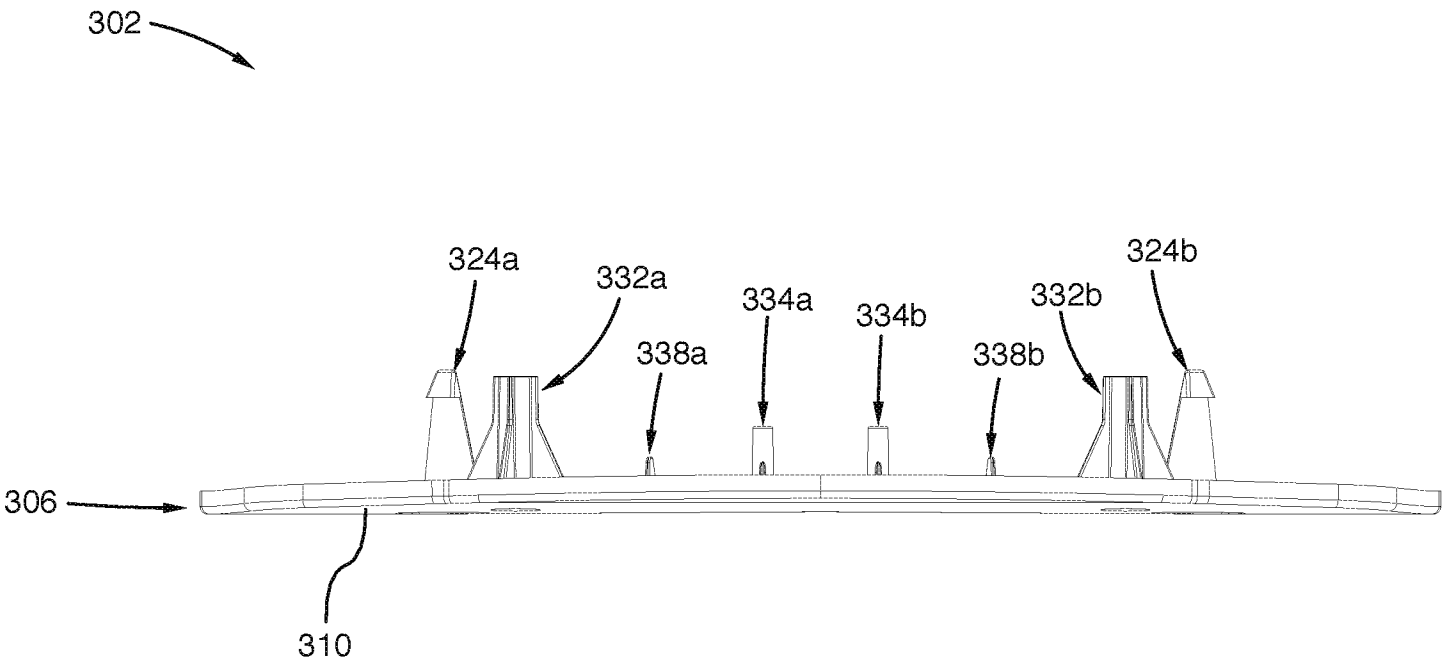
FIG. 18 is a right elevation view of the bottom portion shown in FIG. 16A.
Figure 19:
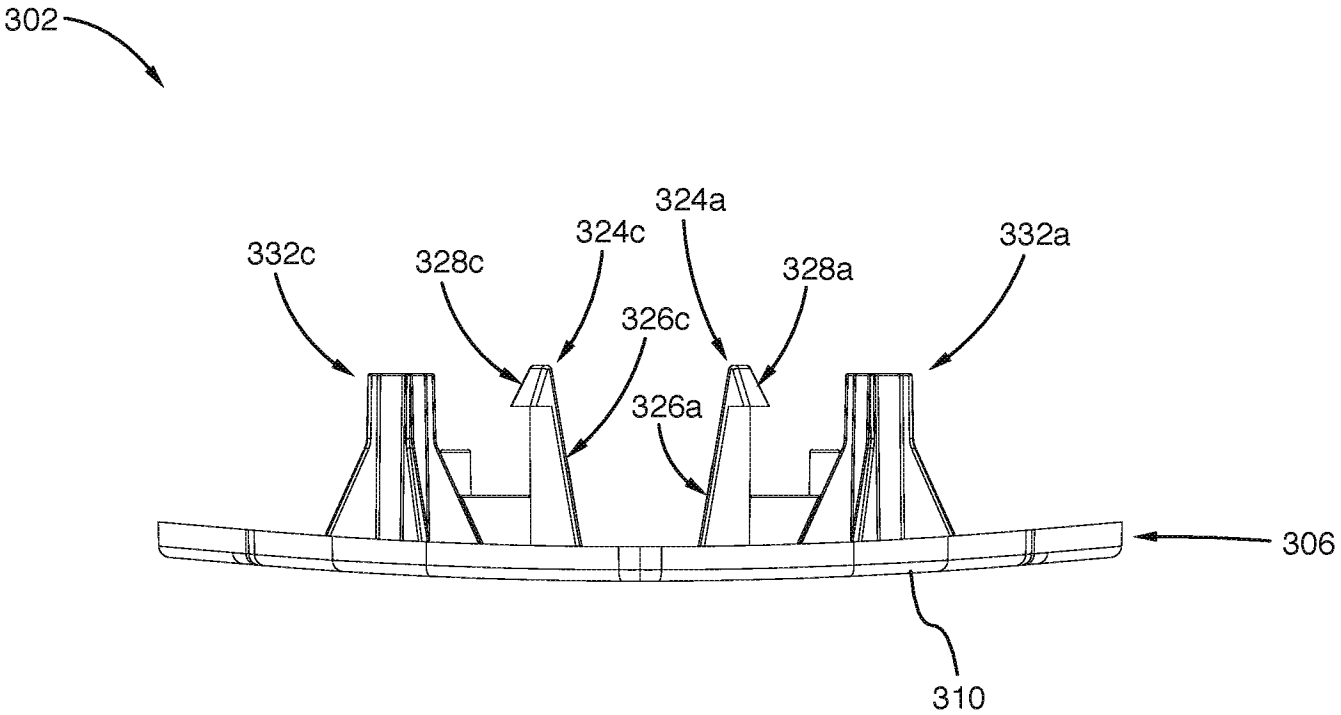
FIG. 19 is a rear elevation view of the bottom portion shown in FIG. 16A.
Figure 20:
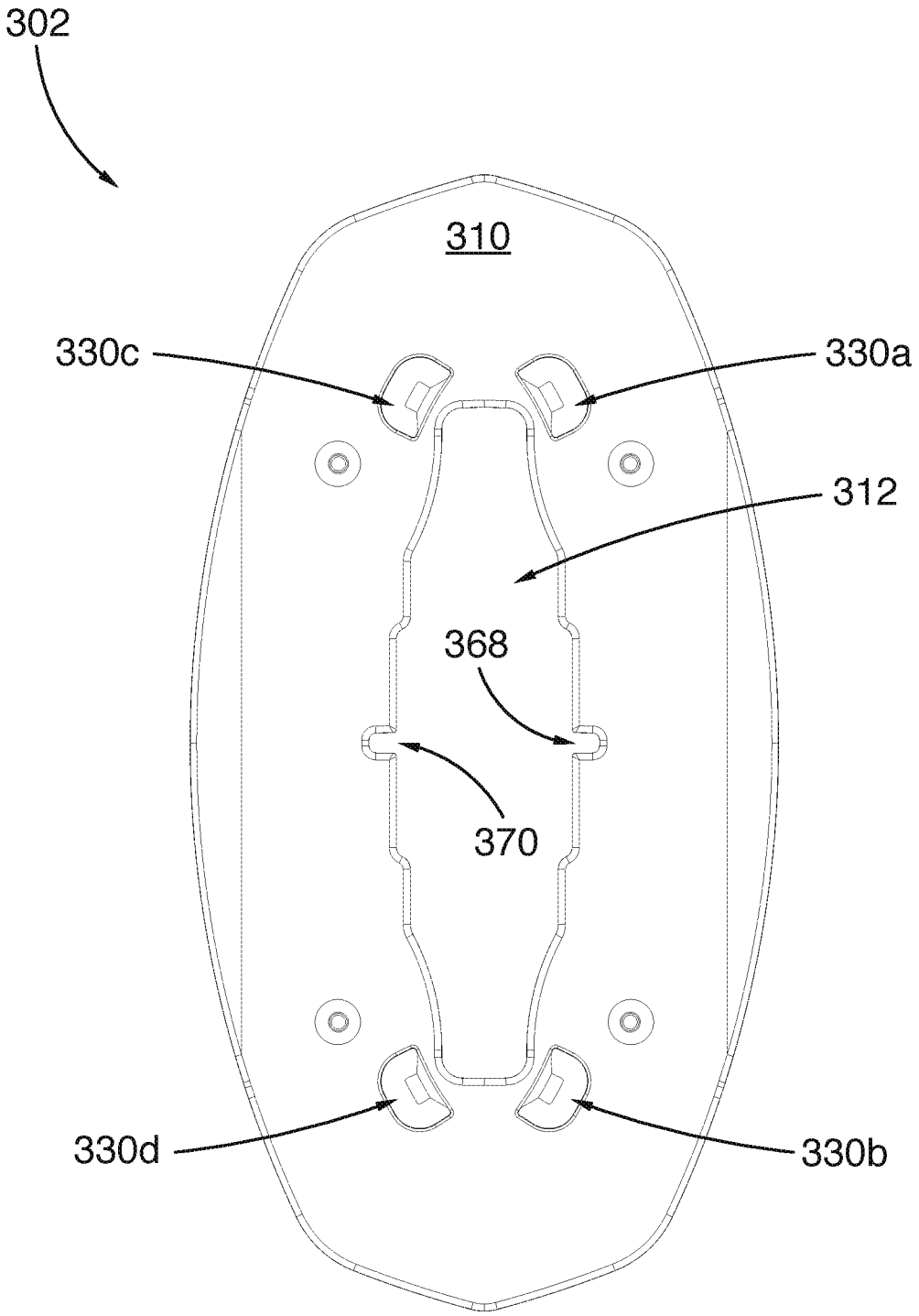
FIG. 20 is a bottom plan view of the bottom portion shown in FIG. 16A.
Figure 21:
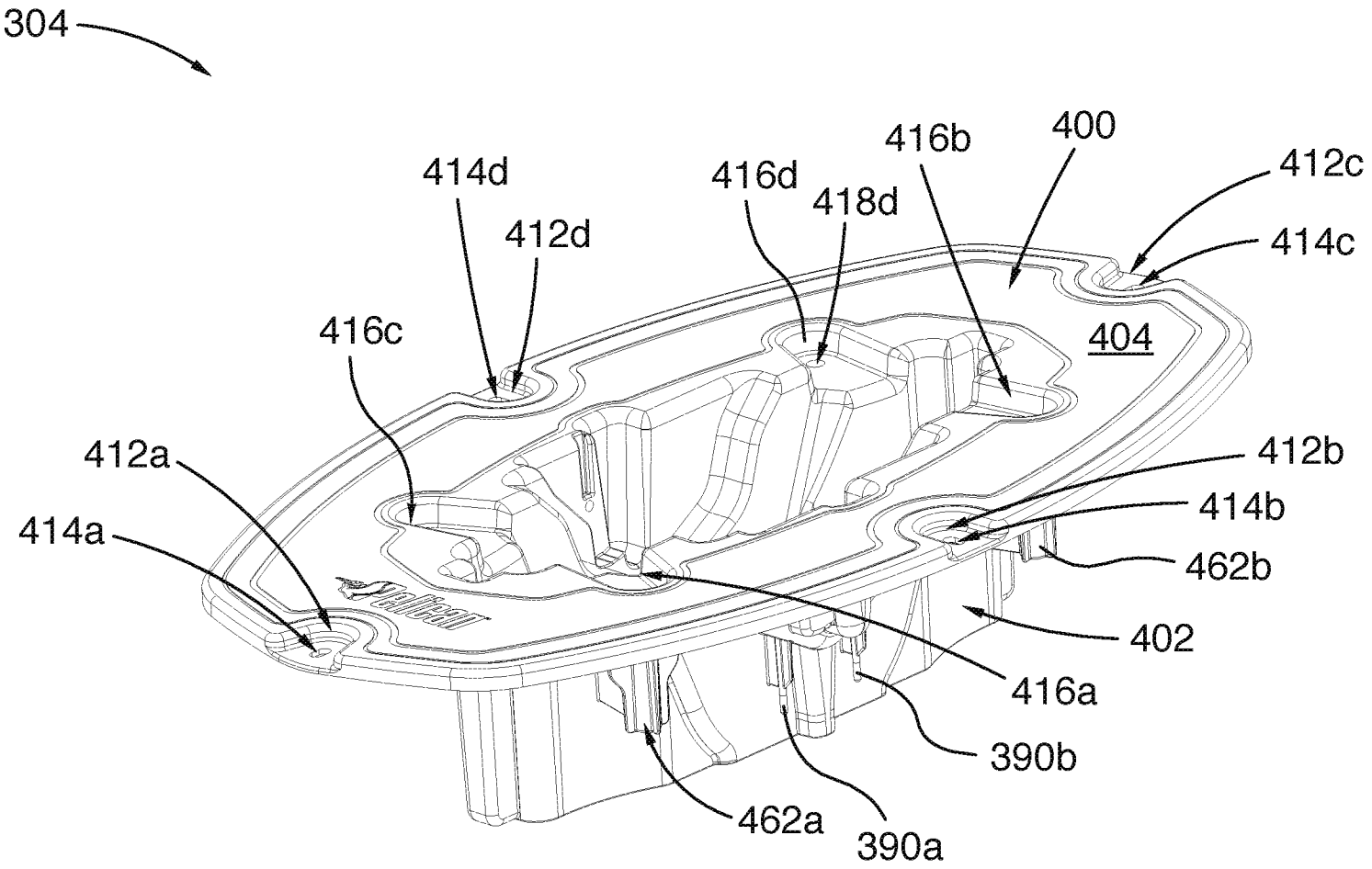
FIG. 21 is a rear, top right perspective view of a top portion of the interface shown in FIG. 13, in accordance with one embodiment.
Figure 22:
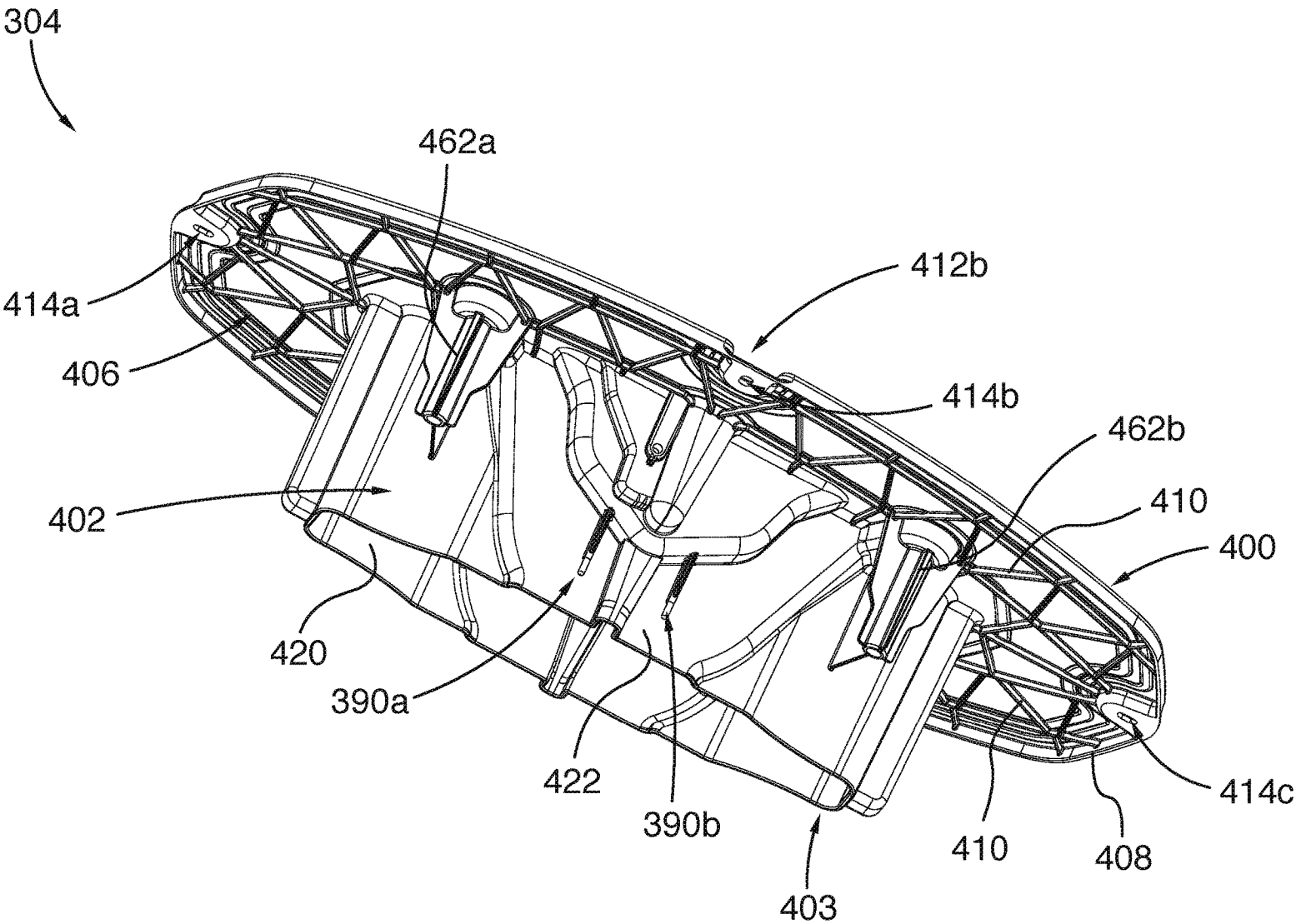
FIG. 22 is a rear, bottom right perspective view of the top portion shown in FIG. 21.
Figure 23:
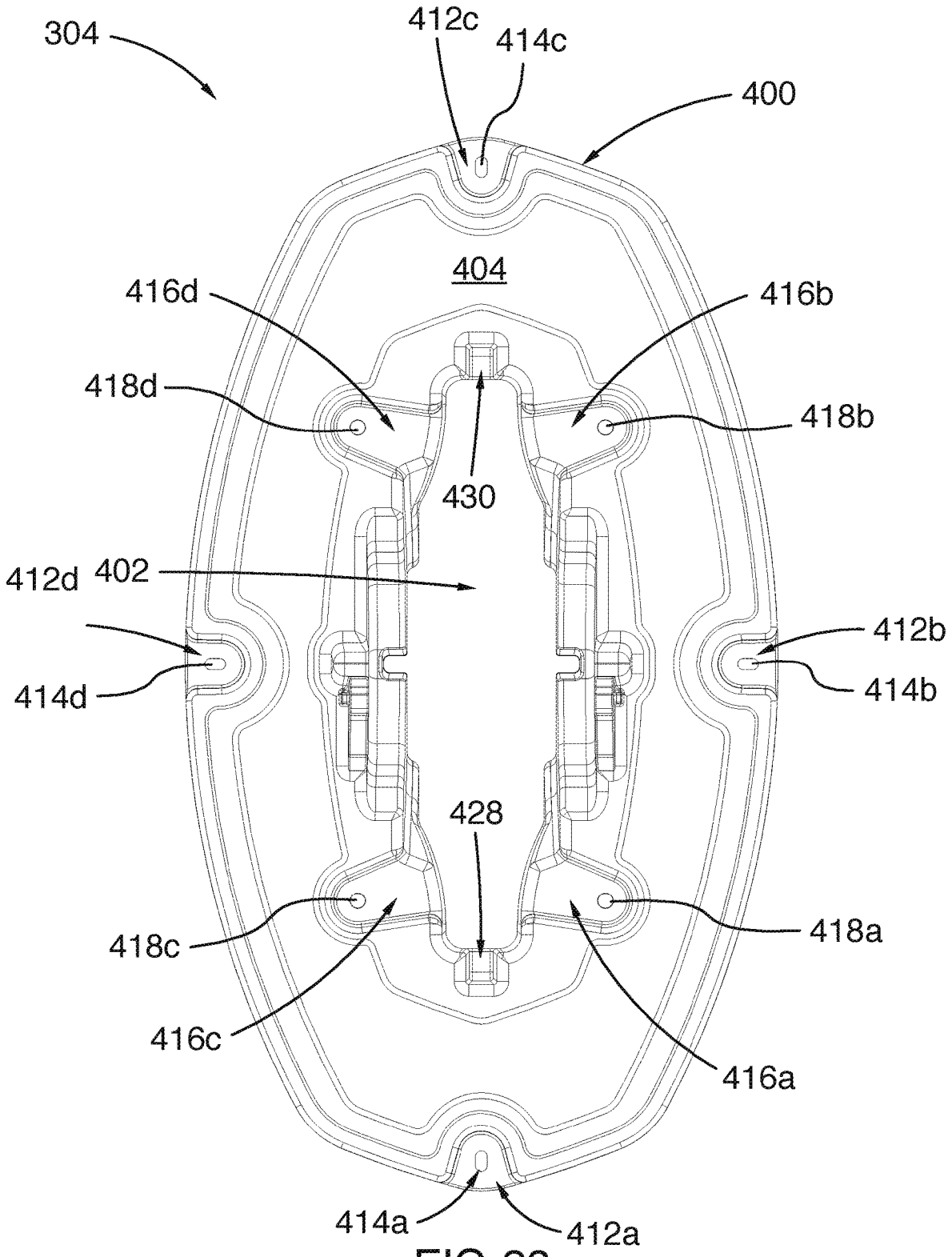
FIG. 23 is a to plan view of the top portion shown in FIG. 21.
Figure 24:
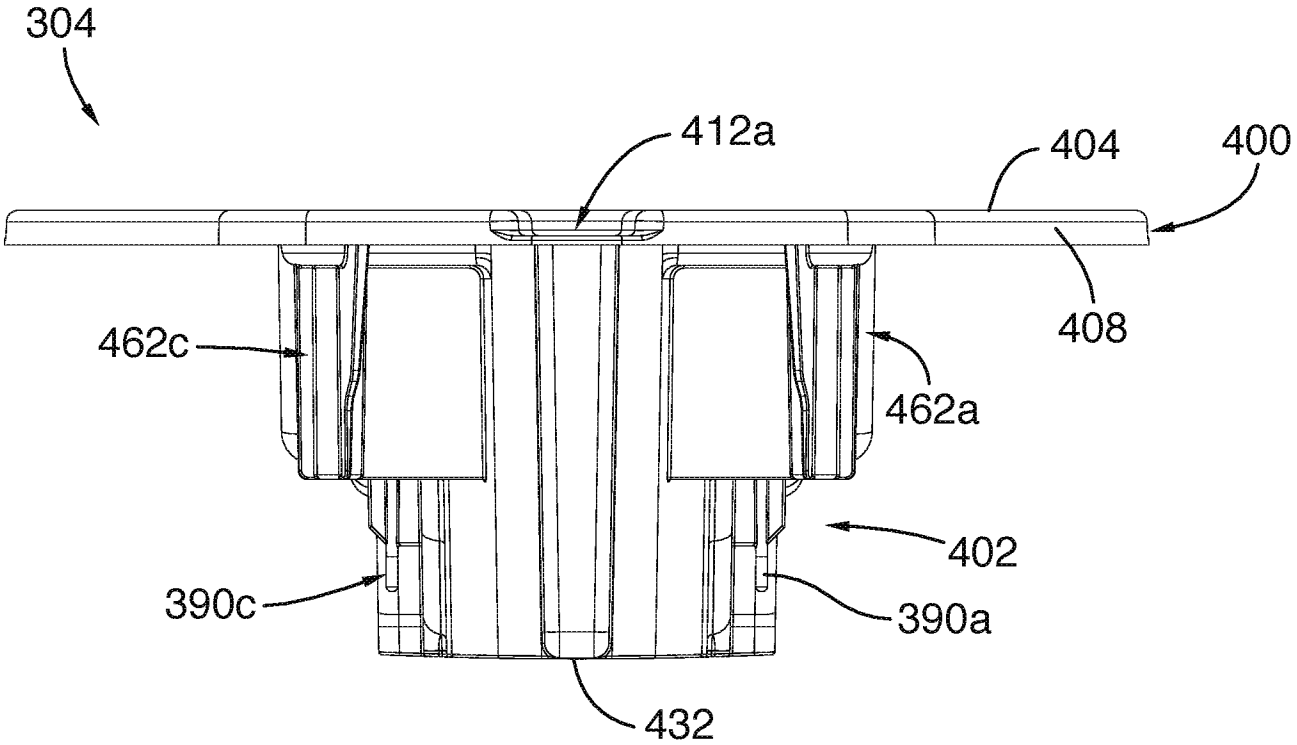
FIG. 24 is a rear elevation view of the top portion shown in FIG. 21.
Figure 25:
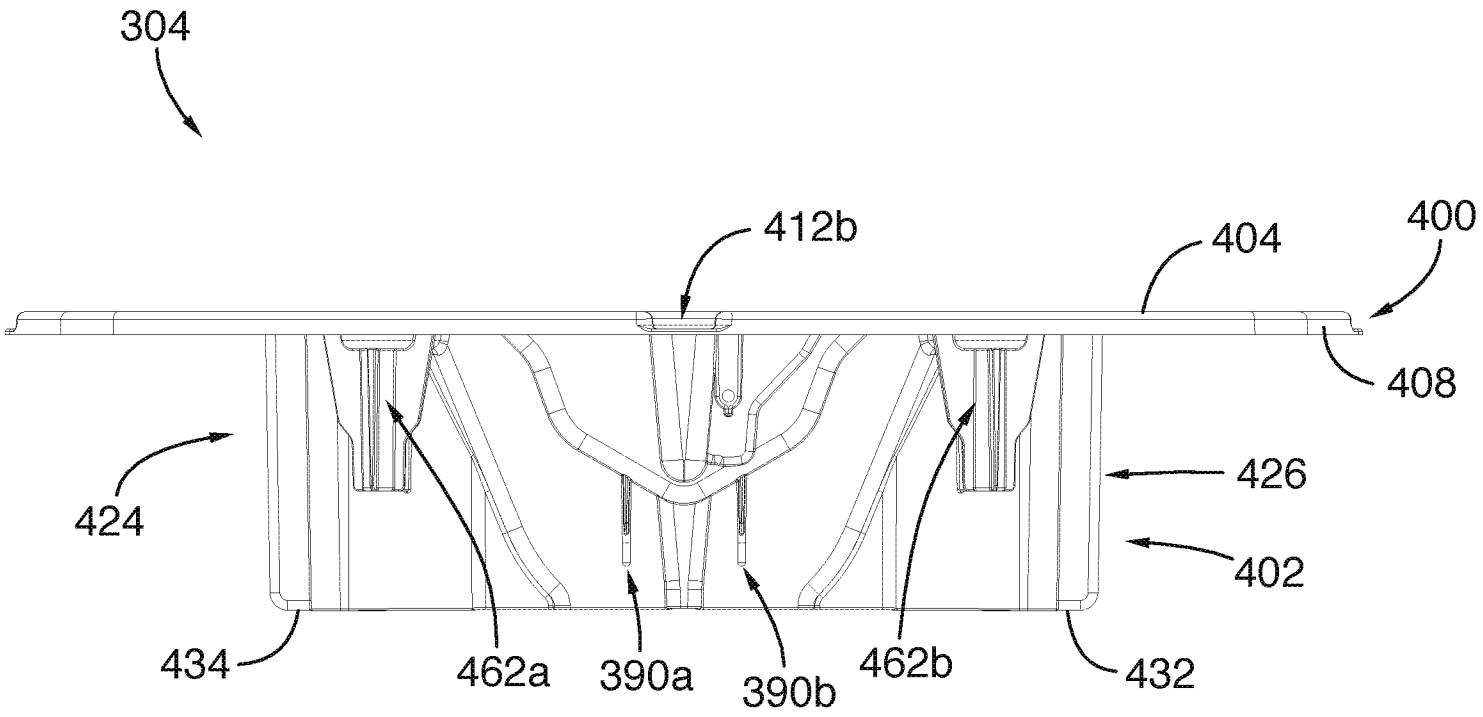
FIG. 25 is a right elevation view of the top portion shown in FIG. 21.
Figure 26:
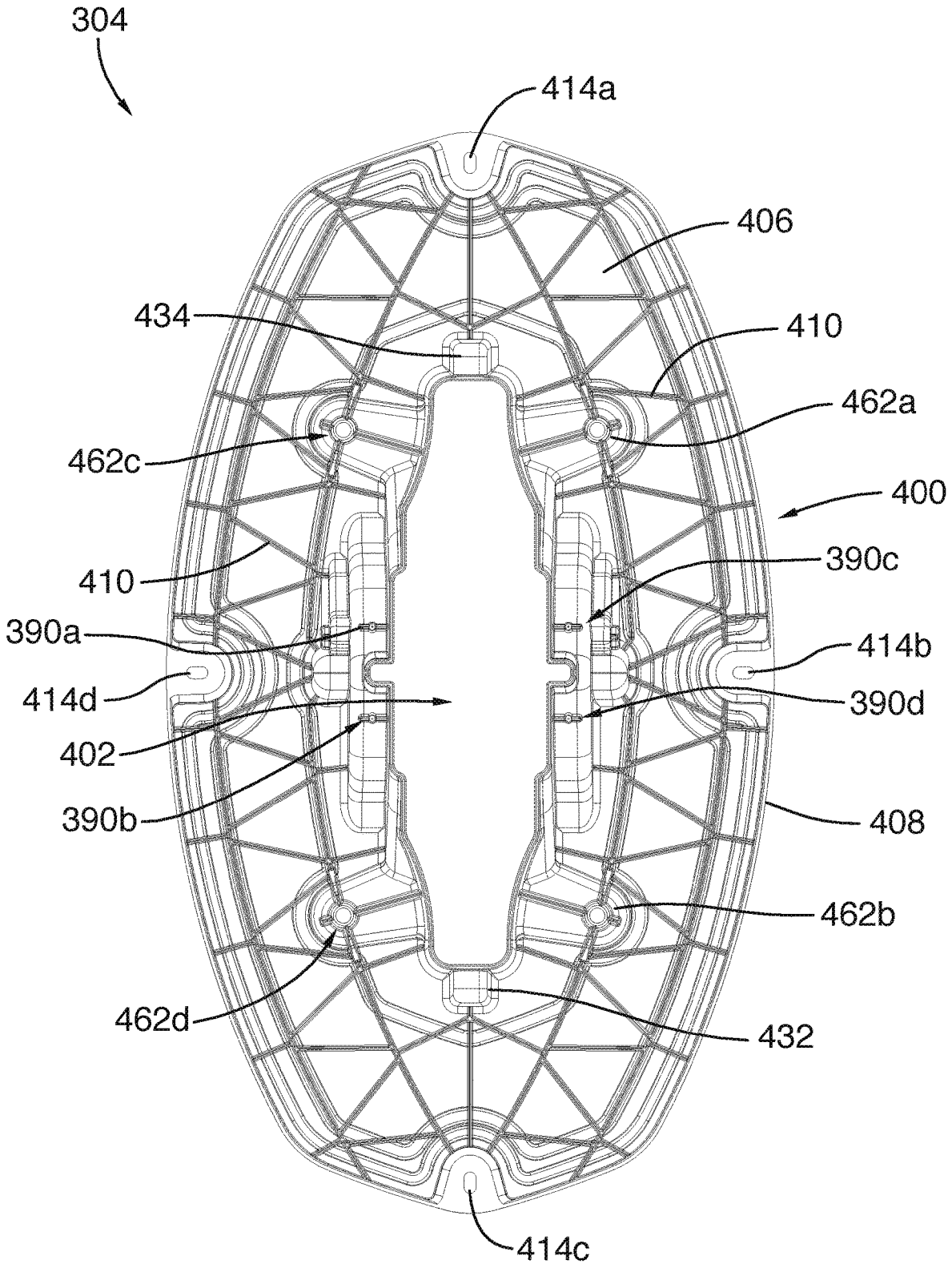
FIG. 26 is a bottom plan view of the top portion shown in FIG. 21.
Figure 27:
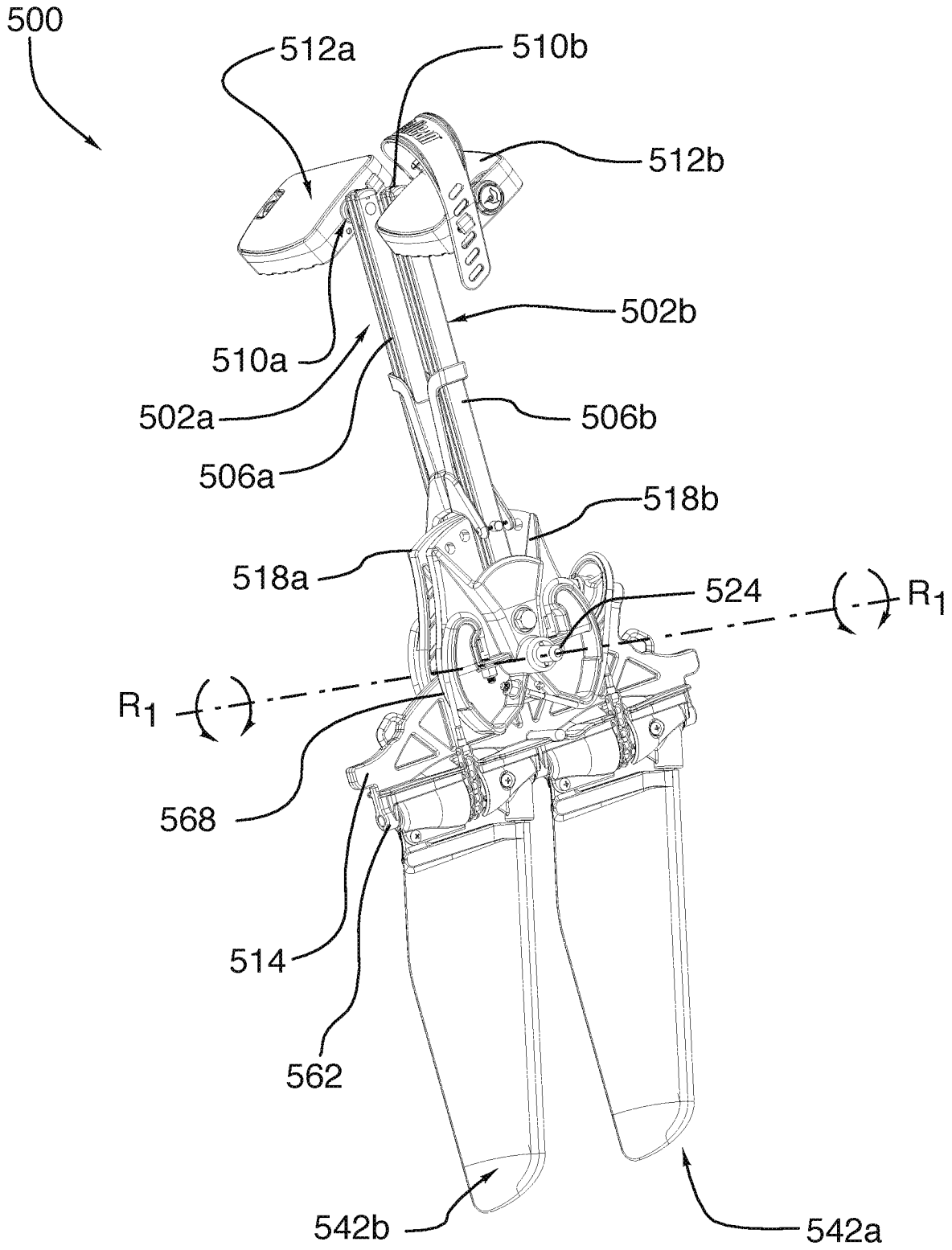
FIG. 27 is a rear, top right perspective view of the propulsion mechanism shown in FIG. 13.
Figure 28:
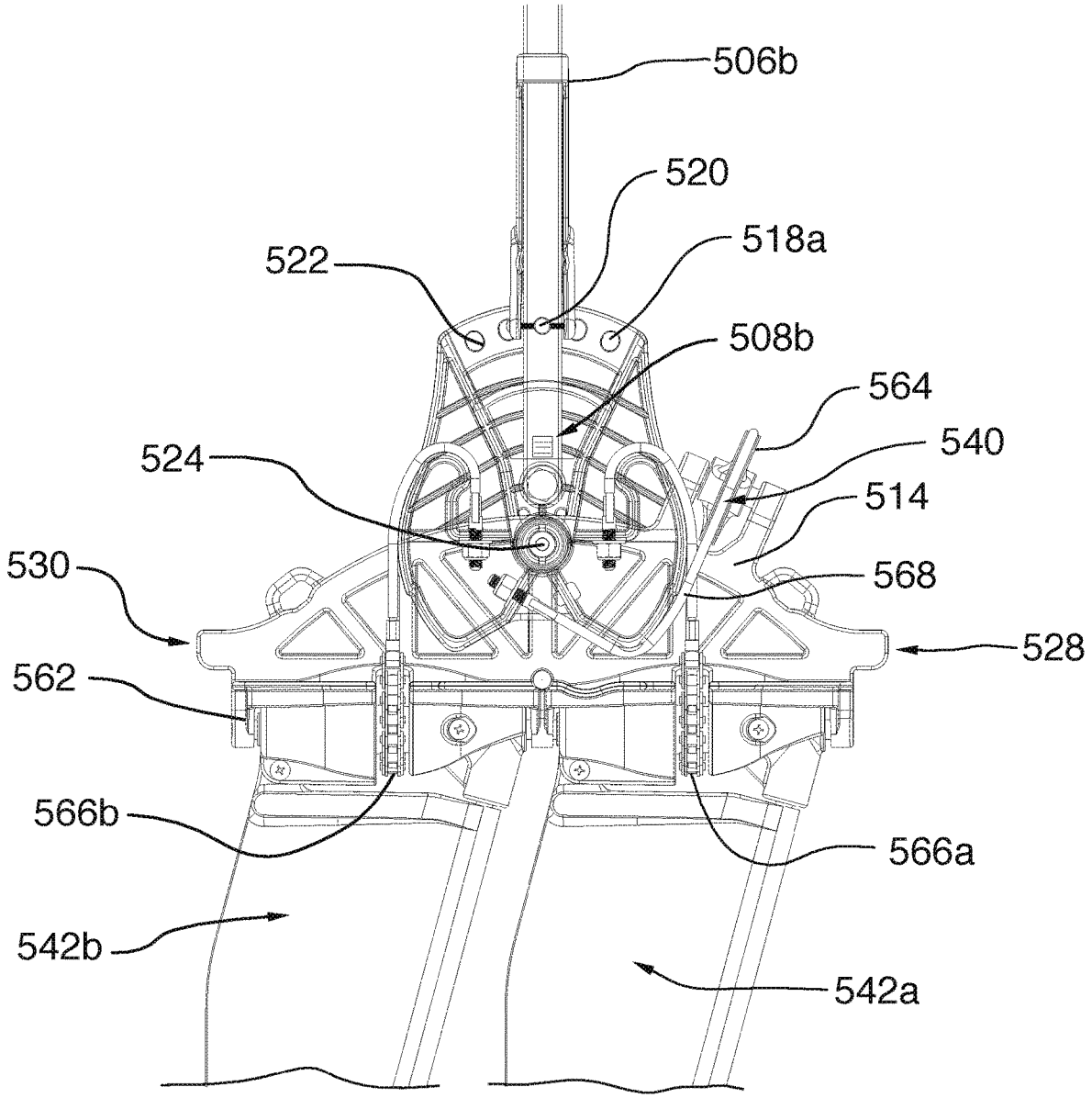
FIG. 28 is an enlarged right elevation view of the propulsion mechanism shown in FIG. 27.

The female portions 334*a*-334*d* of the guide assembly 336 are located adjacent to the elongated hole 312, on the front and rear sides of left and right indentations 368, 370 of the hole 312. With reference to FIG. 16C, each female portion 334*a*-334*d* of the guide assembly 336 comprises a cylindrical body 372, as well as a triangular reinforcement member 374 and a fin 376, the reinforcement member 374 and the fins 376 extending radially from the cylindrical body 372, in opposed directions (only female portion 334*a* being illustrated in FIG. 16C). More specifically, the fin 376 extends between the cylindrical body 372 and the inner wall 314 of the plate 306, while the triangular reinforcement member 374 extends toward the outer peripheral wall 316. Each fin 376 comprises a vertical edge, 378 extending generally vertical in a location slightly remote from the inner peripheral wall 314 of the bottom plate 306, as well as an inclined edge 380, extending from a top end 382 of the vertical edge 378, toward the cylindrical body 372. As such, the inclined edges 380 of the fins 376 are inclined downwardly, toward the elongated hole 312 of the bottom portion 302. Defined in the cylindrical body 372 of each female portion 334*a*-334*d* is a cylindrical hole 384 with a funneled opening 386 for receiving therein a male portion 390*a*-390*d* of the guide assembly 336, as it will be described in greater detail below.

Returning to FIG. 16B, the guiding fins 338*a*-338*d* each comprises a vertical edge 392, extending generally vertical in a location slightly remote from the inner peripheral wall 314 of the bottom plate 306, an inclined edge 394, extending from a top end 396 of the vertical edge 392, a top edge 398 extending from a top end 397 of the inclined edge 394 toward the outer peripheral wall 316, and a rear edge 399, extending from the top edge 398, at a slight angle, and connecting the same to a corresponding ridge 322. As best shown in FIG. 16A, one guiding fin (e.g. 338*a*) is positioned generally halfway between the fin of a fastening portion (e.g. fin 354*a* of fastening portion 332*a*) and the fins of the female portion of the directing assembly 336 (e.g. fin 376 of female portion 334*a*). Together, the guiding fins 334*a*-334*d*, the fins 354 of the fastening portions 332*a*-332*d* and the fins 376 of the female portions 334*a*-334*d* of the directing assembly 336 collaborate to guide the positioning of the top portion 304 of the interface 300 relative to the bottom portion 302 during the assembly of the interface 300, and maintaining such position once the interface 300 is assembled, as it will become apparent below. While in the illustrated embodiment the interface 300 comprises four guiding fins 338*a*-338*d*, four fins 354*a*-354*d* of fastening portions 332*a*-332*d* and four fins 376 of female portions 334*a*-334*d*, it will be appreciated that the interface 300 could comprise a different number of fins, and that the configuration of the fins could vary. For instance, the interface could be provided with only four fins, whether they are found on the fastening portions 332*a*-332*d*, the female portions 334*a*-334*d* or in any other suitable location of the bottom portion 302 of the interface.

With reference to FIGS. 21 to 26, the top portion 304 of the interface 300 will now be described. The top portion 304 comprises a generally horizontal top plate 400 as well as a channel 402 extending downwardly from the top plate 400, for receiving and mounting therein the foot propulsion mechanism 500.

The top plate 400 comprises a top face 404 and a bottom face 406, and is sized and shaped to be received in the recess 116 defined by the first portion 102 of the oblong well 100 defined in the body 12 of the kayak 10. Extending downwardly from the bottom face 406 of the top plate 400, about it periphery, is an outer peripheral wall 408. Also extending downwardly from the bottom face 406, between the peripheral wall 408 and the channel 402, are a plurality of reinforcement ridges 410. Together with the outer peripheral wall 408 of the top plate 400, the reinforcement ridges 410 contribute to provide the top plate 400 with additional rigidity in torsion and/or bending.

Defined on the top face 404 of the top plate 400, about the periphery, are four peripheral recesses 412*a*-412*d* each comprising an oblong hole 414*a*-414*d*. The oblong holes 414*a*-414*d* and the recesses 412*a*-412*d* are configured for receiving therein the threaded fasteners 120*a*-120*d* to fasten the top portion 304 of the interface 300 to the body 12 of the kayak 10, and accommodating the head of such threaded fasteners 120*a*-120*d* when the interface 300 is properly fastened to the body 12. Also defined on the top face 404 are four recesses 416*a*-416*d*, which are positioned adjacent to the channel 402. Each recess 416*a*-416*d* is provided with a corresponding hole 418*a*-418*d*. As it will become apparent below, the holes 418*a*-418*d* are configured for allowing the passage of the threaded fasteners 132*a*-132*d* used to secure the top portion 304 of the interface 300 to the bottom portion 302 while the recesses 416*a*-416*d* are configured for accommodation the head of threaded fasteners 132*a*-132*d* when such bottom and top portion 302, 304 are secured together to the body 12 of the kayak 10.

The channel 402 of the top portion 304 comprises an inner face 420 and an outer face 422, and a bottom end 403. At front and rear ends 424, 426 thereof, the channel 402 is provided with front and rear slots 428, 430 sized and shaped for respectively receiving front and rear ends 550, 552 of a core support 514 of the foot propulsion mechanism 500. At the bottom of the front and rear slots 428, 430 are abutments 432, 434, on which resting surfaces 554, 556 of the front and rear ends 550,552 of the core support 514 rest when the propulsion mechanism 500 is properly mounted to the interface 300.

Figure 14:
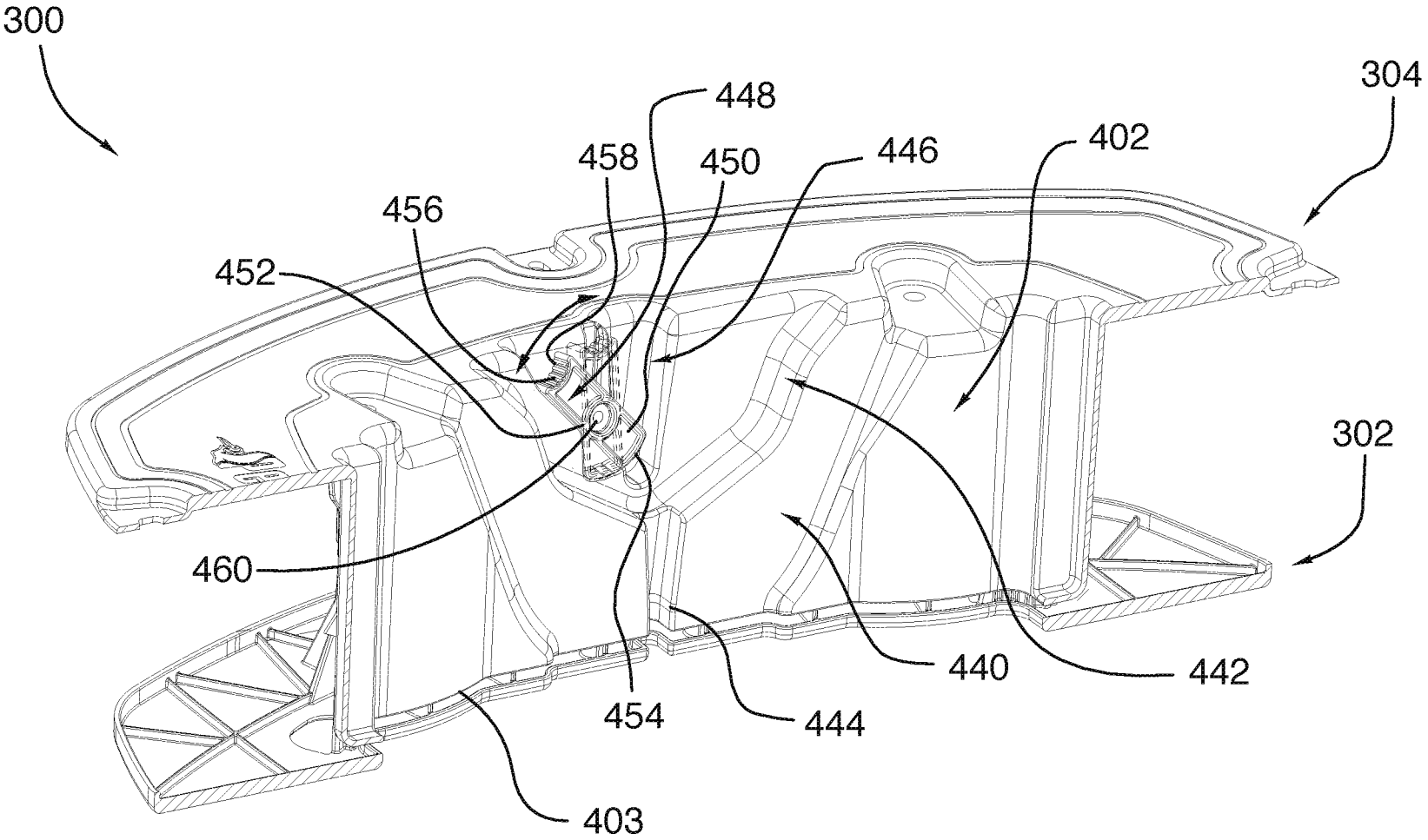
FIG. 14 is a cross-sectioned perspective view of the interface shown in FIG. 13, taken along line XIV-XIV.

With reference to FIG. 14, the channel 402 also comprises a first V-shaped recess 440, a second V-shaped recess 442 terminating into a lower funnel-shape slot 444, as well as a top funnel slot 446 and a lock receiving recess 448. At the bottom end 403 of the channel 402, the first V-shaped recess 440 and the remainder of the channel 402 are sized and shaped to generally conform to the periphery of the core support 514 of the foot propulsion mechanism 500, while the lower funnel-shaped slot 444 is configured to receive left and right transverse projections 548*a*, 548*b* of the core support 514, as it will be described in greater details below.

The top funnel slot 446 is configured for receiving therein a mounting shaft 524 of the foot propulsion mechanism 500. Mounted in each of the lock receiving recesses 448 is a lock 450. In the illustrated embodiment, the lock 450 comprises a generally elongated flat member 452 including a convex lower end 454 and a concave upper end 456, the concave upper end 456 being provided with grip elements 458 for enhancing contact between a finger of a user and the lock 450 for releasing the foot propulsion mechanism 500 from the interface 300. Provided in an intermediate location between the upper end 456 and the lower end 454 is a hole (not shown) for receiving a fastener 460 for pivotably mounting the lock 450 in the lock receiving recess 448 of the channel 402. When properly assembled, the lock 450 is pivotable between an unlock position for allowing the passage of the shaft (shown in dotted line in FIG. 14) and a lock position for preventing the passage of the mounting shaft 524 of the foot propulsion mechanism (shown in continuous line in FIG. 14) to thereby prevent unwanted removal of the foot propulsion mechanism 500 from the interface 300. In one embodiment, the lock 450 is provided with a bias mechanism (not shown), for instance a coil spring or a torsion spring, to bias the lock 450 toward the lock position.

Returning to FIGS. 22 to 25, extending downwardly from the bottom face 406 of the top plate 400 are fastening projections 462*a*-462, as well the male portions 390*a*-390*d* of the directing assembly 336. Each fastening projection comprises a generally cylindrical body 466*a*-466*d* provided and a plurality of reinforcement members 468*a*-468*d*, 470*a*-470*d*, 472*a*-472*d* and 474*a*-474*d*. Defined in the cylindrical body 466*a*-466*d* are holes 418*a*-418*d*.

While in the above embodiment the guiding assembly (i.e. the guiding fins 334*a*-334*d*, the fins 354 of the fastening portions 332*a*-332*d* and the fins 376 of the female portions 334*a*-334*d* of the directing assembly 336) are provided on the bottom plate 302 of the interface 300, and the channel 402 is provided on the top portion 304 of the interface, it will be understood that the location of these components could be inverted, where the channel (e.g. channel 402) would be provided on the bottom portion 302 and the guiding assembly would be provided on the top portion 304 of the interface.

Turning now to FIGS. 27 to 30, the foot propulsion mechanism 500 will now be described. In the illustrated embodiment, the foot propulsion mechanism 500 is an oscillating flapper propulsion system and comprises a set of left and right pedals 502*a* and 502*b* extending upwardly from the top portion 304 of the interface 300 when the foot propulsion mechanism 500 is properly mounted thereto. The pedals 502*a*, 502*b* are operatively mounted to a pair of oscillating, flexible flappers 542*a*, 542*b* via a cable and chain transmission 540 supported on a core support 514.

More specifically, the pedals 502*a*, 502*b* are adapted to be alternatively pushed by the user's feet to actuate the foot propulsion mechanism 500. Each of the left and right pedals 502*a*, 502*b* comprises a shaft 506*a*, 506*b* including a lower end 508*a*, 508*b* and an upper end 510*a*, 510*b*, as well as a footrest 512*a*, 512*b* for receiving one corresponding foot a the user. The lower ends 508*a*,508*b* of the shafts 506*a*, 506*b* are mounted to the core support 514, which is configured to extend longitudinally (i.e. along the longitudinal axis $L_1$-$L_1$ of the kayak 10 when the propulsion mechanism 500 is mounted to the interface 300), via a pair of mounting brackets 518*a*, 518*b*. Each mounting bracket 518*a*, 518*b* allow adjustment of the distance between the footrests 512*a*, 512*b* and the seat 28 by way of an adjustment bolt 520 engaging the lower ends 508*a*, 508*b* of the shafts 506*a*, 506*b* and a plurality of adjustment holes 522 disposed on the mounting brackets 518*a*, 518*b*. The mounting brackets 518*a*, 518*b* are also configured for receiving a mounting shaft 524 extending transverse to the longitudinal axis $L_1$-$L_1$ and engaging the core support 514. The mounting shaft 524 allow rotation of the left and right pedals 502*a*,502*b* relative to the core support 514, about a rotation axis $R_1$-$R_1$.

Figure 29:
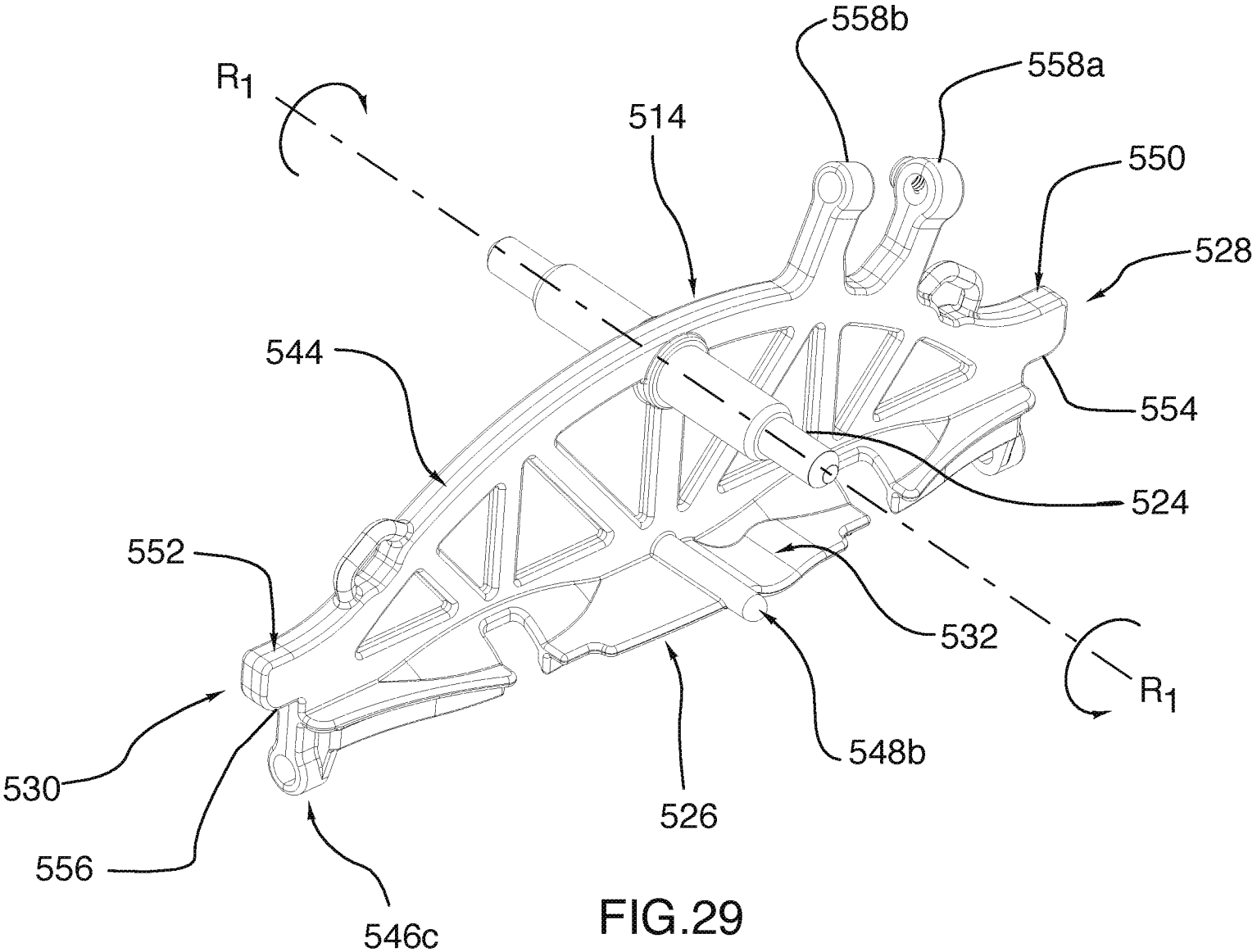
FIG. 29 is a rear, top right perspective view of a core support of the propulsion mechanism shown in FIG. 27, with a pedal shaft mounted thereto.
Figure 30:
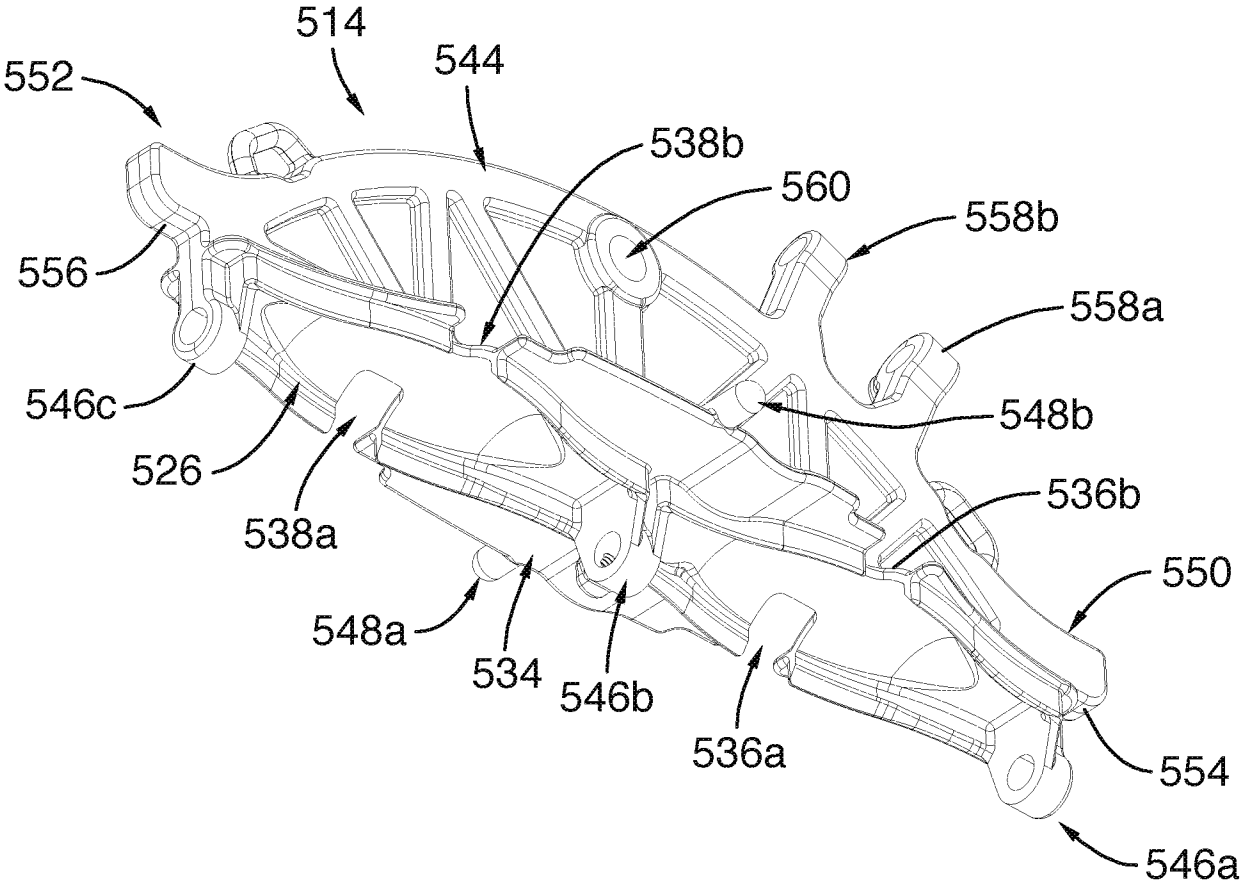
FIG. 30 is a rear, bottom right perspective view of the core support shown in FIG. 29, without the pedal shaft.

With reference to FIGS. 29 and 30, the core support 514 is a monolithic piece and comprises a generally horizontal base 526 having a front end 528, a rear end 530, a top face 532 and a bottom face 534. The generally horizontal base 526 is sized and shaped to be received in the channel 402 of the interface 300 and to substantially conceal the same when the foot propulsion mechanism 500 is mounted to the interface 300, and comprises a plurality of indentations 536*a*, 536*b* 538*a*, 538*b* for allowing the passage of the cable and chain transmission 540 operatively coupling the pedals 502*a*, 502*b* to the flappers 542*a*, 542*b*. The core support 514 also comprise an upright mounting support 544 extending upwardly from the top face 532 of the horizontal base 526, as well as three mounting brackets 546*a*-546*c* extending downwardly from the bottom face 534 for mounting the flappers 542*a*, 542*b*. At the junction of the horizontal base 526 and the upright support 544, generally halfway between the front and rear ends 528, 530, are left and right transverse projections 548*a*, 548*b*, which protrude on each side of the horizontal base 526. As is will be described in greater details below, the left and right transverse projections 548*a*, 548*b* are sized and shaped to engage the lower funnel-shaped slot 444 of the interface 300.

The upright mounting support 544 comprises a front end 550 and a rear end 552. The front and rear ends 550, 552 of the upright mounding core support 514 extend beyond the front and rear ends 528, 530 of the horizontal base 526, to define restring surfaces 554, 556 for mounting the foot propulsion mechanism 500 to the interface 300, as it will become apparent below. The upright support 544 also comprises a pair of pulley mounting brackets 558*a*, 558*b* as well as a transverse bore 560 for receiving therein the mounting shaft 524. To mount the pedals 502*a*,502*b* to the core support 514, the shaft 524 is rotatably engaged in the mounting brackets 518*a*, 518*b* of the pedals 502*a*, 502*b* and the transverse hole 560 of the upright mounting support 544. When properly positioned, the mounting shaft 524 extends beyond each side of the horizontal base 526, and is sized to engage top funnel slot 446 of the channel 402 of the interface 300, as it will become apparent below.

The foot propulsion mechanism 500 also comprises the flexible flappers 542*a*, 542*b* each adapted to oscillate through an arcuate path in a generally transverse direction with respect to the longitudinal axis $L_1$-$L_1$, about a rotation axis $R_2$-$R_2$ which is at or below the bottom of the hull 24 of the kayak 10 when the propulsion mechanism 500 is mounted to the interface 300. More specifically, the flexible flappers 542*a*, 542*b* are carried by a shaft 562 extending generally longitudinally and rotatably mounted to the core support 514 via the three flapper mounting brackets 546*a*-546*c*. The flappers 542*a*, 542*b* are operatively coupled to the mounting brackets 518*a*, 518*b* of the pedals 502*a*, 502*b* via the cable and chain transmission 540, which include a pulley 564 mounted to the pulley mounting brackets 558*a*, 558*b*, chains 566*a*, 566*b* engaging sprockets (not shown) mounted to the shaft 562 and cables 568 connecting the chains 566*a*, 566*b* to the mounting brackets 518*a*, 518*b*. While in the illustrated embodiment the propulsion system 500 is a foot propulsion system, it will be understood that it could also be operated by hand.

Figure 31:
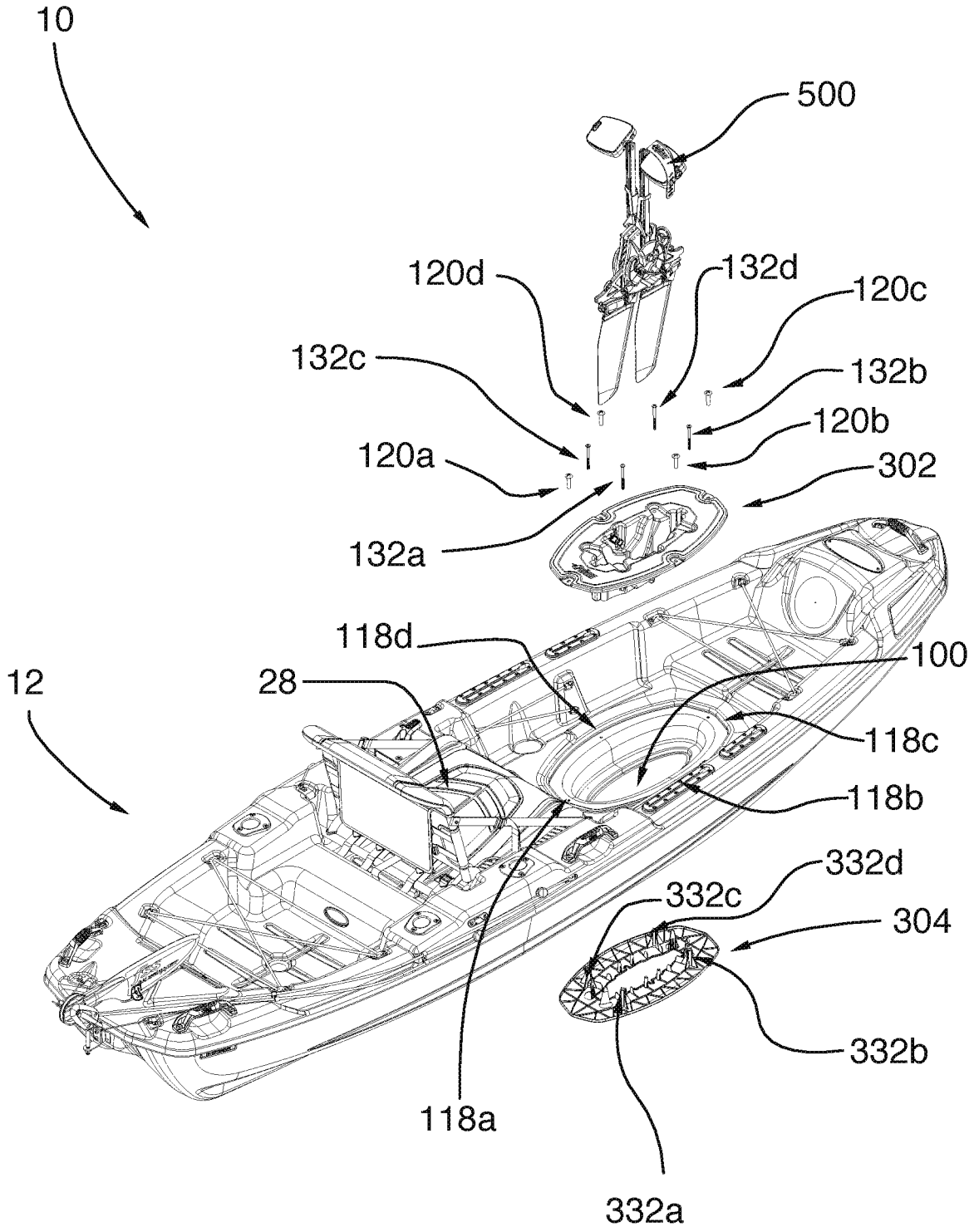
FIG. 31 is a rear, top right, partially exploded view of the kayak shown in FIG. 1.

Having described the general components of the kayak 10 and of the interface 300, their assembly will now be described, with reference to FIG. 31. The body 12 of the kayak 10 may be manufactured using any suitable process, including without being limited to, thermoforming processes, blowmolding processes and rotomolding process. In a specific practical implementation, the body 12 of the kayak 10 may be manufactured by molding two sheets of extrudable material using a thermoforming process to shape the two manufactured sheets into a kayak shape of the type described in the present document, one sheet being used for the top side (i.e. the deck 20) and the other for the bottom side (i.e. the hull 24) of the kayak 10. Examples of the different types of thermoplastics that can be extruded include: LDPE, HDPE, ABS, polystyrene, polypropylene, acetates, butyrates, nylons, polyphenylene sulfides, acetals, polycarbonates and thermoplastic rubbers and polyesters, among other possibilities. As it will be appreciated, the well 100 of the kayak 10 may be closed when the deck 20 and hull 24 emerged from the mold after welding. As such, the manufacturing of the kayak 10 may require an opening to be defined in the well post-molding. Typically, such an opening will be carried out by a worker using a cutting tool such as a rotary saw. As it will be understood, the shape of the well (i.e. a generally oblong shape) greatly simplify the cutting of the opening as compared to a more complex hole shape, thereby facilitating the manufacturing of the kayak 10.

The interface 300 is then mounted to the body 12 of the kayak 10, by first positioning the lower portion 302. To do so, the snapfits 324*a*-324*d* and fastening projections 332*a*-332*d* are engaged in the oblong well 100 of the body 12, and is forced upwardly until the snapfits 324*a*-324*d* engage the lip 138 of the third portion 106 of the well 100, thereby partially securing the lower portion 302 of the interface 300 to the body 12. When the lower portion 302 is engaged in the well 100 in such a position (i.e. when the snapfits 324*a*-324*d* engage the lip 138), the fastening projections 332*a*-332*d* abut the abutment wall 142 of the fourth portion 108 of the well 100, and the threaded bores 366*a*-366*d* of the fastening projections 332*a*-332*d* are aligned with holes 130*a*-130*d*. Furthermore, in such a position, the plate 306 is receive in the recess 152 defined by the peripheral wall 148 and the abutment wall 150 of the fifth portion 110 of the well 100, while the female portions 334*a*-334*d* of the directing assembly 336, the guiding fins 334*a*-334*d*, the fins 354 of the fastening portions 332*a*-332*d*, the fins 376 of the female portions 334*a*-334*d* and the elongated hole 312 are vertically aligned with the open portion of the well 100.

The top portion 304 of the interface 300 is then assembled by positioning the top portion 304 in vertical alignment with the well 100 and gradually lowering down until the top plate 400 is completely received in the recess 116 defined by the peripheral wall 112 and the first abutment wall 114 of the first portion 102 of the well 100. To properly position the bottom end 403 of the channel 402 in alignment with the elongated hole 312 of the lower portion 302, a male portions 390*a*-390*d* of the guide assembly 336 gradually engages female portions 334*a*-334*d* of the directing assembly 336, while the bottom end 403 of the channel 402 gradually engages the inclined edges 358, 380, 394, and then the vertical edges 356, 378, 392 of the guiding fins 334*a*-334*d*, the fins 354 of the fastening portions 332*a*-332*d*, the fins 376 of the female portions 334*a*-334*d*. As such, the directing assembly 336 and the guiding fins 334*a*-334*d*, the fins 354 of the fastening portions 332*a*-332*d* and the fins 376 of the female portions 334*a*-334*d* define a guiding assembly and assist in properly aligning the top and bottom portions 302, 304 of the interface 300 during their assembly with the body 12 of the kayak 10.

When the top portion 304 of the interface 300 is properly positioned relative to the lower portion 302 of the interface 300 and to the body 12 of the kayak 10, the fastening projections 462*a*-462*d* of the top portion 304 are received in the recesses 146*a*-146*d* of the second abutment wall 128 of the third portion 106. Threaded fasteners 132*a*-132*d* are then sequentially engaged into holes 418*a*-418*d* found in the recesses 416*a*-416*d* of the top portion, in holes 130*a*-130*d* of the of second abutment wall 128 and in threaded bores 366*a*-366*d* fastening projections 332*a*-332*d*, thereby securing the top portion to the body 12 of the kayak 10 and to the lower portion 302 of the interface 300. As it will be appreciated, in this position, the second abutment wall 128 of the body 12 is sandwiched between the fastening projections 332*a*-332*d* and 462*a*-462*d* of the lower and upper portions 302, 304, respectively.

To further secure the interface 300 to the body 12, threaded fasteners 120*a*-120*d* are engaged in the oblong holes 414*a*-414*d* defined in the recesses 412*a*-412*d* of the top portion 304, and in the vertically aligned holes 118*a*-118*d* of the body 12, until the head of the threaded fasteners 120*a*-120*d* are received in the recesses 412*a*-412*d*, to complete the assembly of the interface 300 with the body 12 of the kayak 10.

While in the illustrated embodiment the interface 300 is mounted to the body 12 of the kayak 10 using four threaded fasteners 120*a*-120*d* engaging the top portion 304 of the interface and the body 12, and four threaded fasteners 132*a*-132*b* engaging the top portion 304 and the bottom portion 302 of the interface, it will be understood that the interface 300 could be mounted to the body 12 of the kayak differently, for instance by using a different number of fasteners, by positioning the fasteners in other locations or by using other types of fasteners (e.g. rivets). As such, the person skilled in the art will appreciate that the number of projections extending from the top and bottom portions of the interface 300, as well as the number and position of the recesses can be adjusted accordingly.

Further, as it will be appreciated, the description of the assembly of the interface 300 with the body 12 of the kayak 10 assumes that the kayak 10 is assembled with the deck 20 in an upside position and the hull 24 in a downside position. As it will be appreciated, the assembly of the interface 300 with the body 12 could be carried out by positioning the body 12 of the kayak upside/down or in any other position. As such, the referring to moving the various elements up or down is in no way intended to limit assembly steps of the kayak 10.

It will also be appreciated that since the interface is secured to the body 12 of the kayak 10 using threaded fasteners and snapfits 324*a*-324*d*, the interface 300 can be removed from the body 12. This may prove advantageous for instance where the operation of the foot propulsion mechanism 500 over time has created damages or weaknesses to the interface 300. Thus, the interface 300 can be replaced with another interface, thus avoiding the need to replace the entire body of the kayak 10 while ensuring continuous structural integrity of the kayak 10 and the optimum use of the foot propulsion mechanism 500.

Once the interface 300 is properly mounted to the body 12, the user has the possibility to removably mount the foot propulsion mechanism 500 to the interface 300, for instance when the kayak 10 is floating on a water surface. To do so, the user engages the lower part of the flappers 542*a*, 542*b* into the channel 402 of the top portion 304, and gradually lowers down the foot propulsion mechanism 500. When the core support 514 of the foot propulsion mechanism gradually engages the channel 402, the left and right transverse projections 548*a*, 548*b* engage lower funnel-shape slots 444 while the shaft 524 engages the top funnel slot 446. As the foot propulsion mechanism 500 is further lowered down, the shaft 524 forces the lock 450 pivotably mounted in the lock receiving recess 448 toward their unlock position, until the shaft 524 reaches its position in the top funnel slot 446. In such position, the lock 450 are allowed to pivot back to their lock position, where the convex lower end 454 of the lock 450 engage the shaft 524 to prevent unwanted removal of the foot propulsion mechanism 500. Furthermore, when the foot propulsion mechanism 500 is properly positioned in the interface 300, the resting surfaces 554,556 provided at the front and rear ends 550, 552 of the upright mounting support 544 of the core support 514 lie on the abutments 432, 434 of the front and rear slots 428, 430 defined in the channel 402, while the shaft 562 and the flappers 542*a*, 542*b* extend below the hull 24. As it will be appreciated, the left and right transverse projections 548*a*, 548*b*, the shaft 524 and the front and rear ends 550, 552 of the upright mounting support 544, as well as the shape of the horizontal base 526 of the core support 514 (which substantially correspond to the shape of the channel 402), collaborated with the various portions of the interface 300 to prevent movement of foot propulsion mechanism 500 relative to the interface 300 during the operation.

When the user wants to remove the foot propulsion mechanism 500 from the interface 300, for instance to facilitate transport of the kayak 10, the user forces the locks 450 toward their unlock position by engaging the grip elements 458 at the concave upper ends 456, thereby allowing the shaft 524 to travel upwardly in the channel 402. The user then pulls on the foot propulsion mechanism 500 to disengage the same from the interface 300.

While the kayak 10 has been described in connection with the embodiment illustrated in FIGS. 1 to 31, it will be understood that variations are possible without departing from the scope of the invention. For instance, while the interface 300 and foot propulsion mechanism 500 are described in connection with a kayak 10 provided with a single seat 28, they could also be used in connection with a tandem kayak, or with any other type of watercraft, including small boats, a paddleboards and pedal boats. Likewise, while the foot propulsion mechanism 500 described in the illustrated embodiment is an oscillating flapper propulsion system, it will be understood that the interface 300 could be used in conjunction with other types of propulsion mechanisms, such as hand operated propulsion mechanisms, motorised propulsion mechanisms such as electric motors and gas motors, whether they are of the flapper oscillating type, propeller type or blade type. Furthermore, the interface 300 could be used in conjunction with a plug configured to be received in the channel 402 and concealing the elongated hole 312 of the interface 300 when no propulsion mechanism is used, for instance when the user propels the kayak 10 with paddles.

Furthermore, while the kayak 10 has been described in connection with the interface 300 shown in FIGS. 11 to 26, it will be understood that other interface configurations are possible without departing from the scope of the invention. For instance, while the channel 412 extends from the top portion 304 and the elongated hole 312 is defined in the bottom portion 302, the channel (e.g. channel 412) could extend upwardly from a bottom portion (e.g. bottom portion 302) while the elongated hole (e.g. elongated hole 312) and the fins (e.g. guiding fins 338*a*-338*d*, 354*a*-354*d* and 376) could be defined or extend from the top portion (e.g. top portion 304).

It will also be understood that an interface could be configured to comprise only one of the top and bottom portions (e.g. top portion 304 or bottom portion 302), from which would extend a channel (e.g. channel 412), either downwardly (in the case of a top portion) or upwardly (in the case of a bottom portion). In such cases, the top or bottom portion would be secured to the body 12 of the kayak 10 using fasteners engaging the top or bottom portion, and the body 12 of the kayak. Taking top portion 304 as an example, to secure the interface constituted by the top portion 304 to the body 12, threaded fasteners 120*a*-120*d* would be engaged in the oblong holes 414*a*-414*d* defined in the recesses 412*a*-412*d* of the top portion 304, and in the vertically aligned holes 118*a*-118*d* of the body 12, until the head of the threaded fasteners 120*a*-120*d* are received in the recesses 412*a*-412*d*, to complete the assembly of the top portion 304 with the body 12 of the kayak 10.

Alternatively, the interface could be provided with both a bottom portion (e.g. bottom portion 302) and a top portion (e.g. top portion 304), but mounted to the body 12 of the kayak 10 differently than interface 300. For instance, the bottom and top portions could have no fastening projections (e.g. fastening projections 332*a*-332*d* and 462*a*-462*d*), in which case the top and bottom portions would be secured to the body 12 of the kayak 10 by using threaded fasteners engaging either the bottom portion and the body 12 of the kayak, or the top portion and the body 12 of the kayak. Alternatively, various arrangements of snapfits could be used.

Figure 32:
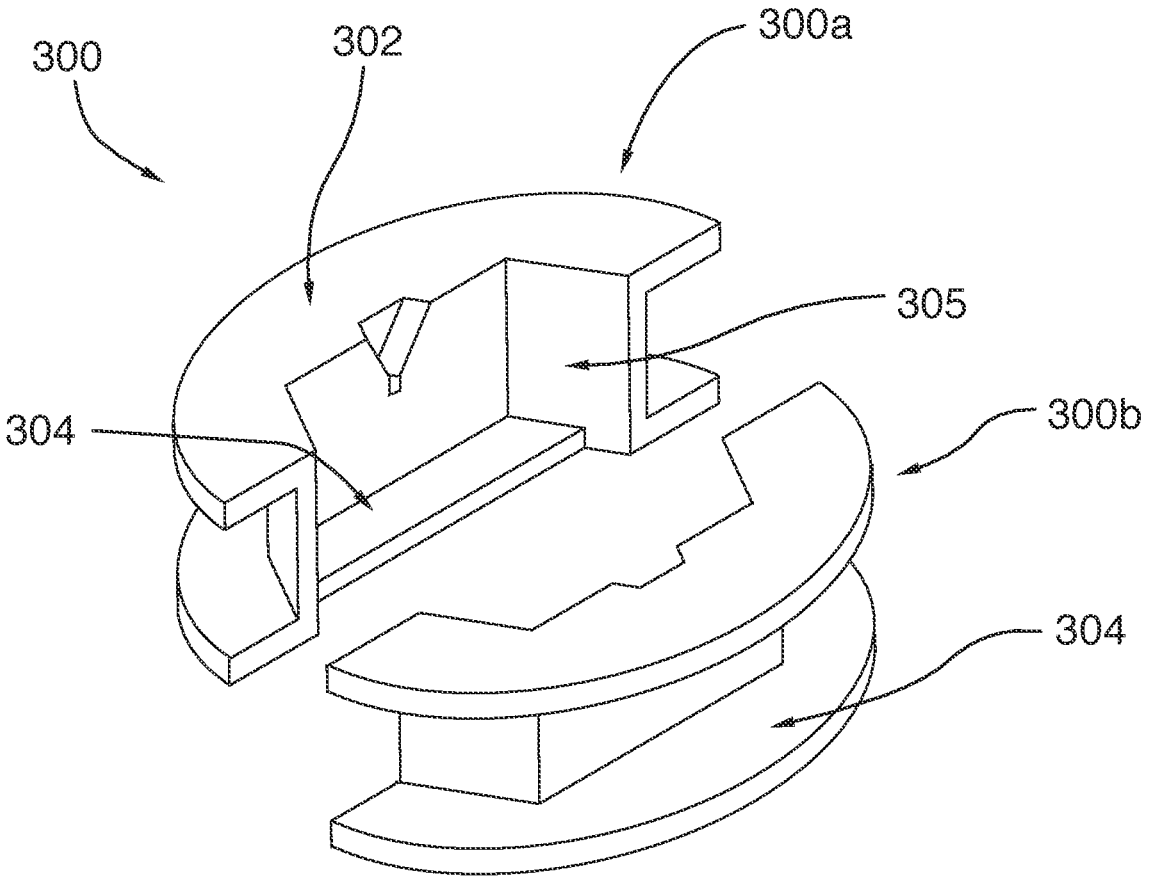
FIG. 32 is a top perspective view of an interface, in accordance with some embodiments.
Figure 33:
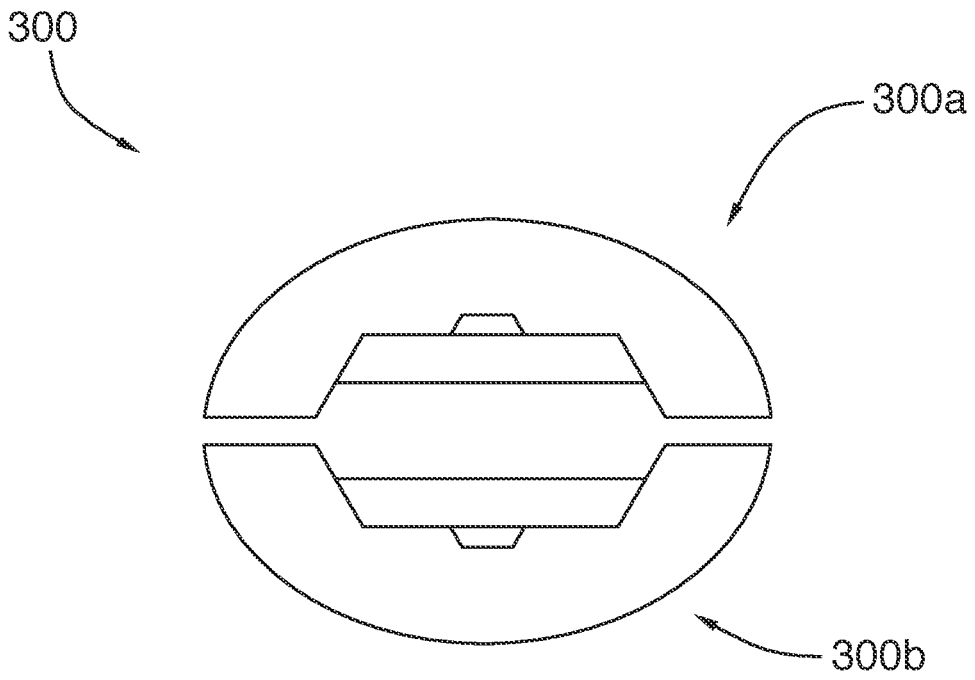
FIG. 33 is a top view of the interface shown in FIG. 32 bottom, rear right perspective view of the interface and propulsion mechanism shown in FIG. 32.

Tuning now to FIGS. 32 and 33, the interface 300 will now be described, in accordance with some embodiments. The interface 300 comprises a first (left) interface section 300*a*, and a second (right) interface section 300*b*. The first and second interface section being essentially mirror images of one another, only first interface section 300*a* will be described. It will however be appreciated that a similar description also applies to second interface section 300*b*, with proper adaptation.

The first interface section 300*a* comprises a top plate 302, a bottom plate, 304 and a first channel section 305 extending between the top plate 302 and the bottom plate 304. In the illustrated embodiment, the top plate 302 and the bottom plate 304 are spaced-apart and extend generally parallel to one another. The distance separating the top plate 302 and the bottom plate 304 generally corresponds to the distance between the deck 20 and the hull 24, such that the top plate 302 abuts against the deck 20 while the bottom plate 304 abuts against the hull 24 when the first interface section 300*a* is mounted to the body 12 of the kayak 10. As such, the first channel portion 305 comprises a top end adjacent to the top plate 302 and a bottom end adjacent to the bottom plate 304, the distance between the top end and the bottom end of the first channel portion 305 being adapted to permit such abutment of the top plate 302 and bottom plate 304 against the deck 20 and hull 24, respectively, thereby reducing possible slack between the structures, which could eventually contribute to increased wear and tear.

To mount the first and second interface sections 300*a*, 300*b* to the body 12 of the kayak 10, the first interface section 300*a* is first positioned, by sequentially engaging the bottom plate 304 and the first channel portion 305 in the well 100, until the top plate 302 and the bottom plate 304 are in general alignment with the deck and hull surfaces. At that point, the first interface section 300*a* can be pushed laterally such that a segment of the rigid body 82 of the kayak 10 surrounding the well 100 is sandwiched between the top plate 302 and the bottom plate 304. The second interface section 300*b* can then be positioned, again by sequentially engaging the bottom plate 304 and the channel section. As it will be appreciated, the first and second interface sections can be moved into the well and/or relative to one another so as to facilitate the passage of the bottom plate of the second interface section in the well, until the top plate 302 and the bottom plate 304 are in general alignment with the deck and hull surface, respectively. At that point, the second interface section 300*b* can be pushed laterally, in a direction opposite to the first interface section 300*a* such that another segment of the rigid body of the watercraft surrounding the well is sandwiched between the top plate 302 and the bottom plate 304 of the second interface section. In other embodiments either or both of the top plate 302 or the bottom plate 304 are removably attached to the respective channel portion, so that they can be removed in order to slide the channel portion into the well. The removed top and/or bottom plate is then reattached once the channel portion is in the well.

At that point, the first and second interface sections 300*a*, 300*b* can be secured to the body of the watercraft by way of a securing assembly. In some embodiments, the securing assembly is configured to secure the first and second interface sections 300*a*, 300*b* to the body by attaching the first and second interface section 300*a*, 300*b* to one another, to thereby prevent movement of the interface 300 relative to the body 12 of the kayak 10. In an alternate embodiment, the securing assembly comprises a plurality of fasteners engaging each of the first and second interface sections 300*a*, 300*b* and the body 12 of the kayak 10. In a further alternate embodiment, the fastening assembly is configured to secure the first and second interface sections 300*a*, 300*b* to the body 12 by attaching the first and second interface sections 300*a*, 300*b* to one another, and comprises a plurality of fasteners engaging each of the first and second interface sections 300*a*, 300*b* and the body 12 of the kayak 10.

Figure 34:
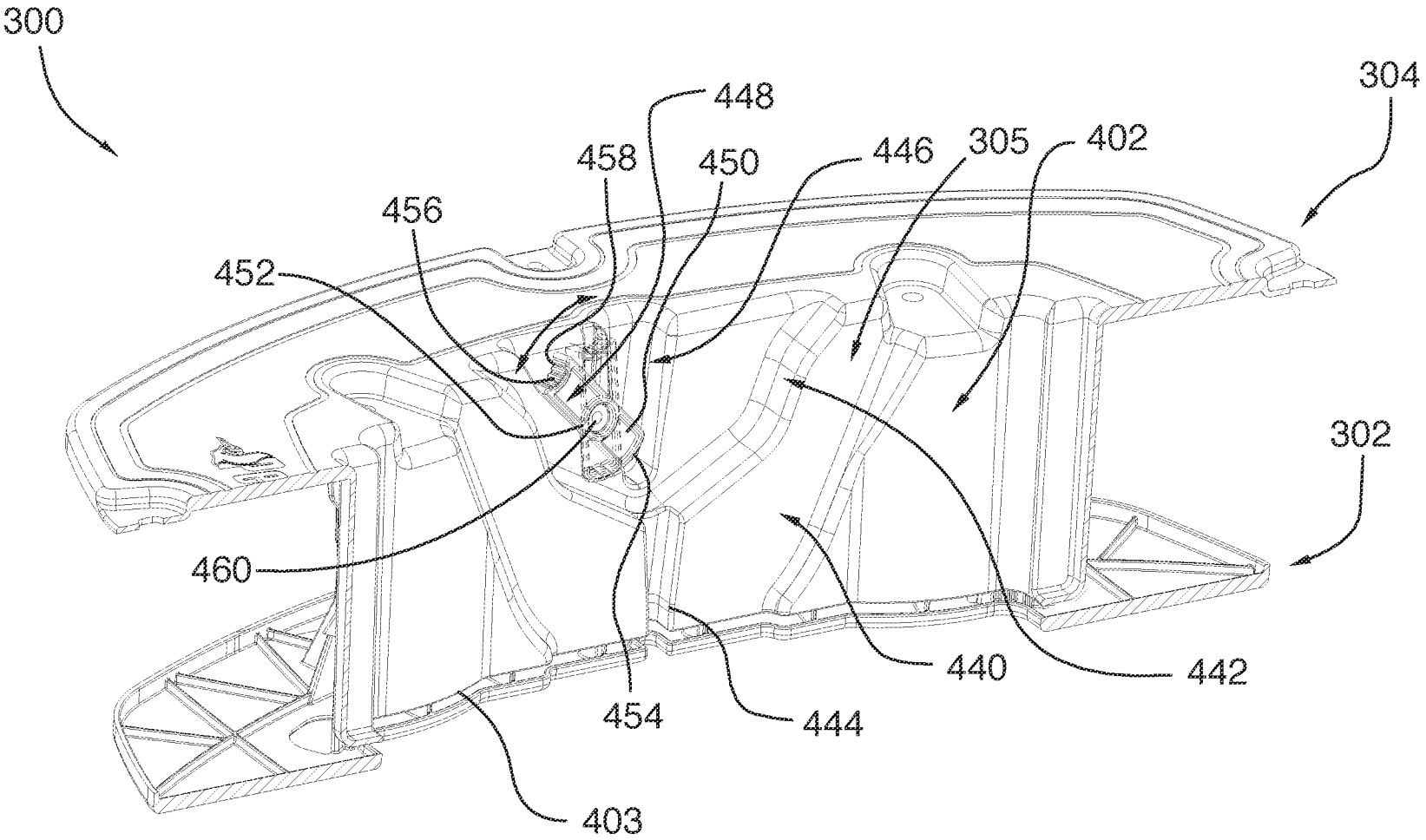
FIG. 34 is a top, perspective view of a left portion of the interface shown in FIG. 11.

Together, the first and second interface sections 300*a*, 300*b* define a channel portion 305. With reference to FIG. 34, which is presented to illustrate some principles of the of the channel portion 305 rather that all of the structures thereof, the channel 305 also comprises a first V-shaped recess 440, a second V-shaped recess 442 terminating into a lower funnel-shape slot 444, as well as a top funnel slot 446 and a lock receiving recess 448. At the bottom end 403 of the channel 305, the first V-shaped recess 440 and the remainder of the channel 305 are sized and shaped to generally conform to the periphery of the core support 514 of the foot propulsion mechanism 500, while the lower funnel-shaped slot 444 is configured to receive left and right transverse projections 548*a*, 548*b* of the core support 514.

The top funnel slot 446 is configured for receiving therein a mounting shaft 524 of the foot propulsion mechanism 500. Mounted in each of the lock receiving recesses 448 is a lock 450. In the illustrated embodiment, the lock 450 comprises a generally elongated flat member 452 including a convex lower end 454 and a concave upper end 456, the concave upper end 1456 being provided with grip elements 1458 for enhancing contact between a finger of a user and the lock 1450 for releasing the foot propulsion mechanism 500 from the channel portion 1305. Provided in an intermediate location between the upper end 456 and the lower end 454 is a hole (not shown) for receiving a fastener 1460 for pivotably mounting the lock 450 in the lock receiving recess 1448 of the channel portion 305. When properly assembled, the lock 1450 is pivotable between an unlock position for allowing the passage of the shaft (shown in dotted line in FIG. 34) and a lock position for preventing the passage of the mounting shaft 524 of the foot propulsion mechanism (shown in continuous line in FIG. 34) to thereby prevent unwanted removal of the foot propulsion mechanism 500 from the interface 300. In some embodiments, the lock 450 is provided with a bias mechanism (not shown), for instance a coil spring or a torsion spring, to bias the lock 1450 toward the lock position.

FIG. 34 is also representative of a cross-section of the interface for any of the other embodiments described herein.

Figure 35:
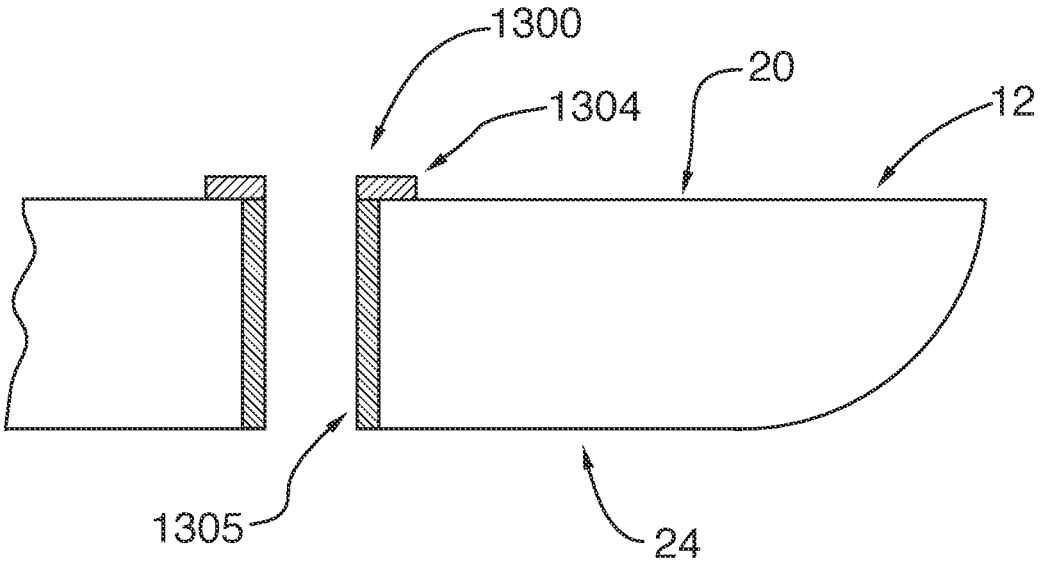
FIG. 35 is a schematic representation of an interface according to another embodiment.
Figure 36B:
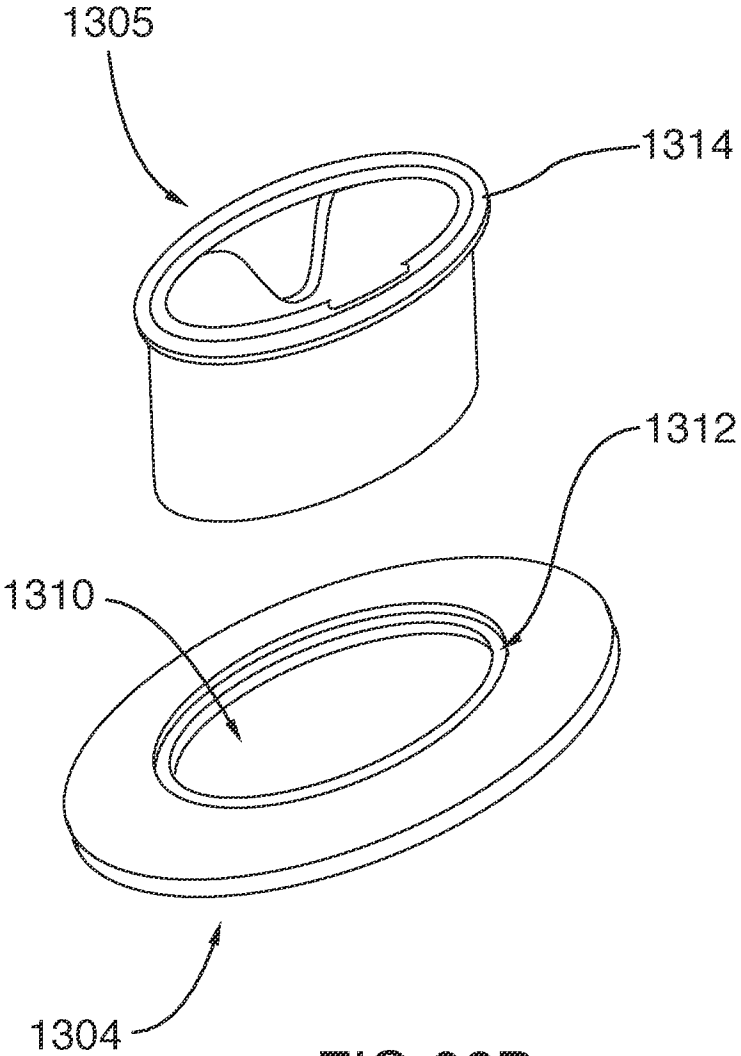
FIG. 36B is a top perspective view of the interface represented in FIG. 35, in accordance with an alternate embodiment.
Figure 36A:
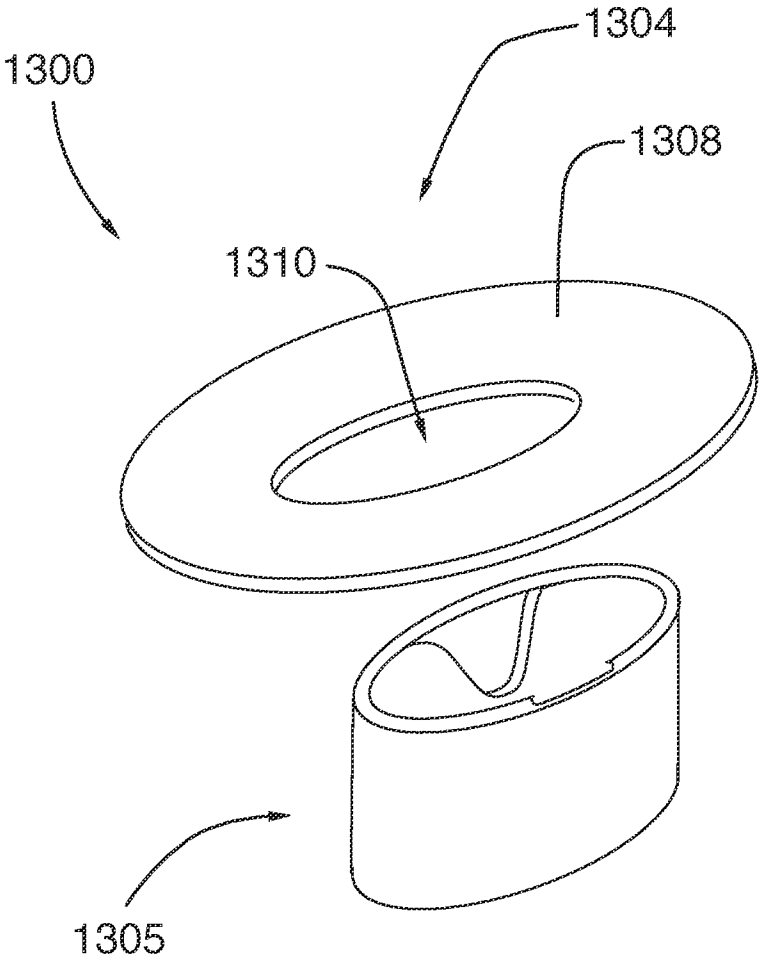
FIG. 36A is a top perspective view of the interface represented in FIG. 35 in accordance with some embodiments.
Figure 37:
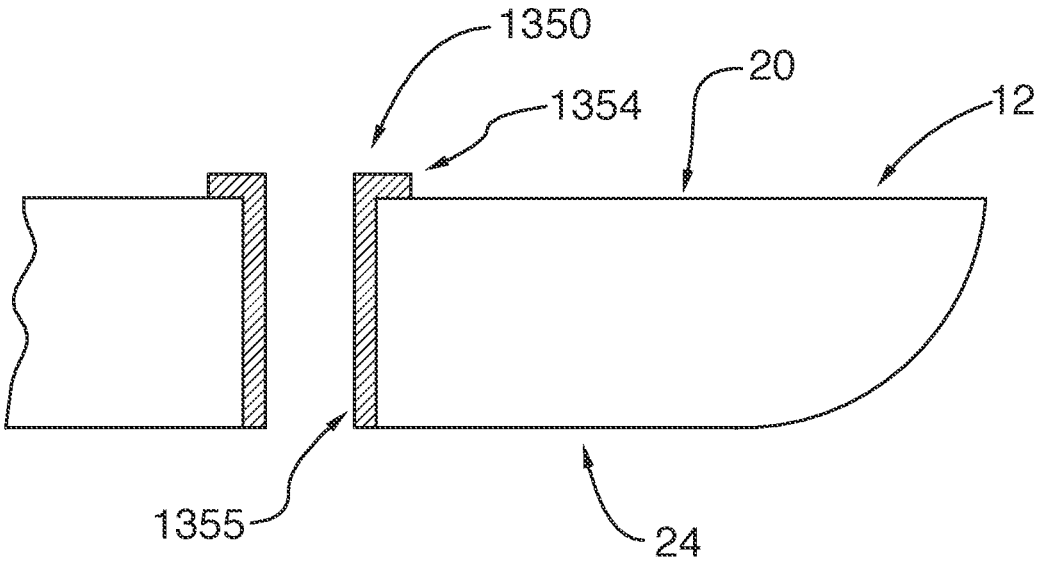
FIG. 37 is a schematic representation of an interface in accordance to an embodiment.

With reference to FIGS. 35, 36A, and 36B, an alternate embodiment of an interface 1300 will now be described. The interface 1300 can be used instead of interface 300 and comprises a channel portion 1305 configured to receive and support the foot propulsion mechanism 500. An optional top portion 1304 can be used to to cover/and or conceal the well 100 of the body 12, regardless of any manufacturing variations which may affect the thickness of the body 12 in this location.

More specifically, the top portion 1304 comprises a somewhat annular plate 1308 into which defines a hole 1310 sized and shaped for allowing the passage of the propulsion mechanism 500 therethrough. The optional annular plate 1308 is configured for resting on top of the deck 20, and for concealing the well 100 while allowing the passage of the propulsion mechanism 500, to be received in the channel portion 1305. The annular plate 1308 can be secured to the deck 20 of the kayak 10 using fasteners (e.g. threaded fasteners, rivets and the like), adhesive (e.g. glue, double-sided tape), plastic welded to the deck 20 or can simply rest atop the deck 20, without any particular fastener or securing means. The channel portion 1305 and/or the annular plate 1308 can also be snap- or friction-fit to the body. In some embodiments, the annular plate 1308 is integrally formed with the channel portion 1305.

With reference to FIG. 34, which is presented to illustrate some principles of the of the channel portion 1305 rather that all structures thereof, and using the same reference numerals that interface 300 but in the "1000" range, the channel portion 1305 also comprises a first V-shaped recess 1440, a second V-shaped recess 1442 terminating into a lower funnel-shape slot 1444, as well as a top funnel slot 1446 and a lock receiving recess 1448. At the bottom end 1403 of the channel portion 1305, the first V-shaped recess 1440 and the remainder of the channel portion 1305 are sized and shaped to generally conform to the periphery of the core support 514 of the foot propulsion mechanism 500, while the lower funnel-shaped slot 1444 is configured to receive left and right transverse projections 548*a*, 548*b* of the core support 514.

The top funnel slot 1446 is configured for receiving therein a mounting shaft 524 of the foot propulsion mechanism 500. Mounted in each of the lock receiving recesses 1448 is a lock 1450. In the illustrated embodiment, the lock

1450 comprises a generally elongated flat member 1452 including a convex lower end 1454 and a concave upper end 1456, the concave upper end 1456 being provided with grip elements 1458 for enhancing contact between a finger of a user and the lock 1450 for releasing the foot propulsion mechanism 500 from the channel portion 1305. Provided in an intermediate location between the upper end 1456 and the lower end 1454 is a hole (not shown) for receiving a fastener 1460 for pivotably mounting the lock 1450 in the lock receiving recess 1448 of the channel portion 1305. When properly assembled, the lock 1450 is pivotable between an unlock position for allowing the passage of the shaft (shown in dotted line in FIG. 34) and a lock position for preventing the passage of the mounting shaft 524 of the foot propulsion mechanism (shown in continuous line in FIG. 34) to thereby prevent unwanted removal of the foot propulsion mechanism 500 from the interface 1300. In some embodiments, the lock 1450 is provided with a bias mechanism (not shown), for instance a coil spring or a torsion spring, to bias the lock 1450 toward the lock position.

In this embodiment, the top portion 1304 (which include the annular plate 1308) and the channel portion 1305 are separate components. As it will be appreciated, they can be assembled to the body 12 of the kayak 10 either separately (e.g. the channel portion 1305 is mounted to the body 12 of the kayak 10, and then the top portion 1304 is mounted to the body 12 of the kayak 10, the channel portion 1305 and the top portion 1304 have little or no physical interactions with one another) or can be assembled together and then mounted to the body 12 of the kayak as an assembly (for instance, where, as shown in FIG. 15B the top portion 1304 comprises a recess 1312 surrounding the hole 1310 and the channel portion 1305 comprises a corresponding lip 1314, and the channel portion 1305 is engaged in the hole 1310 of the top portion 1304 and slid until the lip 1314 engages the recess 1312, with or without adhesive, sealing material fasteners and/or press fit engagement a between them).

In an alternate embodiment, in addition to the top portion 1304 and the channel portion 1305, the interface 1300 could be provided with a bottom portion (not shown in FIGS. 35 to 36B), to conceal the well 100 of the watercraft's body 12 at the keel or hull 24. The bottom portion can include its own bottom annular plate with a hole therein for receiving the propulsion mechanism therethrough. In some embodiments the bottom annular plate can be integrally formed with the channel.

In a further alternate embodiment, instead of being made from two discrete components (e.g. top portion 1304 and channel portion 1305 of interface 1300), the interface could include the same features integrally formed. For instance, with reference to FIGS. 16 and 17, there could be provided an interface 1350 including a top portion 1354 and a channel portion 1355 integrated to the top portion 1354.

Figure 39:
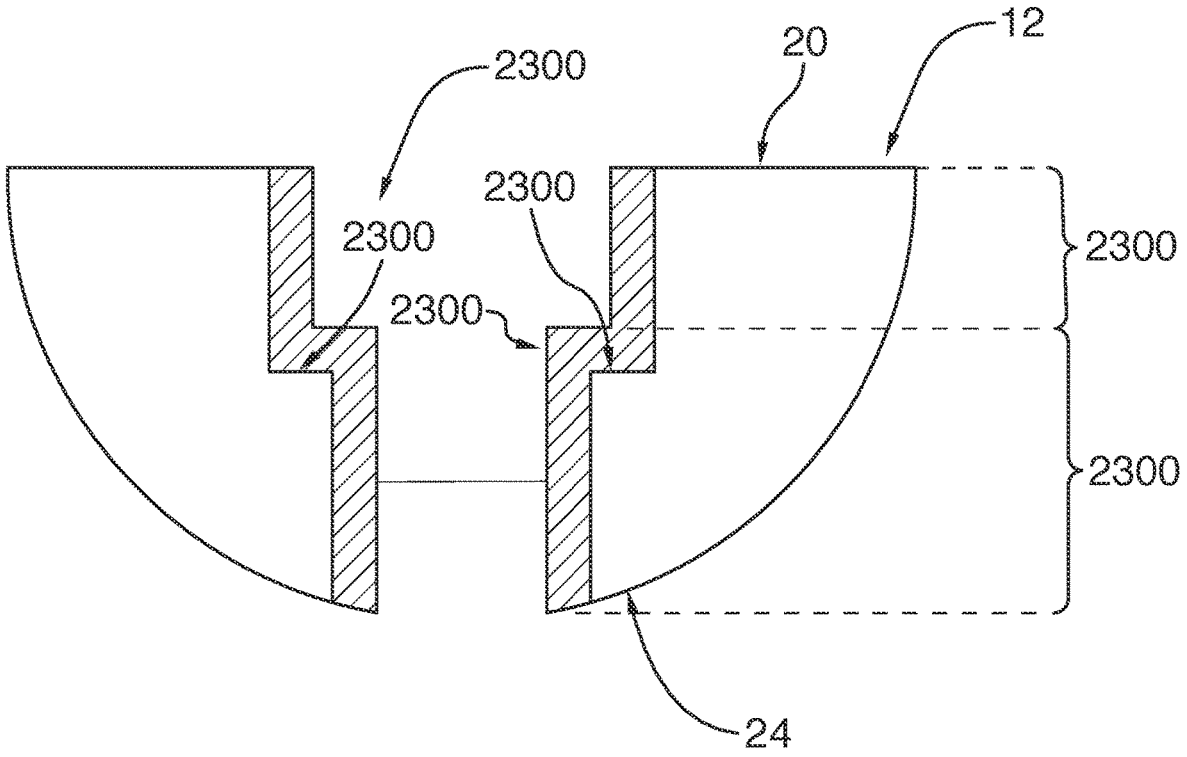
FIG. 39 is a schematic representation of an interface, in accordance with some embodiments.

While the interfaces 300 and 1300 have been described in connection with top portions 304, 1304 and 1354, and optionally bottom portions, it will be appreciated that such top and/or bottom portions could be omitted. For instance, and referring to FIG. 39, and interface 2300 devoid of top portion and bottom portion could be provided. In this embodiment, the interface 2300 would correspond essentially to the channel portion 1305 of the interface 1300, with some adaptation. For instance, and still referring to FIG. 39, the interface 2300 comprises a generally vertical lower portion 2302 and a generally vertical upper portion 2304 wider than the lower portion 2302, the lower and upper portions 2302, 2304 being joined together by a transverse resting portion 2306. In this embodiment, the body 12 of the kayak can be configured to include a seat portion 2308 onto which the transverse resting portion 2306 of the interface 2300 rests.

Much like the channel portion 1305 of the interface 1300, the interface 2300 comprises channels and/or retaining mechanism for mounting the prolusion mechanism to the interface 2300.

In other words, depending on the embodiment, the interface can have only the channel, the channel and a top plate, the channel and a bottom plate, or the channel with both the top and bottom plates, all of which can be separate components or integrally formed with one another.

While in the above embodiments, the interfaces 300, 1300, 1350 and 2300 were configured to be mounted to the body of the watercraft, an interface could instead be permanently or semi-permanently mounted to the propulsion mechanism (e.g. propulsion mechanism 500), and be configured to be removably mountable to the body of the watercraft (i.e. the propulsion mechanism and the interface are jointly positioned to and/or removed from the body of the watercraft).

Figure 40:
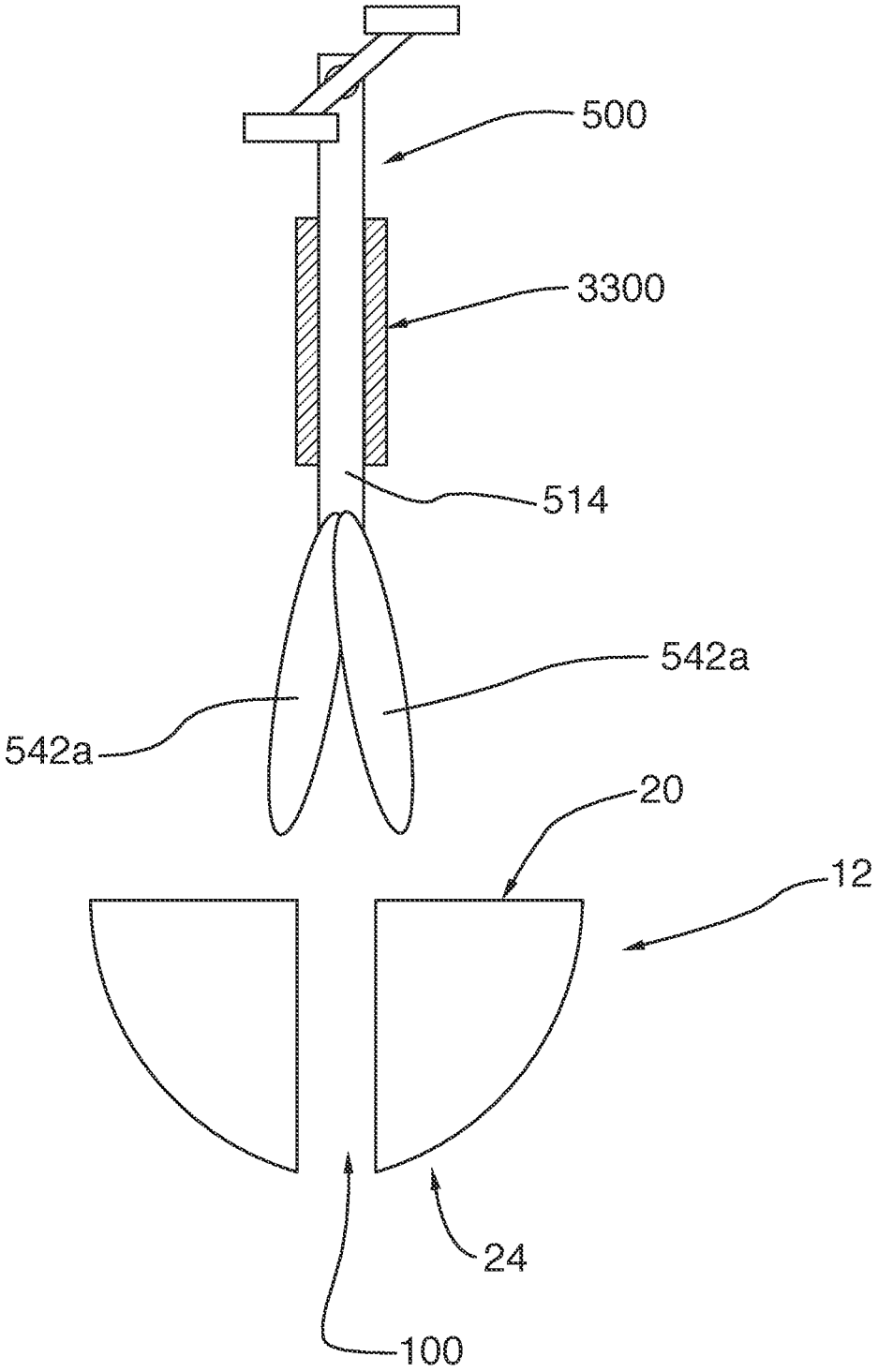
FIG. 40 is a schematic representation of an interface and propulsion mechanism, in accordance with some embodiments.
Figure 41:
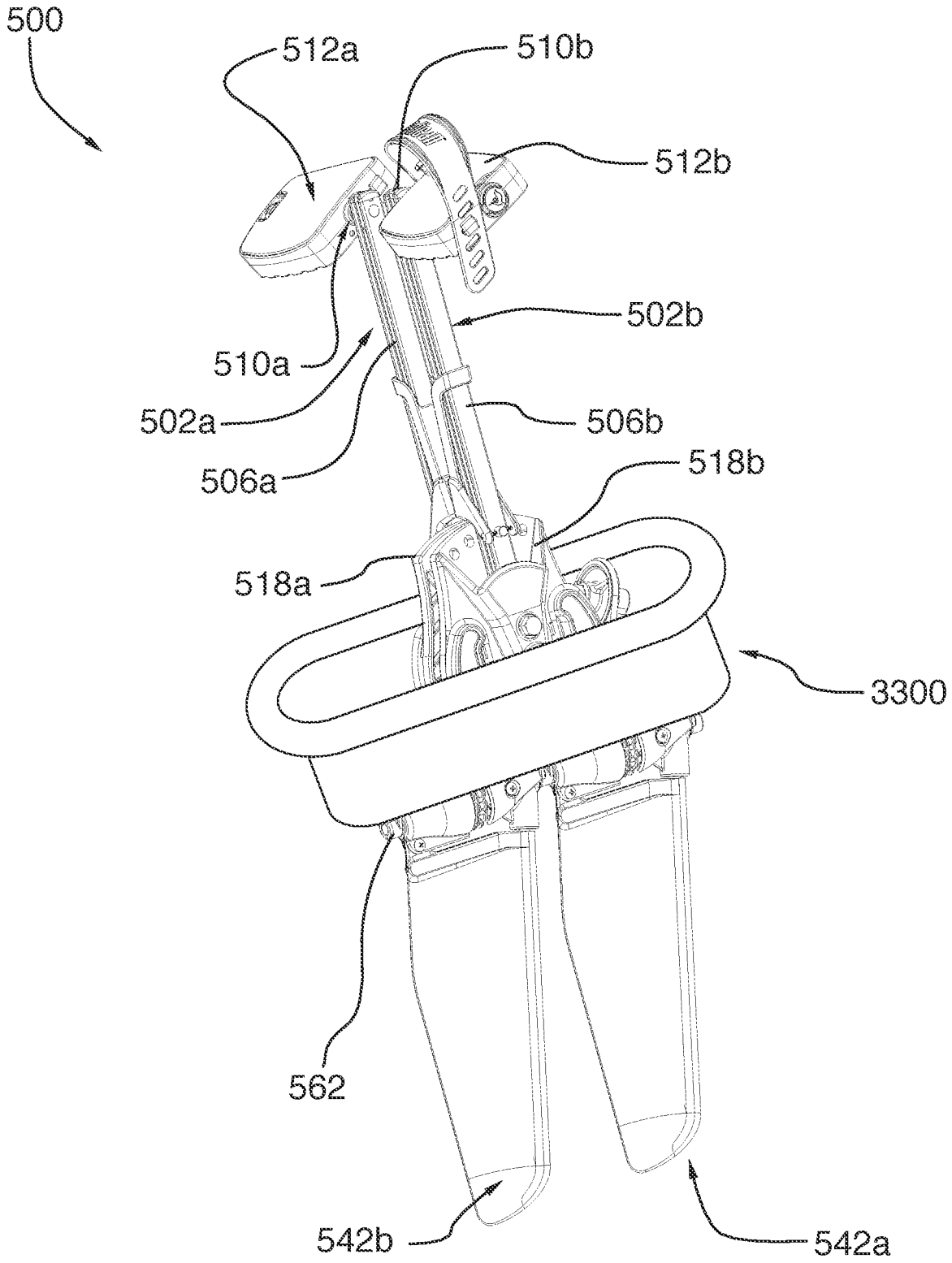
FIG. 41 is a perspective view of the interface and propulsion mechanism represented in FIG. 40, in accordance with some embodiments.

For instance, and referring to FIGS. 40 and 41, the foot propulsion mechanism 500 secured to an alternate embodiment of an interface 3300 is shown. In the illustrated embodiment, the foot propulsion mechanism 500 is an oscillating flapper propulsion system and comprises a set of left and right pedals 502*a* and 502*b* extending upwardly from the top portion 304 of the interface 3300 when the foot propulsion mechanism 500 is properly mounted thereto. The pedals 502*a*, 502*b* are operatively mounted to a pair of oscillating, flexible flappers 542*a*, 542*b* via a cable and chain transmission supported on a core support 514.

More specifically, the pedals 502*a*, 502*b* are adapted to be alternatively pushed by the user's feet to actuate the foot propulsion mechanism 500. Each of the left and right pedals 502*a*, 502*b* comprises a shaft 506*a*, 506*b* including a lower end and an upper end 510*a*, 510*b*, as well as a footrest 512*a*, 512*b* for receiving one corresponding foot of the user. The lower ends 508*a*, 508*b* of the shafts 506*a*, 506*b* are mounted to the core support 514, which is configured to extend longitudinally (i.e. along the longitudinal axis $L_1$-$L_1$ of the kayak 10 when the propulsion mechanism 500 is mounted to the interface 300), via a pair of mounting brackets 518*a*, 518*b*. Each mounting bracket 518*a*, 518*b* allow adjustment of the distance between the footrests 512*a*, 512*b* and the seat 28 by way of an adjustment bolt engaging the lower ends of the shafts 506*a*, 506*b* and a plurality of adjustment holes disposed on the mounting brackets 518*a*, 518*b*. The mounting brackets 518*a*, 518*b* are also configured for receiving a mounting shaft extending transverse to the longitudinal axis $L_1$-$L_1$ and engaging the core support 514. The mounting shaft allow rotation of the left and right pedals 502*a*,502*b* relative to the core support 514, about a rotation axis $R_1$-$R_1$.

The foot propulsion mechanism 500 also comprises the flexible flappers 542*a*, 542*b* each adapted to oscillate through an arcuate path in a generally transverse direction with respect to the longitudinal axis $L_1$-$L_1$, about a rotation axis $R_2$-$R_2$ which is at or below the bottom of the hull 24 of the kayak 10 when the propulsion mechanism 500 is mounted to the interface 3300. More specifically, the flexible flappers 542*a*, 542*b* are carried by a shaft 562 extending generally longitudinally and rotatably mounted to the core support 514 via the three flapper mounting brackets. The flappers 542*a*, 542*b* are operatively coupled to the mounting brackets 518*a*, 518*b* of the pedals 502*a*, 502*b* via the cable and chain transmission, which include a pulley mounted to the pulley mounting brackets, chains engaging sprockets (not shown) mounted to the shaft 562 and cables connecting the chains to the mounting brackets 518*a*, 518*b*. While in the illustrated embodiment the propulsion system 500 is a foot propulsion system, it will be understood that it could also be operated by hand.

In this embodiment, the interface 3300 is mounted to the core support 514 of the propulsion mechanism, and allow movement of the pedals 502*a*, 502*b* and of the flappers 542*a*, 542*b*, as well as the positioning of the propulsion mechanism 500 in the well. To prevent unwanted movement relative to the body of the watercraft, or unwanted removal of the interface 3300 from the body of the watercraft, the interface 3300 can be provided with manually operable fasteners (e.g. knobs, clamps) or snap mechanisms coupled to pull-out tabs.

Figure 38:
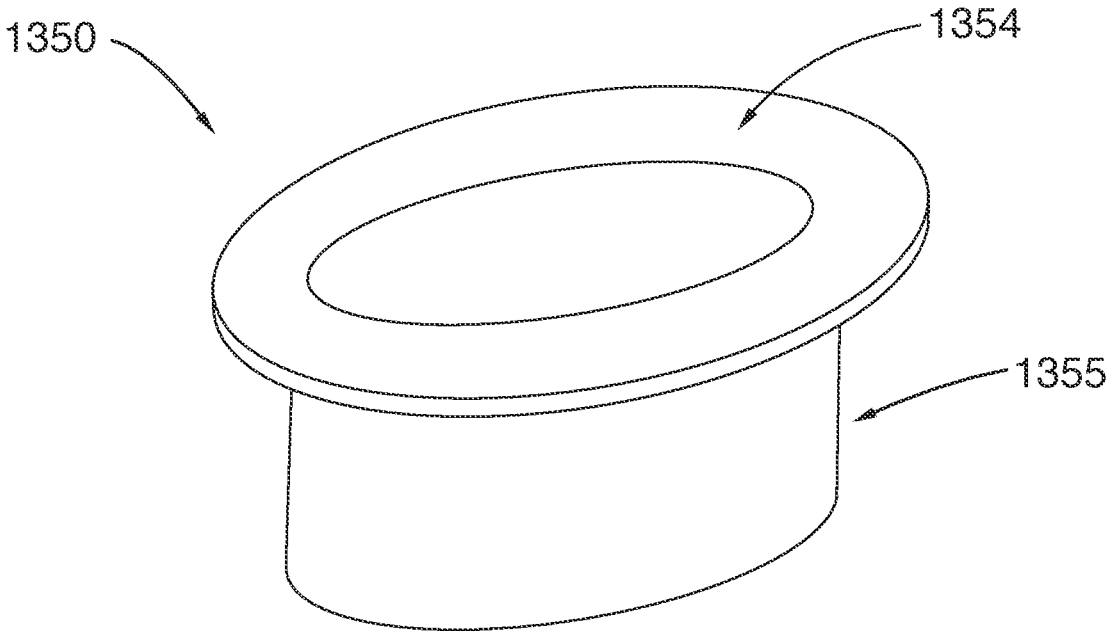
FIG. 38 is a top perspective view of the interface represented in FIG. 337.
Figure 42:
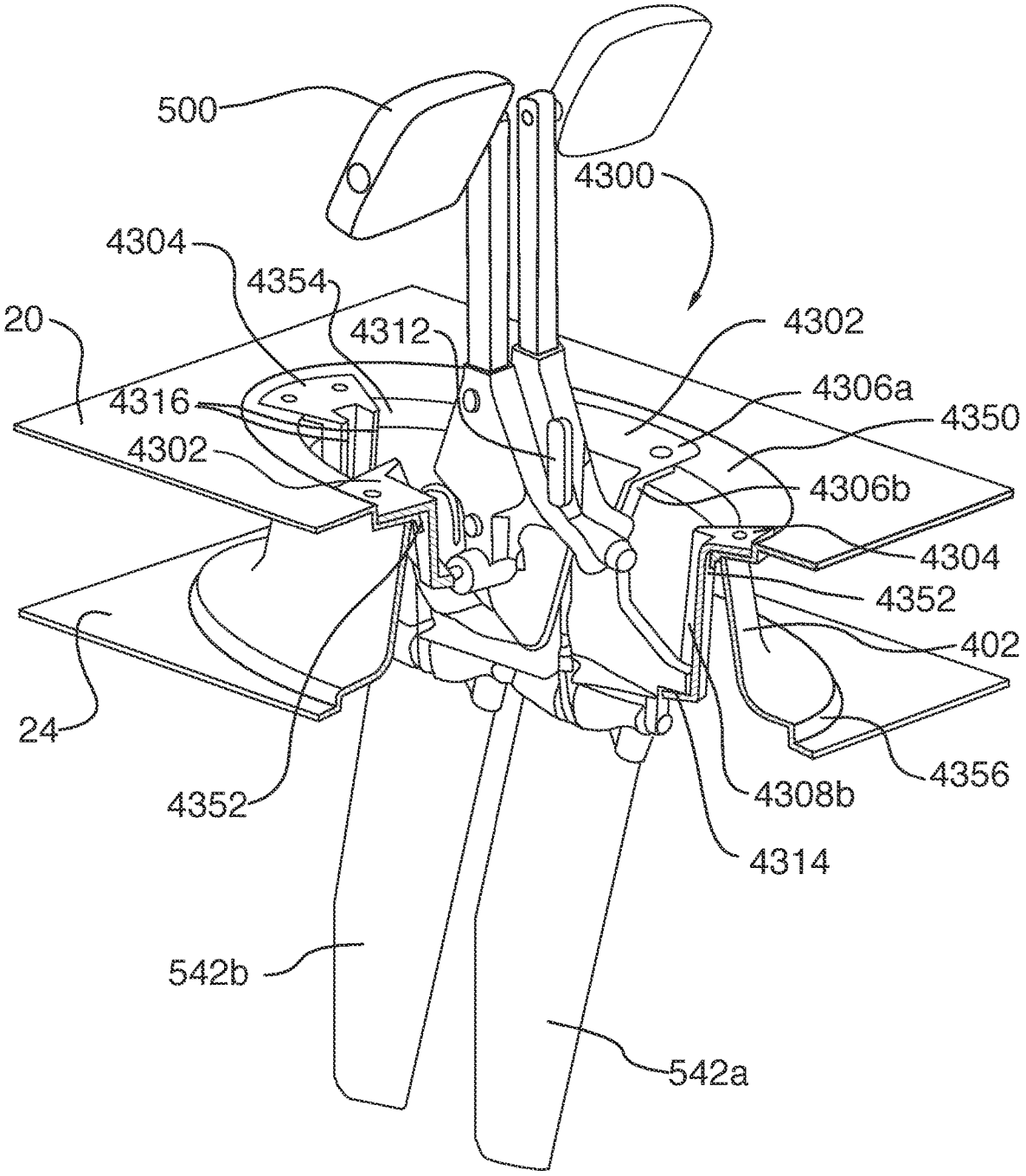
FIG. 42 is a perspective view of an interface and propulsion mechanism, in accordance with some embodiments.

In addition to interfaces 300, 1300, 1350, 2300, and 3300 that substantially surround or circumscribe an opening of the channel 402 in the body 12 of the kayak 10 when mounted to the kayak 10, FIG. 42 shows embodiments in which an interface 4300 is formed by separate mounting components that engage only portions of the channel 402. The interface 4300 engages directed with the body 12 of the kayak 10, as shown in FIG. 42. In some embodiments, the interface 4300 engages with a second interface similar to the interface 1350 shown in FIG. 38 and connects to the body 12 of the kayak 10 via the interface 1350.

FIG. 42 shows the propulsion mechanism 500 secured via the interface 4300 to the channel 402 of the kayak 10. The interface 4300 includes a first group of mounting brackets 4302 and a second group of mounting brackets 4304. In some embodiments, the mounting brackets 4302 are larger than the mounting brackets 4304. The larger mounting brackets 4302 are positioned to extend substantially parallel to a longer dimension (e.g., a major axis) of the oval-shaped opening 4354. The smaller mounting brackets 4304 are positioned to extend substantially perpendicular to the longer dimension (e.g., a major axis) of the oval-shaped opening. The mounting bracket 4304 on the right side of the FIG. 42 shows a cross-sectional view of the mounting bracket 4304 on the left side of the FIG. 42, and both mounting brackets 4304 have the same size. The mounting bracket 4302 on the left side of the FIG. 42 shows a cross-sectional view of the mounting bracket 4302 on the right side of the FIG. 42, and both mounting brackets 4302 have the same size.

In some embodiments, the same mounting brackets may be used (i.e., all four mounting brackets are the same). In some embodiments, different mounting brackets may be used (e.g., four mounting brackets of different sizes and/or designs). In some embodiments, different numbers of mounting brackets may be used (e.g., two, three, five, six, seven, or eight, etc.). In some embodiments, the mounting brackets 4302 and 4304 allow adjustment in the placement of the propulsion mechanism 500 within the opening 4354.

The mounting brackets 4302 have two portions 4306*a* and 4306*b* arranged perpendicularly in an L-shape configuration. The mounting bracket 4304 has two portions 4308*a* and 4308*b* arranged perpendicularly in an L-shape configuration. The portion 4306*a* (and 4308*a*) is mechanically engaged to a top recessed portion 4350 of the opening of the channel. In some embodiments, as shown in FIG. 42, the recessed portion 4350 is defined in the deck 20. Similarly, a corresponding rim 4356 is also defined in the hull 24. The rim 4356 is connected to the channel 402, which is formed by a wall that extends from an edge of the recessed portion 4350 to the rim 4356. A lip extension 4352 of the recessed portion 4350 provides frictional and tensional engagement for the mounting brackets 4302 and 4304 to snap on. For example, tension from the lip extension 4352 pushes on the second portion 4306*b* of the mounting bracket 4302 to retain the mounting bracket 4304 in the opening 4354. Additional fasteners (e.g., threaded screws, knobs, clamps, snap fasteners etc.) can be provided via openings 4310 (e.g., threaded openings) to further secure the mounting bracket to the opening 4354.

In some embodiments, the second portion 4306*b* of the mounting bracket 4302 is secured to the propulsion mechanism 500 via a fastener 4312. The portion 4308*b* of the mounting bracket 4304 includes a protrusion 4314 on which a portion of the propulsion mechanism 500 rests. In some embodiments, the protrusion 4314 is a bottom wall connected to side walls 4316 of the portion 4308*b*. A portion of the propulsion mechanism 500 slides into a channel formed by the side walls 4316 and rests on the protrusion 4314 that forms the bottom wall of the channel.

Figure 43:
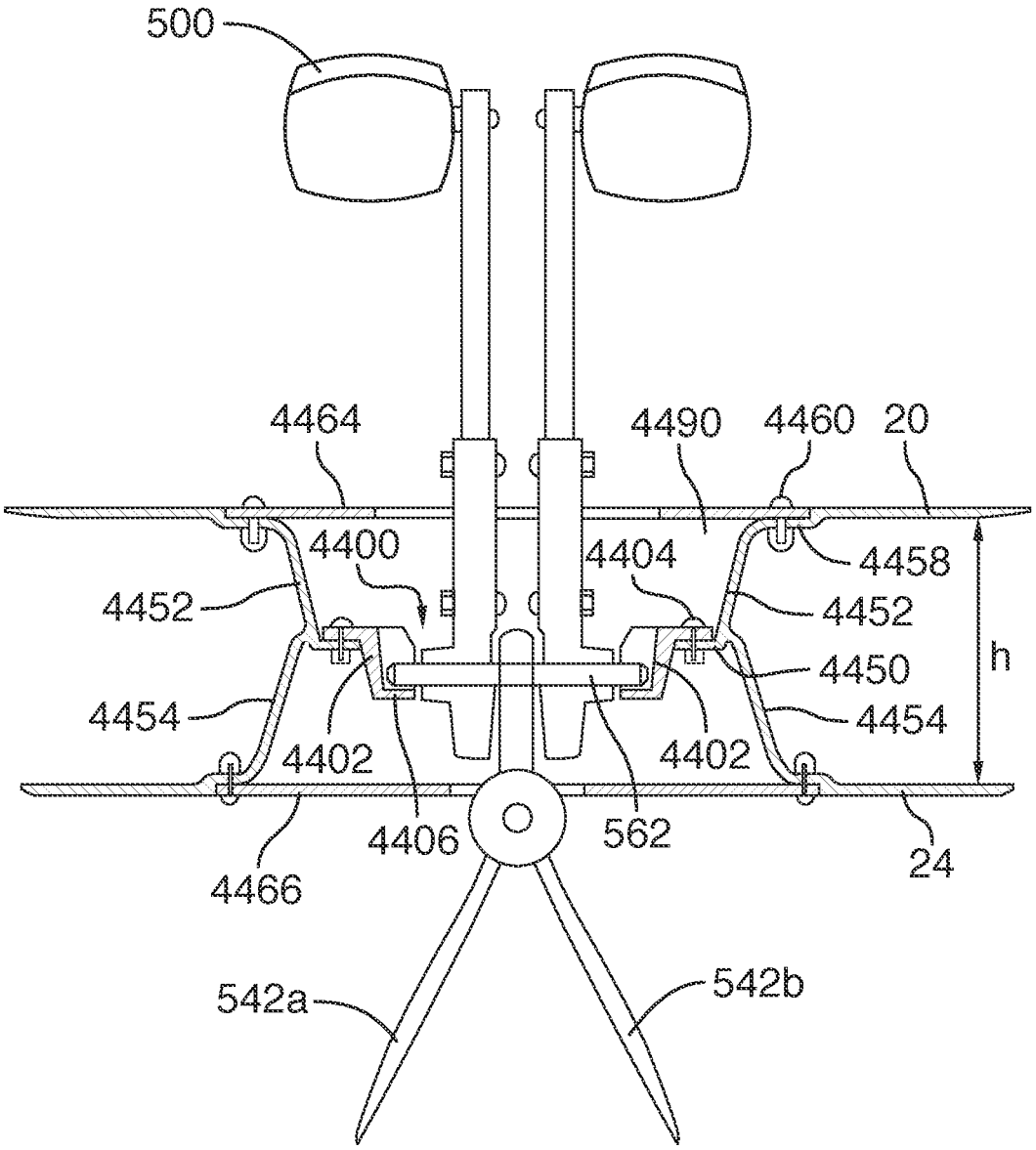
FIG. 43 is a cross-section view of an interface and propulsion mechanism, in accordance with some embodiments.

FIG. 43 shows an interface 4400 that includes two mounting brackets 4402. Each of the mounting bracket 4402 is fastened by a fastener 4404 to a joined portion 4450. One end of the joined portion 4450 connects a top sidewall 4452 and a bottom sidewall 4454. The top sidewall 4452 extends from a top plane of the deck 20 and the bottom sidewall 4454 extends from the hull 24, and the sidewalls 4452 and 4454 meet to form the joined portion 4450.

The sidewalls 4452 and 4454 jointly form a well 4490 between the deck 20 and the hull 24. A (top) cover 4464 is positioned over an opening of the well 4490 and secured to a step 4458 of the deck 20 via a fastener 4460. A (bottom) cover 4466 is also positioned over an opening of the well 4490 and secured to a step of the hull 24 via a fastener. The mounting bracket 4402 includes a lower protrusion 4406 that supports a portion of the propulsion mechanism 500. For example, the shaft 562 of the propulsion mechanism 500 can rest of on the lower protrusion 4406. A top portion 4408 of the mounting bracket 4402 rests on the joined portion 4450 and allows the fastener 4404 to connect to the body 12 of the kayak 10.

FIG. 43 shows an interface 4400 that includes two mounting brackets 4402. Each of the mounting bracket 4402 is fastened by a fastener 4404 to a joined portion 4450. One end of the joined portion 4450 connects a top sidewall 4452 and a bottom sidewall 4454. The top sidewall 4452 extends from the deck 20 and the bottom sidewall 4454 extends from the hull 24, and the sidewalls 4452 and 4454 meet to form the joined portion 4450.

The sidewalls 4452 and 4454 jointly form a well 4490 between the deck 20 and the hull 24. A (top) cover 4464 is positioned over an opening of the well 4490 and secured to a step 4458 of the deck 20 via a fastener 4460. A (bottom) cover 4466 is also positioned over an opening of the well 4490 and secured to a step of the hull 24 via a fastener. The mounting bracket 4402 includes a lower protrusion 4406 that supports a portion of the propulsion mechanism 500. For example, the shaft 562 of the propulsion mechanism 500 can rest of on the lower protrusion 4406. A top portion 4408 of the mounting bracket 4402 rests on the joined portion 4450 and allows the fastener 4404 to connect to the body 12 of the kayak 10.

Figure 15:
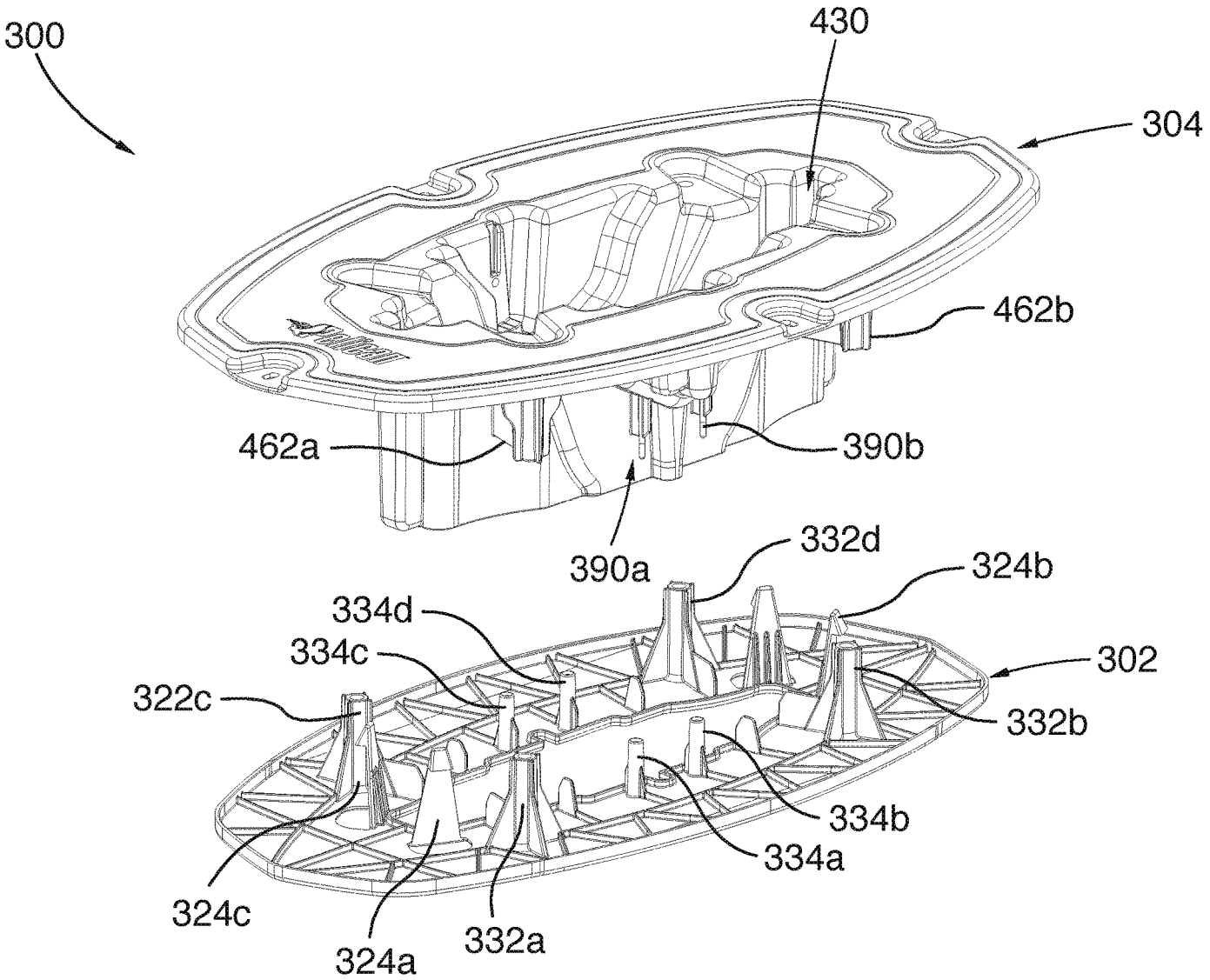
FIG. 15 is an exploded view of the interface shown in FIG. 13.
Figure 44:
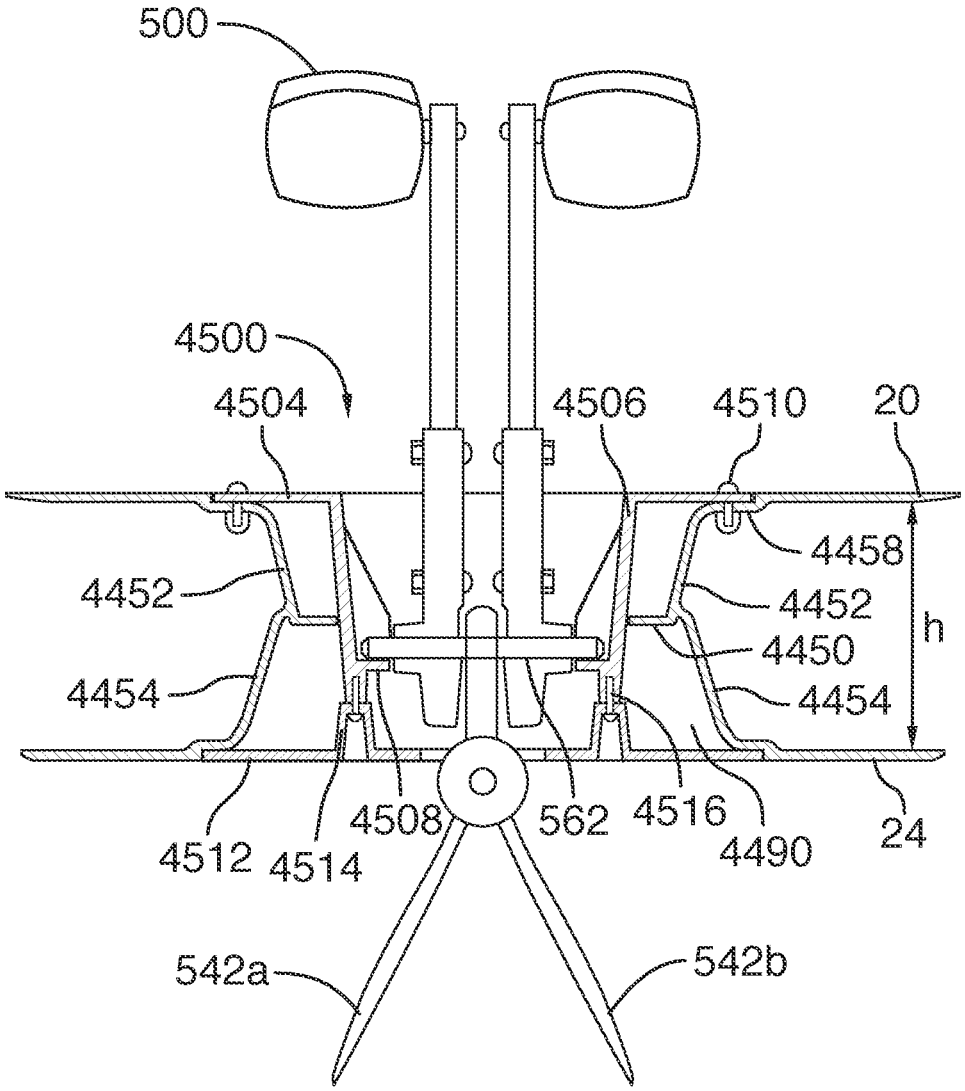
FIG. 44 is a cross-section view of an interface and propulsion mechanism, in accordance with some embodiments.
Figure 45:
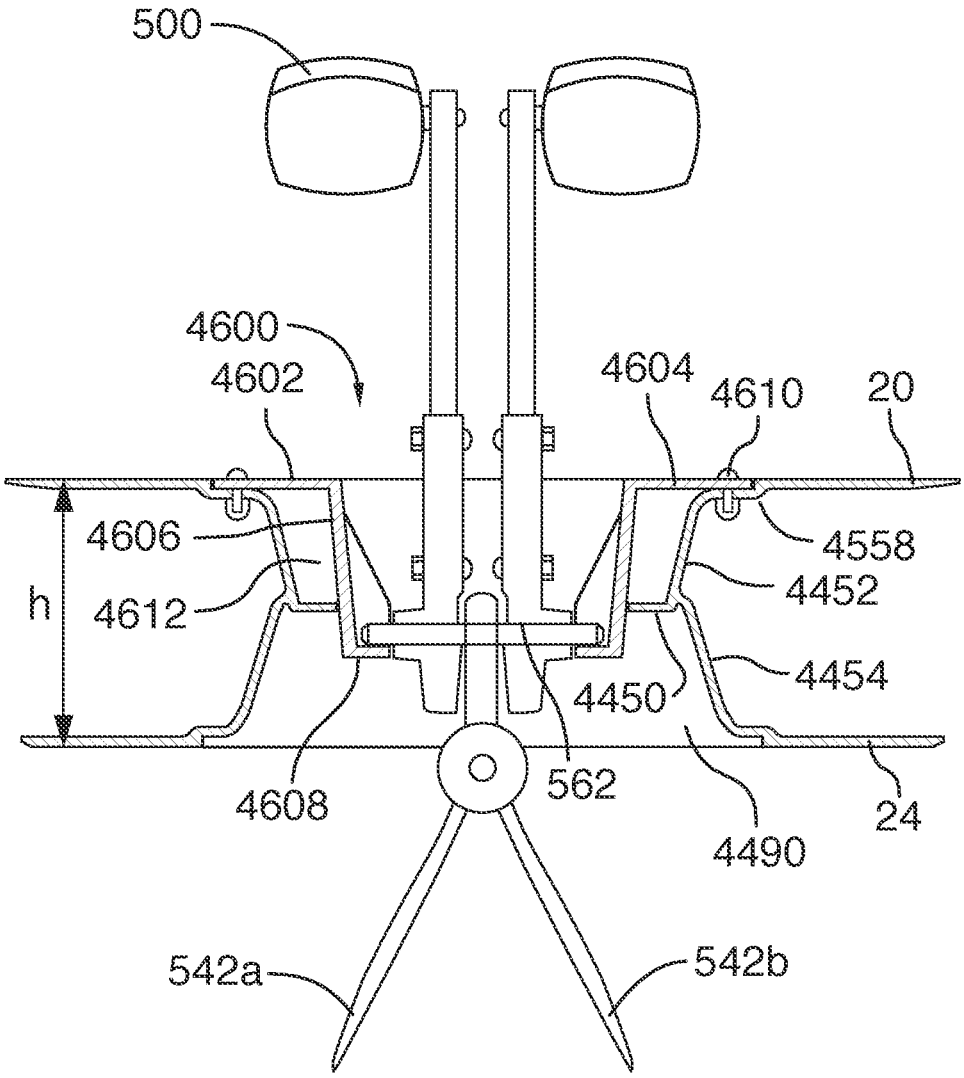
FIG. 45 is a cross-section view of an interface and propulsion mechanism, in accordance with some embodiments.

FIG. 44 shows an interface 4500 that includes two mounting brackets 4502. In some embodiments, as shown in FIG. 45, instead of two (or more) mounting brackets 4502, an interface 4600 is formed by a single mounting bracket 4602 that surrounds substantially the entire opening of the well 4490, similar to embodiments described in U.S. Pat. No. 10,829,189, issued on Nov. 10, 2020, entitled "Interface for Mounting a Propulsion Mechanism to a Watercraft," which is hereby incorporated by reference in its entirety. FIG. 15 of U.S. Pat. No. 10,829,189, incorporated herein in its entirety, shows an interface 300 formed of a top portion 304 and a bottom section 302 that surround substantially the entire perimeter of an opening that defines a well in the body of the kayak, similar to an interface 4800 shown in FIG. 47.

In some embodiments shown in FIG. 44, the mounting bracket 4502 includes a portion 4504 along a top plane of the deck 20, and a wall portion 4506 that includes a protrusion 4508. The protrusion 4508 supports a portion of the propulsion mechanism 500. For example, the shaft 562 rests on the protrusion 4508. Each of the mounting bracket 4602 is fastened by a fastener 4510 to a step 4558 extending form the deck 20.

A bottom mounting bracket 4512 includes a protrusion 4514 having a channel that allows a fastener 4516 to secure the bottom mounting bracket 4512 to the mounting bracket 4502. Instead of individual mounting brackets 4512 as shown in FIG. 44, an integral bottom portion 302 shown in FIG. 15 of U.S. Pat. No. 10,829,189 may be used.

FIG. 45 shows an interface 4600 formed by a single mounting bracket 4602 that surrounds substantially the entire opening of the well 4490, similar to the top portion 304 shown in FIG. 15 of U.S. Pat. No. 10,829,189. The interface 4600 does not include a bottom mounting bracket or an integral bottom portion 302. The mounting bracket 4602 includes a portion 4604 in a surface plane of the deck 20, and a wall portion 4606 that includes a protrusion 4608. The protrusion 4608 supports a portion of the propulsion mechanism 500. For example, the shaft 562 rests on the protrusion 4608. The mounting bracket 4602 is fastened by a fastener 4610 to a step 4558 extending form the deck 20.

The mounting bracket 4602 includes additional protrusions that fit a profile of the top sidewall 4452 and joined portion 4450. The additional protrusions provide more frictional contact between the single mounting bracket 4602 and the deck 20.

Figure 46:
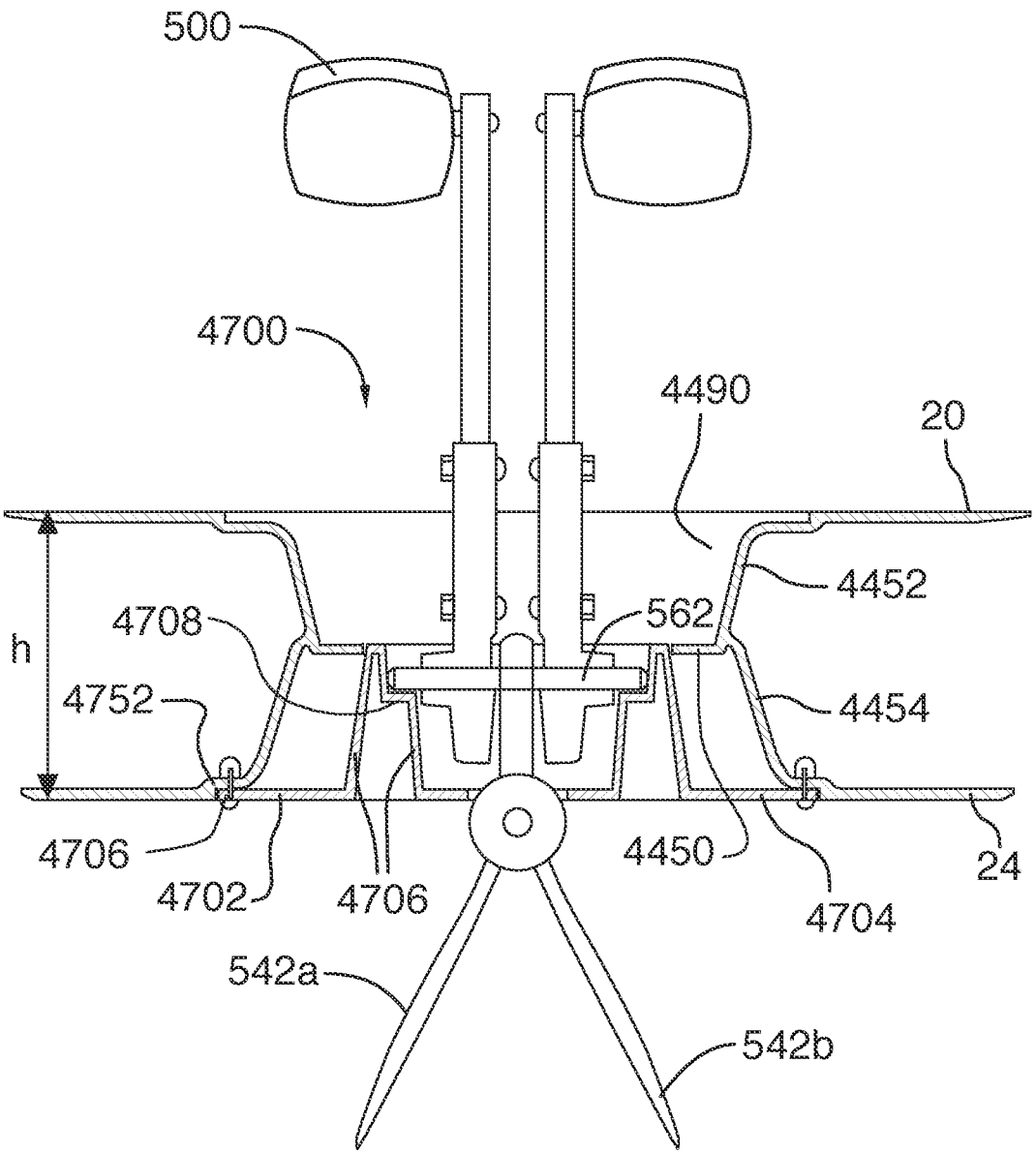
FIG. 46 is a cross-section view of an interface and propulsion mechanism, in accordance with some embodiments.

FIG. 46 shows an interface 4700 formed by a single mounting bracket 4702 that surrounds substantially the entire bottom opening of the well 4490, similar to the bottom portion 302 shown in FIG. 15 of U.S. Pat. No. 10,829,189. The interface 4700 does not include a top mounting bracket or an integral top portion 304. The mounting bracket 4702 includes a portion 4704 along a bottom plane of the hull 24, and two side walls 4706 that includes a ledge 4708. The ledge 4708 supports a portion of the propulsion mechanism 500. For example, the shaft 562 rests on the ledge 4708. The mounting bracket 4702 is fastened by a fastener 4710 to a portion 4752 extending from the hull 24 to secure the interface 4700 to the body 12 of the kayak 10.

Figure 47:
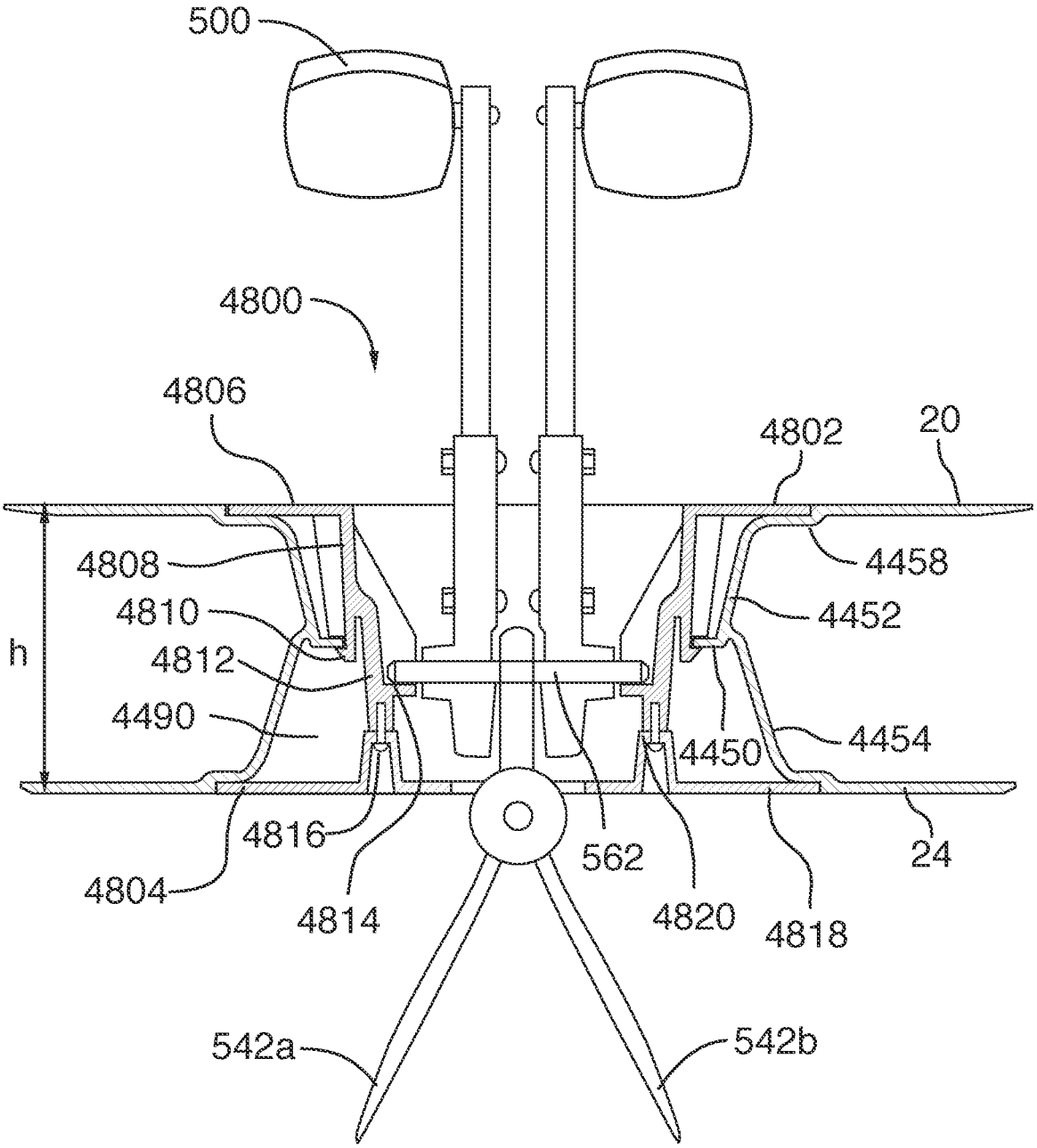
FIG. 47 is a cross-section view of an interface and propulsion mechanism, in accordance with some embodiments.

FIG. 47 shows an interface 4800 formed by a top mounting portion 4802 that surrounds substantially the entire top opening of the well 4490, similar to the top portion 304 shown in FIG. 15 of U.S. Pat. No. 10,829,189. The top mounting portion 4802 includes a portion 4806 in a top plane of the deck 20, and a wall portion 4808 that includes a hook-shaped protrusion 4810 that allows the top mounting portion 4802 to be frictionally engaged (e.g., by snap mechanisms or snap fasteners) to the joined portion 4450. The top mounting portion 4802 includes a second sidewall 4812, and a second protrusion 4814. The second protrusion 4814 supports a portion of the propulsion mechanism 500. For example, the shaft 562 rests on the second protrusion 4814. The top mounting portion 4802 is fastened by a fastener 4816 to a bottom mounting portion 4804 of the interface 4800.

The bottom mounting portion 4804 includes a portion 4818 and a raised portion 4820 that lines up with the second sidewall 4812 of the top mounting portion 4802. The raised portion 4820 is configured to receive the fastener 4816. The interface 4800 is fastened to the body 12 of the kayak 10 through the hook-shaped protrusion 4810.

Figure 48:
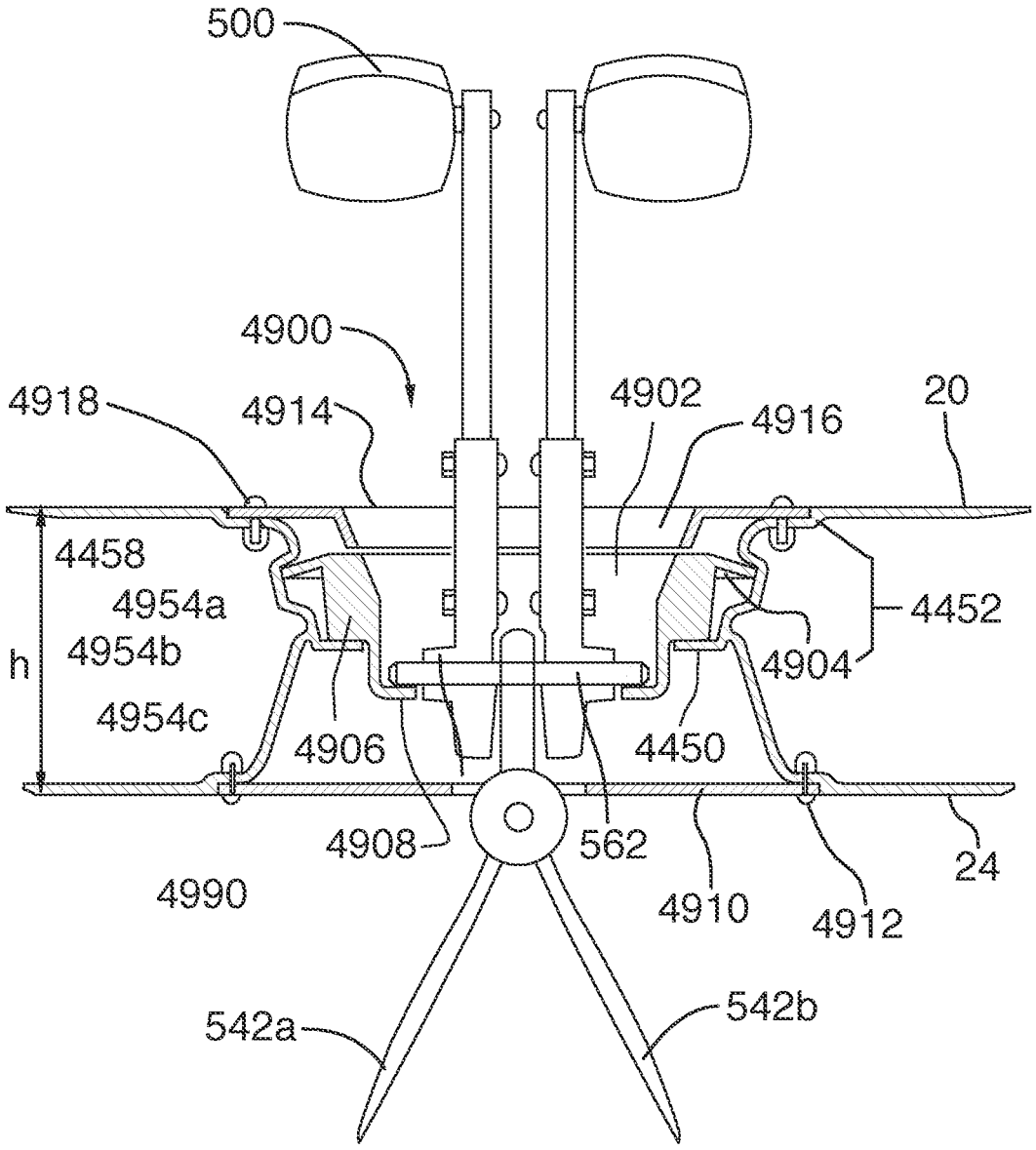
FIG. 48 is a cross-section view of an interface and propulsion mechanism, in accordance with some embodiments.

FIG. 48 shows an interface 4900 for a well that has a different cross-sectional profile compared to the wells shown in FIGS. 43-47. Instead of a top sidewall 4452, a sidewall 4952 includes a first notch 4954*a*, a first receptacle 4954*b*, and a second notch 4954*c*. The interface 4900 does not use any external fasteners, relying on snap mechanisms or snap fasteners integrated in the top mounting portion 4902. The top mounting portion 4902 includes a protrusion 4904 extending along a top surface of the top mounting portion 4902. The top surface of the top mounting portion 4902 is offset from a plane of the deck 20. The top surface is closer, along a height dimension, to the shaft 562 of the propulsion mechanism 500 than a plane of the deck 20. The protrusion 4904 fits snugly into the first receptacle 4954*b* to provide mechanical (e.g., frictional) engagement between the interface 4900 and the body 12 of the kayak 10. A second edge 4906 of the top mounting portion 4902 rests on a joined portion 4450 of the well 4990. A ledge 4908 of the top mounting portion 4902 extends below the joined portion 4450 and supports a portion of the propulsion mechanism 500. For example, the shaft 562 rests on the ledge 4908.

A bottom plate 4910 is positioned over a bottom opening of the well 4990 and secured to a step of the hull 24 via a fastener 4912. A top cover 4914 is positioned over a top opening of the well 4990 and secured to a step 4458 of the deck 20 via a fastener 4918. Instead of a flat plate like the bottom plate 4910, the top cover 4914 includes a protrusion 4916 having a tapering width along a height dimension. Other profiles of the top cover may be adopted. The top cover 4914 can enhance the aesthetics of the interface 4900 by providing a flat/covered portion to the well 4990 that conceals a portion of the propulsion mechanism 500.

Figure 49:
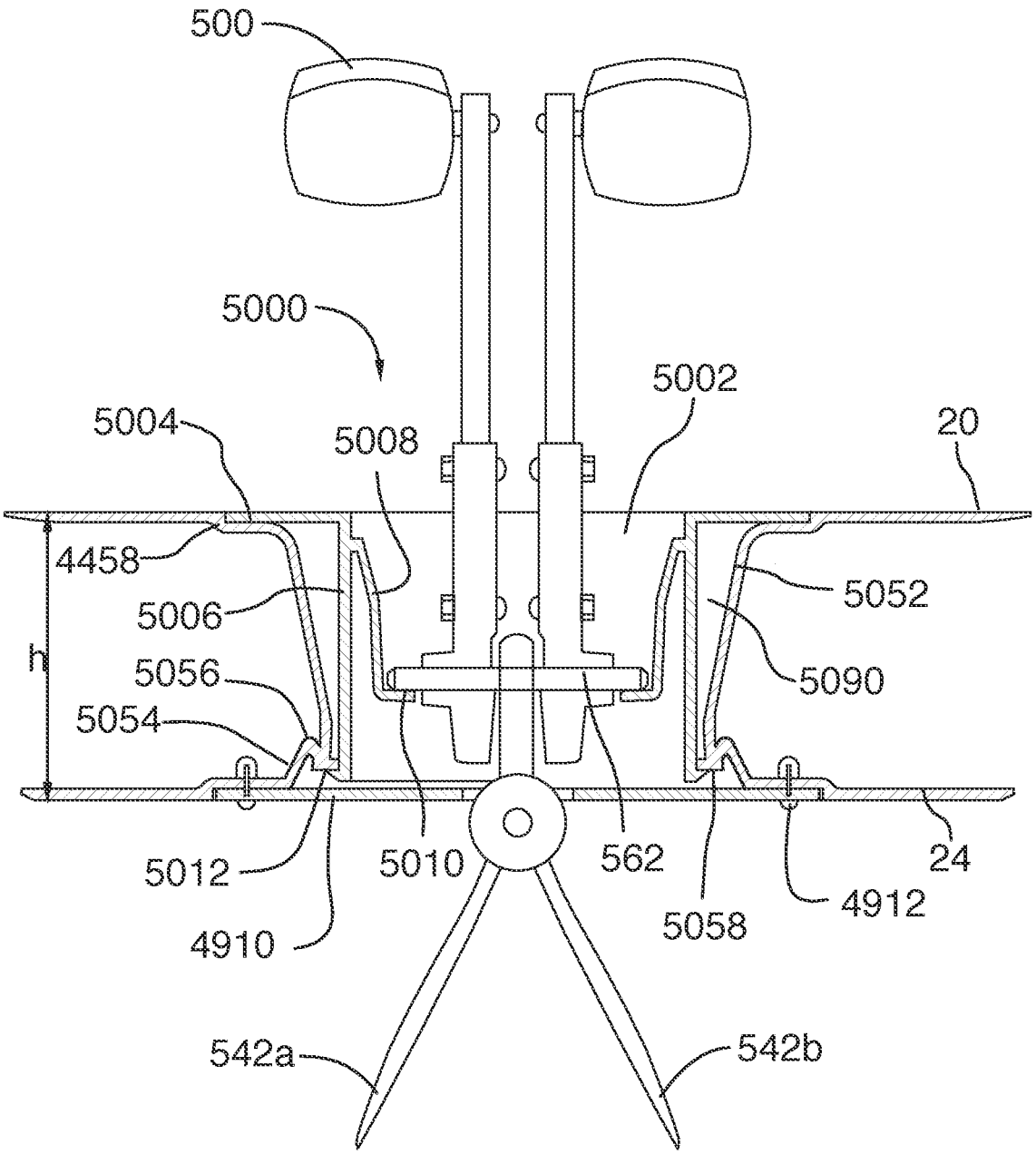
FIG. 49 is a cross-section view of an interface and propulsion mechanism, in accordance with some embodiments.

FIG. 49 shows an interface 5000 for a well 5090 that has a different profile compared to the well shown in FIGS. 43-48. Similar to the interface 4900, the interface 5000 also does not use any external fasteners, replying on snap mechanisms or snap fasteners integrated in a top mounting portion 5002. Instead of a top sidewall 4452, an elongated top sidewall 5052 extends along a substantial portion (e.g., more than 50%, more than 60%, more than 70%, more than 80%, more than 90%, less than 99%) of a height h between the deck 20 and the hull 24. A tapering profile of channel 5090 formed by the sloping sidewalls 5052 may increase the ease for placing the interface 5000 into the channel 5090. A shortened bottom sidewall 5054 includes an arched portion 5056 that joins together with the elongated top sidewall 5052 to form a joined portion 5058.

The top mounting portion 5002 includes a portion 5004 along a top surface of the deck 20, and rest on the step 4458 of the deck 20. The top mounting portion 5002 includes a first sidewall 5006 and a second sidewall 5008. The second sidewall 5008 includes a ledge 5010 that supports a portion of the propulsion mechanism 500. For example, the shaft 562 rests on the ledge 5010. The first sidewall 5006 includes a hook-shaped protrusion 5012 that allows the top mounting portion 5002 to be frictionally engaged (e.g., by snap mechanisms or snap fasteners) to the joined portion 5058. The hook-shaped protrusion 5012 fits snugly under the joined portion 5058 to provide mechanical (e.g., frictional) engagement between the interface 5000 and the body 12 of the kayak 10. The arched portion 5056 may enhance a mechanical strength of the channel and better secure the interface 5000 to the body 12 of the kayak 10.

A bottom plate 4910 is positioned over a bottom opening of the well 5090 and secured to a step of the hull 24 via a fastener 4912.

Having described the general components of the kayak 10 and of the interfaces 300, 1300, 1350, 2300 and 3300, their assembly will now be described. The body 12 of the kayak 10 may be manufactured using any suitable process, including without being limited to, thermoforming processes, blowmolding processes and rotomolding process. In a specific practical implementation, the body 12 of the kayak 10 may be manufactured by molding two sheets of extrudable material using a thermoforming process to shape the two manufactured sheets into a kayak shape of the type described in the present document, one sheet being used for the top side (i.e. the deck 20) and the other for the bottom side (i.e. the hull 24) of the kayak 10. Examples of the different types of thermoplastics that can be extruded include: LDPE, HDPE, ABS, polystyrene, polypropylene, acetates, butyrates, nylons, polyphenylene sulfides, acetals, polycarbonates and thermoplastic rubbers and polyesters, among other possibilities. As it will be appreciated, the well 100 of the kayak 10 may be closed when the deck 20 and hull 24 emerged from the mold after welding. As such, the manufacturing of the kayak 10 may require an opening to be defined in the well post-molding. Typically, such an opening will be carried out by a worker using a cutting tool such as a rotary saw. As it will be understood, the shape of the well (i.e. a generally oblong shape) greatly simplify the cutting of the opening as compared to a more complex hole shape, thereby facilitating the manufacturing of the kayak 10.

The interface 300, 1300 or 2300 is then mounted to the body 12 of the kayak 10, Once the interface 300, 1300, 1350 or 2300 is properly mounted to the body 12, the user has the possibility to removably mount the foot propulsion mechanism 500 to the interface 300, for instance when the kayak 10 is floating on a water surface. To do so, the user engages the lower part of the flappers 542*a*, 542*b* into the channel 402 of the top portion 304, and gradually lowers down the foot propulsion mechanism 500. When the core support 514 of the foot propulsion mechanism gradually engages the channel 402, the left and right transverse projections 548*a*, 548*b* engage lower funnel-shape slots 444 while the shaft 524 engages the top funnel slot 446. As the foot propulsion mechanism 500 is further lowered down, the shaft 524 forces the lock 450 pivotably mounted in the lock receiving recess 448 toward their unlock position, until the shaft 524 reaches its position in the top funnel slot 446. In such position, the lock 450 are allowed to pivot back to their lock position, where the convex lower end 454 of the lock 450 engage the shaft 524 to prevent unwanted removal of the foot propulsion mechanism 500. Furthermore, when the foot propulsion mechanism 500 is properly positioned in the interface 300, the resting surfaces 554,556 provided at the front and rear ends 550, 552 of the upright mounting support 544 of the core support 514 lie on the abutments 432, 434 of the front and rear slots 428, 430 defined in the channel 402, while the shaft 562 and the flappers 542*a*, 542*b* extend below the hull 24. As it will be appreciated, the left and right transverse projections 548*a*, 548*b*, the shaft 524 and the front and rear ends 550, 552 of the upright mounting support 544, as well as the shape of the horizontal base 526 of the core support 514 (which substantially correspond to the shape of the channel 402), collaborated with the various portions of the interface 300 to prevent movement of foot propulsion mechanism 500 relative to the interface 300 during the operation.

When the user wants to remove the foot propulsion mechanism 500 from the interface 300, for instance to facilitate transport of the kayak 10, the user forces the locks 450 toward their unlock position by engaging the grip elements 458 at the concave upper ends 456, thereby allowing the shaft 524 to travel upwardly in the channel 402. The user then pulls on the foot propulsion mechanism 500 to disengage the same from the interface 300, 1300 or 2300.

With respect to interface 3300, the process is essentially similar, except that the interface 3300 is removably secured to and removed from the body of the kayak with the propulsion mechanism attached thereto.

In an alternate embodiment, the interface 300, 1300, 2300, or similar interfaces or components thereof, could be manufactured such that they be integrated to the body of the watercraft at the time of the manufacture. For instance, in some embodiments, there could be provided a method or process for manufacturing a watercraft including a rigid body having a deck portion, a hull portion and an embedded propeller interface extending between the deck portion and the hull portion by thermoforming, the method or process comprising:

- Providing a mold including a deck shell and a hull shell, the deck shell and hull shell being movable relative to one another between an open position and a closed position;
- Providing a propeller interface (e.g. interfaces 300, 1300, 1350 or 2300) including deck end and a hull end, the propeller interface being made of a first plastic material (e.g. by plastic injection);
- Providing first and second sheets of a second, thermoformable plastic material;
- Moving the deck shell and the hull shell in the open position;
- Positioning the first sheet of the second, thermoformable plastic material adjacent to one of the deck portion and the hull portion;
- Positioning the second sheet of the second thermoformable plastic material adjacent to the other of the deck portion and the hull portion;
- Positioning the propeller interface between the first and second sheets of the second, thermoformable material;
- Moving the deck shell and the hull shell of the mold in the closed position;
- Simultaneously thermoforming the deck portion and the hull portion to obtain the rigid body;
- Moving the deck shell and the hull shell of the mold in the open position; and
- Removing the rigid body of the watercraft including the interface from the mold.

While the kayak 10 has been described in connection with the embodiment illustrated in FIGS. 1 to 49, it will be understood that variations are possible without departing from the scope of the invention. For instance, while the interfaces 300, 1300, 1350, 2300, and 3300 and foot propulsion mechanism 500 are described in connection with a kayak 10 provided with a single seat 28, they could also be used in connection with a tandem kayak, or with any other type of watercraft, including small boats, a paddleboards and pedal boats. Likewise, while the foot propulsion mechanism 500 described in the illustrated embodiment is an oscillating flapper propulsion system, it will be understood that the interfaces 300, 1300, 1350, 2300, and 3300 could be used in conjunction with other types of propulsion mechanisms, such as hand operated propulsion mechanisms, motorised propulsion mechanisms such as electric motors and gas motors, whether they are of the flapper oscillating type, propeller type or blade type. Furthermore, the interface 300, 1300, 2300 or 3300 could be used in conjunction with plugs configured to be received in the channel and concealing the same when no propulsion mechanism is used, for instance when the user propels the kayak 10 with paddles.

The embodiments described above are intended to be exemplary only. The scope of the invention is therefore intended to be limited solely by the appended claims.

The invention claimed is:

1. A kayak comprising:

a substantially rigid body having a deck side, a hull side, and a well extending through the deck side and the hull side;

an interface for mounting a foot-driven propulsion mechanism to the substantially rigid body, the interface including:

a first portion near to the hull side or the deck side, the first portion comprising a first hole for allowing passage of at least a portion of the foot-driven propulsion mechanism therethrough;

a second portion near to the other of the hull side or the deck side on an opposite side of the well from the first portion, the second portion comprising a second hole for allowing passage of at least a portion of the foot-driven propulsion mechanism therethrough, wherein the second portion is a separate component from at least the first portion; and a channel structure disposed in the well between the first portion and the second portion, the channel structure being sized and shaped for allowing passage of a portion of the foot-driven propulsion mechanism therethrough and for removably securing the foot-driven propulsion mechanism to the interface, wherein a distal end of the channel structure is securely coupled to the first portion and/or the second portion.

2. The kayak as claimed in claim 1, wherein the channel structure is glued to the first portion and/or the second portion.

3. The kayak as claimed in claim 1, wherein the distal end of the channel structure securely mates with the first portion and/or the second portion via a projection and a corresponding recess.

4. The kayak as claimed in claim 1, wherein the distal end of the channel structure securely mates with the first portion and/or the second portion via multiple projections and corresponding recesses.

5. The kayak as claimed in claim 1, wherein the channel structure is integrally formed with, and extends away from, the first portion, and multiple projections and corresponding recesses mate with one another to couple the channel structure with the second portion.

6. The kayak as claimed in claim 5, wherein the channel structure is glued to the second portion.

7. The kayak as claimed in claim 5, wherein the channel structure is plastic-welded to the first portion or second portion.

8. The kayak as claimed in claim 2, further comprising drainage holes in the interface through which water can drain.

9. The kayak as claimed in claim 8, wherein the interface further comprises at least one guide extending from the second portion to align the channel structure with the second hole of the second portion.

10. The kayak as claimed in claim 9, wherein the at least one guide defines a lip for receiving a portion of the channel structure thereon.

11. The kayak as claimed in claim 10, wherein the lip extends at least partially around a periphery of the second hole of the second portion.

12. The kayak as claimed in claim 1, wherein the well structure includes a recess near the deck side and a recess near the hull side, wherein each of the first portion and the second portion are disposed within a respective recess at the hull side or the deck side.

13. The kayak as claimed in claim 1, wherein the interface further comprises at least one guide extending from the first portion to align the channel structure with the first hole of the first portion.

14. The kayak as claimed in claim 1, wherein the interface and the substantially rigid body of the kayak are formed by different plastic molding processes.

15. The kayak as claimed in claim 1, further comprising drainage holes in the interface through which water can drain.

16. The kayak as claimed in claim 1, further comprising a fastener for coupling the interface to the kayak, wherein the fastener comprises either screws and corresponding holes or a snapfit.

17. The kayak as claimed in claim 1, wherein the interface is removably coupled to the kayak.

18. A kayak comprising:

a substantially rigid body having a deck side, a hull side, and a well extending through the deck side and the hull side, wherein the well includes a recess near the deck side;

an interface for mounting a foot-driven propulsion mechanism to the substantially rigid body, the interface including:

a first portion disposed in the recess near to the deck side of the kayak;

a channel structure extending from the first portion, the channel structure disposed in the well, wherein the channel structure is sized and shaped for receiving therein at least a portion of the foot-driven propulsion mechanism and for removably securing the foot-driven propulsion mechanism to the interface; and multiple screws securing the first portion to the kayak.

19. The kayak as claimed in claim 18, wherein the channel structure is integrally formed with the first portion by different plastic molding processes than that used to form the kayak.

20. The kayak as claimed in claim 18, wherein the channel structure is a separate component from the first portion, wherein both the channel structure and the first portion are formed by different plastic molding processes than that used to form the kayak, and wherein the channel structure is glued to the first portion.

21. A kayak extending longitudinally between rear and front ends and transversely between left and right sides, the kayak comprising:

a foot-driven propulsion mechanism comprising first and second shafts with first and second pedals, first and second flappers, and a core body between the first and second shafts and first and second flappers, the core body comprising first and second projections comprising first and second ends;

a body comprising a deck portion with a top side and a hull portion with a bottom side adapted to contact water, wherein the top side comprises a top peripheral wall section defining a top opening and wherein the bottom side comprises a bottom peripheral wall section defining a bottom opening; and an interface comprising top and bottom plates and a channel portion extending between the top and bottom plates, the top plate comprising a top peripheral wall section defining a top opening adapted to at least partially receive the foot-driven propulsion mechanism and the bottom plate comprising a bottom peripheral wall section defining a bottom opening adapted to at least partially receive the foot-driven propulsion mechanism, wherein the channel portion comprises an internal peripheral wall defining a hollow space to at least partially receive the foot-driven propulsion mechanism, wherein the internal peripheral wall of the interface comprises first and second projections or recesses;

wherein the first and second ends of the first and second projections are mounted to the first and second projections or recesses.

22. The kayak of claim 21, wherein the top peripheral wall section of the deck portion comprises a top peripheral recess, wherein the bottom peripheral wall section of the deck portion comprises a bottom peripheral recess, wherein the top peripheral wall section of the interface is received in the top peripheral recess, and wherein the bottom peripheral wall section of the interface is received in the bottom peripheral recess.

23. The kayak of claim 22, wherein the top peripheral wall section of the interface is snap-fit or friction fit into the top peripheral recess and wherein the bottom peripheral wall section of the interface is snap-fit or friction fit into the bottom peripheral recess.

24. The kayak of claim 22, wherein the top peripheral wall section of the interface is secured to the top peripheral recess with treaded fasteners or rivets and wherein the bottom peripheral wall section of the interface is secured to the bottom peripheral recess with treaded fasteners or rivets.

25. The kayak of claim 22, wherein the top peripheral wall section of the interface is glued or plastic welded to the top peripheral recess and wherein the bottom peripheral wall section of the interface is glued or plastic welded to the bottom peripheral recess.

26. The kayak of claim 21, wherein the channel portion of the interface is integrally formed with the top plate or the bottom plate.

27. The kayak of claim 21, wherein the first and second projections are rear and front projections, wherein the first and second projections or recesses are rear and front projections or recesses, wherein the core body of the foot-driven propulsion mechanism comprises left and right projections comprising left and right ends, wherein the internal peripheral wall of the interface comprises left and right projections or recesses, and wherein the left and right ends of the left and right projections are mounted to the left and right projections or recesses.

28. The kayak of claim 21, wherein the channel portion of the interface comprises first and second side walls, wherein each of the first and second side walls comprises a first recess, a second recess terminating into a lower funnel-shape slot, and a top funnel slot, wherein the first recess has a shape to generally conform to a periphery of the core body of the foot propulsion mechanism, and wherein the lower funnel-shaped slot is adapted to receive left and right transverse projections of the core body of the foot propulsion mechanism.

29. The kayak of claim 28, wherein the top funnel slot is adapted to at least partially receive the core body of the foot propulsion mechanism.

30. The kayak of claim 29, comprising a lock that is pivotable between an unlocked position and a locked position, wherein in the locked position, movement of the foot propulsion mechanism is prevented.

* * * * *